US011512256B2

(12) United States Patent
Huq et al.

(10) Patent No.: US 11,512,256 B2
(45) Date of Patent: Nov. 29, 2022

(54) NON-AQUEOUS EXTRACTION OF BITUMEN FROM OIL SANDS

(71) Applicant: SUNCOR ENERGY INC., Calgary (CA)

(72) Inventors: Iftikhar Huq, Calgary (CA); Ali Abbaspour, Calgary (CA); Brian Doucette, Calgary (CA); Alexander Hyndman, Calgary (CA); Billy James Rideout, Calgary (CA)

(73) Assignee: SUNCOR ENERGY INC., Calgary (CA)

( * ) Notice: Subject to any disclaimer, the term of this patent is extended or adjusted under 35 U.S.C. 154(b) by 78 days.

(21) Appl. No.: 16/811,929

(22) Filed: Mar. 6, 2020

(65) Prior Publication Data

US 2021/0047569 A1 Feb. 18, 2021

(51) Int. Cl.
*C10G 1/04* (2006.01)

(52) U.S. Cl.
CPC ..... *C10G 1/045* (2013.01); *C10G 2300/44* (2013.01)

(58) Field of Classification Search
CPC ..... C10G 1/045
See application file for complete search history.

(56) References Cited

U.S. PATENT DOCUMENTS

| | | | |
|---|---|---|---|
| 5,316,659 | A | 5/1994 | Brons et al. |
| 8,226,820 | B1 | 7/2012 | Wegner |
| 8,980,080 | B2 | 3/2015 | Keseoglu et al. |
| 9,266,730 | B2 | 2/2016 | Kresnyak |
| 9,650,578 | B2 | 5/2017 | Klerk et al. |
| 2005/0150844 | A1 | 7/2005 | Hyndman et al. |
| 2013/0098735 | A1 | 4/2013 | Corscadden et al. |
| 2014/0069641 | A1 | 3/2014 | Kosik et al. |

FOREIGN PATENT DOCUMENTS

| | | | | | |
|---|---|---|---|---|---|
| CA | 1069451 | A | | 1/1980 | |
| CA | 1085763 | A | | 9/1980 | |
| CA | 1098466 | A | | 3/1981 | |
| CA | 1107670 | A | * | 8/1981 | ..... C10G 1/04 |
| CA | 1107670 | A | | 8/1981 | |
| CA | 1148104 | A | * | 6/1983 | ..... C10G 1/006 |
| CA | 1148104 | A | | 6/1983 | |
| CA | 1160586 | A | | 1/1984 | |
| CA | 1249976 | A | | 2/1989 | |
| CA | 1291435 | C | | 10/1991 | |
| CA | 2147943 | C | | 12/1996 | |
| CA | 2149737 | C | | 3/1999 | |
| CA | 2217300 | C | | 8/2002 | |
| CA | 2263858 | A1 | | 5/2006 | |
| CA | 2706665 | A1 | | 6/2009 | |
| CA | 2582078 | C | | 12/2010 | |
| CA | 2773089 | A1 | | 3/2011 | |
| CA | 2580098 | C | | 5/2011 | |
| CA | 2785852 | A1 | | 7/2011 | |
| CA | 2520943 | C | | 11/2011 | |
| CA | 2704927 | A1 | | 11/2011 | |
| CA | 2759610 | A1 | | 5/2012 | |
| CA | 2740670 | A1 | * | 11/2012 | ..... C10G 21/003 |
| CA | 2783845 | A1 | | 1/2013 | |
| CA | 2645267 | C | | 4/2013 | |
| CA | 2753811 | C | | 10/2013 | |
| CA | 2740935 | C | | 12/2013 | |
| CA | 2762444 | C | | 5/2014 | |
| CA | 2740468 | A1 | | 7/2014 | |
| CA | 2741280 | A1 | | 8/2014 | |
| CA | 2747004 | C | | 9/2014 | |
| CA | 2740670 | C | | 10/2014 | |
| CA | 2751719 | A1 | | 2/2015 | |
| CA | 2803977 | C | | 2/2015 | |
| CA | 2740481 | A1 | | 4/2015 | |
| CA | 2797513 | A1 | | 4/2015 | |
| CA | 2599741 | C | | 5/2015 | |
| CA | 2738194 | A1 | | 6/2015 | |
| CA | 2875040 | A1 | | 6/2015 | |
| CA | 2771236 | C | | 8/2015 | |
| CA | 2804232 | A1 | | 8/2015 | |
| CA | 2747913 | A1 | | 11/2015 | |
| CA | 2832931 | C | | 2/2016 | |
| CA | 2833353 | C | | 2/2016 | |
| CA | 2837968 | C | | 3/2016 | |
| CA | 2852087 | A1 | | 4/2016 | |
| CA | 2963782 | A1 | | 4/2016 | |
| CA | 2913614 | C | | 6/2016 | |
| CA | 2912884 | A1 | | 7/2016 | |
| CA | 2913617 | C | | 7/2016 | |
| CA | 2913619 | C | | 7/2016 | |
| CA | 2937325 | A1 | | 7/2016 | |
| CA | 2640448 | C | | 11/2016 | |
| CA | 2863487 | A1 | | 1/2017 | |
| CA | 2907155 | A1 | | 1/2017 | |
| CA | 2867357 | A1 | | 10/2017 | |
| CA | 2895118 | C | | 10/2017 | |
| CA | 2864021 | C | | 12/2017 | |
| CA | 2953038 | C | | 1/2018 | |
| CA | 2870944 | C | | 2/2018 | |
| CA | 2789383 | C | | 3/2018 | |
| CA | 2814707 | A1 | | 6/2018 | |

(Continued)

*Primary Examiner* — Randy Boyer
(74) *Attorney, Agent, or Firm* — Marshall, Gerstein & Borun LLP

(57) ABSTRACT

A non-aqueous process for producing bitumen from oil sands is provided, and includes contacting oil sands and solvent to produce solvent diluted bitumen and solvent diluted tailings. The solvent diluted bitumen is subjected to a first fines separation stage that produces an overflow solvent diluted bitumen stream with residual fines that is subjected to a second fines separation stage to remove residual fines and produce a solvent diluted bitumen stream, which is subjected to solvent recovery. The fines streams are subjected to washing to produce washed tailings and solvent wash liquor comprising solvent and bitumen. Another non-aqueous process for producing bitumen from oil sands is provided, and includes subjecting oil sands to solvent extraction, including displacing the oil sands material and a solbit counter-currently and horizontally, and recovering a bitumen enriched solbit stream which is subjected to fines separation and subjecting the solvent diluted bitumen stream to solvent recovery.

33 Claims, 46 Drawing Sheets

(56) References Cited

FOREIGN PATENT DOCUMENTS

| | | | | | |
|---|---|---|---|---|---|
| CA | 2937235 | A1 | | 6/2018 | |
| CA | 2857131 | A1 | | 9/2018 | |
| CA | 2979231 | A1 | | 10/2018 | |
| CA | 2771733 | A1 | | 11/2018 | |
| CA | 2961594 | A1 | | 12/2018 | |
| CA | 2932863 | C | | 1/2019 | |
| CA | 3021685 | C | | 2/2019 | |
| CA | 2932853 | C | | 3/2019 | |
| CA | 2855693 | C | | 6/2019 | |
| WO | WO-2006044485 | A3 | * | 10/2006 | ..... C10G 1/04 |
| WO | 2013103447 | A3 | | 1/2014 | |
| WO | 2018102831 | A1 | | 6/2018 | |

* cited by examiner

NON-AQUEOUS EXTRACTION OF BITUMEN FROM OIL SANDS

TECHNICAL FIELD

The technical field generally relates to processing mined oil sands, and more particularly to the extraction of bitumen from mined oil sands using non-aqueous extraction techniques.

BACKGROUND

Conventional methods for the extraction of bitumen from oil sands rely on mixing the oil sands with water to form an aqueous slurry and then separating the slurry into fractions including bitumen froth and aqueous tailings. The bitumen froth is then treated to remove residual water and solids, while the aqueous tailings are stored in tailings ponds and/or subjected to processing. Water-based extraction methods have various challenges related to water demand and processing requirements; energy requirements to heat aqueous streams to operating temperatures to facilitate extraction; as well as the production, handling and disposal of aqueous tailings materials.

SUMMARY

Non-aqueous extraction (NAE) processes for producing a bitumen product from oil sands material can provide advantages related to reduced water demand and reduced aqueous tailings production. Non-aqueous extraction of bitumen can be carried out using a low boiling point organic solvent that has a high solubility for bitumen and allows separation from the bitumen after extraction. The solid mineral materials from which bitumen is extracted can be washed, drained, dried and disposed of readily into a mine pit as reclamation material, thereby facilitating mine reclamation and reducing tailings management requirements.

In one implementation, a non-aqueous extraction process for producing a bitumen product from oil sands material, includes the following steps: crushing oil sands ore to produce a crushed oil sands material; sizing the crushed oil sands material to produce a sized oil sands material; subjecting the sized oil sands material to non-aqueous bitumen extraction including adding a solvent having a lower boiling point than bitumen to dissolve bitumen present in the oil sands material and facilitate extraction and separation of the bitumen from mineral solids in the oil sands material, thereby producing a solvent diluted bitumen stream comprising bitumen, solvent and fine mineral solids and a solvent diluted tailings stream comprising coarse mineral solids, bitumen and solvent; separating fine mineral solids from the solvent diluted bitumen stream to produce a solvent affected fine tailings stream and a bitumen enriched stream; subjecting the solvent diluted tailings stream to solvent recovery to produce recovered solvent that can be recycled back into the process and a solvent-depleted tailings material for disposal.

One notable approach can be the integration of multiple functionalities—such as digestion, extraction and separation—into a single integrated unit. For example, the integrated extraction unit can be a settler type extractor with an upper separation zone and recirculation systems for digestion and extraction; or an auger type extractor with a separation zone in the main vessel and an auger conveyor for digestion, extraction as well as some washing along the conveyor. Another integrated extractor that can be used includes a primary extraction assembly including an extraction trough housing a rotating element, which can rotate about the longitudinal axis of the extraction trough, the primary extraction assembly being coupled to a classifier assembly containing an auger, where the solbit and the solids move counter-currently through the extractor. A number of other examples of integrated units for NAE processing are described herein.

Various other techniques are described herein for enhanced non-aqueous extraction of bitumen from oil sands. For example, removing solvent from the solvent diluted tailings can include washing the solvent diluted tailings stream with solvent wash to produce a solvent wash liquor and a washed solvent affected tailings material; draining the washed solvent affected tailings stream to produce solvent drainage and a drained solvent affected tailings material; subjecting the drained solvent affected tailings material to drying to evaporate solvent contained therein and produce dried solvent depleted tailings and recovered solvent vapour. The solvent wash liquor, the solvent drainage, and/or solvent recovered from drying can be recycled for use in the non-aqueous bitumen extraction step and/or the washing of the solvent diluted tailings stream. Fresh solvent can be used in the washing step, and the solvent containing stream that is used for the extraction step can include solvent wash liquor and/or other bitumen-containing solvent streams.

In several implementations, substantially no extraneous water is added to the digestion, extraction, separation, washing or drying parts of the process such that the only water that is present is in the oil sands ore itself. It should nevertheless be noted that water could be added to various parts of the process for particular purposes, such as enhancing fluidity of certain streams or performing other functions. In some cases, steam can be used to perform certain functions such as heating and/or pressurizing. Liquid water can be added into the dried solvent depleted tailings to aid in dust suppression and transport, for example.

Several innovative process configurations and unit designs are described herein for NAE of bitumen from oil sands.

In one aspect, there is provided a non-aqueous extraction process for producing a bitumen product from oil sands material. The process includes the steps of crushing oil sands ore to produce a crushed oil sands material; sizing the crushed oil sands material to produce a sized oil sands material; subjecting the sized oil sands material to non-aqueous bitumen extraction including adding a solvent having a lower boiling point than bitumen to dissolve bitumen present in the oil sands material and facilitate extraction and separation of the bitumen from mineral solids in the oil sands material, thereby producing a solvent diluted bitumen stream comprising bitumen, solvent and fine mineral solids and a solvent diluted tailings stream comprising coarse mineral solids, bitumen and solvent; separating fine mineral solids from the solvent diluted bitumen stream to produce a solvent affected fine tailings stream and a bitumen enriched stream; washing the solvent diluted tailings stream with solvent wash to produce a solvent wash liquor and a washed solvent affected tailings material; draining the washed solvent affected tailings stream to produce solvent drainage and a drained solvent affected tailings material; subjecting the drained solvent affected tailings material to drying to evaporate solvent contained therein and produce dried solvent depleted tailings and recovered solvent vapour; condensing the recovered solvent vapour to produce condensed solvent; disposing of the dried solvent depleted tailings; recycling the solvent wash liquor, the solvent drainage, and the condensed solvent for use in the non-aqueous bitumen extraction and/or the washing of the solvent diluted tailings stream; and processing the bitumen enriched stream to produce a bitumen product.

In another aspect, there is provided an integrated extractor for non-aqueous extraction of bitumen from oil sands material and providing digestion, extraction and separation functionalities. The integrated extractor includes a main vessel having an upper portion for settling of fine solids from a diluted bitumen material; a lower portion for receiving settled mineral solids; and a liquid outlet for withdrawing a solvent diluted bitumen stream. The main vessel being oxygen depleted and inerted. The integrated extractor further includes an oil sands feed line for supplying the oil sands material into the main vessel; at least one solvent inlet for supplying solvent into the extractor; a rotating conveyor having a lower upstream end located in the lower portion of the main vessel and an upper downstream end, the rotating conveyor having a housing defining a conduit through which solids in the oil sands material are transported toward the upper downstream end and a displacement system disposed within the housing and configured to mix the oil sands material with solvent and displace the solids toward the upper downstream end during rotation of the displacement system. At the lower upstream end, the displacement system receives and engages solvent and oil sands material to transport the oil sands material and solvent toward the upper downstream end while imparting mixing energy thereto. The housing includes an intermediate section for transport of the oil sands material by the displacement system toward the upper downstream end while solvent and extracted bitumen drain back toward the lower upstream end and an outlet at the upper downstream end for discharging a bitumen depleted tailings stream.

In another aspect, there is provided a dual-auger extractor for non-aqueous extraction of bitumen from oil sands material, the dual-auger extractor including a main vessel having an upper portion for settling of fine solids from a diluted bitumen material; a lower portion for receiving settled mineral solids; and a liquid outlet for withdrawing a solvent diluted bitumen stream, wherein the main vessel is oxygen depleted and inerted. The dual-auger extractor further including an oil sands feed line for supplying the oil sands material into the main vessel; a solvent inlet coupled to the feed line and/or the main vessel for supplying a solvent containing stream into the vessel; a dual-auger conveyor having a lower upstream end located in the lower portion of the main vessel and an upper downstream end, the auger conveyor having two side-by-side augers; a housing in which the at least one auger is accommodated and a motor system configured for driving rotation of the augers within the housing, wherein at the lower upstream end, the augers receive and engage solvent and oil sands material to transport the oil sands material and solvent toward the upper downstream end while imparting mixing energy thereto. The housing also includes an intermediate section for transport of the oil sands material by the augers toward the upper downstream end while solvent and extracted bitumen drain back toward the lower upstream end; and an outlet at the upper downstream end for discharging a bitumen depleted tailings stream. The dual-auger extractor also includes at least one conveyor solvent inlet coupled to the housing for supplying a solvent containing stream into the dual-auger conveyor.

In yet another aspect, there is provided an auger extractor for non-aqueous extraction of bitumen from oil sands material, including a main vessel having a liquid outlet for withdrawing a solvent diluted bitumen stream, wherein the main vessel is oxygen depleted and inerted; an oil sands feed line for supplying the oil sands material into the main vessel; at least one solvent inlet for supplying solvent into the auger extractor; and an auger conveyor having a lower upstream end located in the lower portion of the main vessel and an upper downstream end, the auger conveyor having at least one auger; a housing in which the at least one auger is accommodated and a motor system configured for driving rotation of the at least one auger within the housing, wherein at the lower upstream end the at least one auger engages solvent and oil sands material to transport the oil sands material and solvent toward the upper downstream end while imparting mixing energy thereto. The housing also includes an intermediate section for transport of the oil sands material by the at least one auger toward the upper downstream end while solvent and extracted bitumen drain back toward the lower upstream end; and an outlet at the upper downstream end for discharging a bitumen depleted tailings stream.

In yet another aspect, there is provided an integrated gravity settler extractor for non-aqueous extraction of bitumen from oil sands material, including a sealed vessel having an upper portion for settling of fine solids from a diluted bitumen material, the upper portion comprising inclined plates; a lower portion for receiving settled mineral solids; an overflow outlet for withdrawing the solvent diluted bitumen stream; and an underflow outlet for withdrawing solvent diluted tailings stream, wherein the vessel is oxygen depleted and inerted. The integrated gravity settler extractor further includes an oil sands feed line having a discharge end for supplying the sized oil sands material into the vessel; a solvent inlet for supplying a solvent containing stream into the vessel proximate to the discharge end to contact and impart mixing energy to the sized oil sands material to promote digestion and extraction; and a recirculation system coupled to the vessel for withdrawing liquid material and recirculating the liquid material back into a lower part of the vessel to promote digestion and extraction.

In another aspect, there is provided an integrated gravity settler extractor for non-aqueous extraction of bitumen from oil sands material, including a sealed vessel that is oxygen depleted and inerted, the vessel having an upper portion defining a separation zone for settling of fine solids from a diluted bitumen material; an intermediate portion defining a digestion and extraction zone for receiving sized oil sands material and incoming solvent; a lower portion for receiving settled mineral solids; an upper outlet communicating with the upper portion for withdrawing the solvent diluted bitumen stream; and a lower outlet for withdrawing solvent diluted tailings stream from the lower portion. The integrated gravity settler extractor further includes an oil sands feed line having a discharge end for supplying the sized oil sands material into the intermediate portion of the vessel; a solvent inlet for supplying a solvent containing stream into the intermediate portion of the vessel proximate to the discharge end of the feed line to contact and impart mixing energy to the sized oil sands material; and at least one recirculation system coupled to the vessel for withdrawing material and recirculating the material back into the vessel to promote digestion and extraction.

In another aspect, there is provided a proves for non-aqueous extraction of bitumen from oil sands material, including subjecting oil sands material to non-aqueous bitumen extraction including adding a solvent having a lower boiling point than bitumen to dissolve bitumen present in the oil sands material and facilitate extraction and separation of the bitumen from mineral solids in the oil sands material, thereby producing a solvent diluted bitumen stream comprising bitumen, solvent and fine mineral solids and a solvent diluted tailings stream comprising coarse mineral solids, bitumen and solvent; removing a portion of solvent and bitumen from the solvent diluted tailings stream to produce a solvent affected tailings stream; and subjecting the solvent affected tailings stream to solvent recovery comprising imparting microwave energy thereto to produce solvent depleted tailings and recovered solvent vapour.

In yet another aspect, there is provided a non-aqueous extraction process for producing a bitumen product from oil sands material, including crushing and sizing the oil sands material to produce a sized oil sands material having a maximum lump size of two inches; subjecting the sized oil sands material to non-aqueous bitumen extraction including adding a solvent having a lower boiling point than bitumen to dissolve bitumen present in the oil sands material and facilitate extraction and separation of the bitumen from mineral solids in the oil sands material, thereby producing a solvent diluted bitumen stream comprising bitumen, solvent and fine mineral solids and a solvent diluted tailings stream comprising coarse mineral solids and solvent; separating fine mineral solids from the solvent diluted bitumen stream to produce a solvent affected fine tailings stream and a bitumen enriched stream; removing solvent from the solvent diluted tailings stream to produce a solvent depleted tailings material and recovered solvent; recycling the recovered solvent for reuse in the non-aqueous bitumen extraction; and processing the bitumen enriched stream to produce a bitumen product.

In yet another aspect, there is provided a non-aqueous extraction process for producing a bitumen product from oil sands material, including crushing and sizing the oil sands material to produce a sized oil sands material having a maximum lump size of four inches; subjecting the sized oil sands material to non-aqueous bitumen extraction including adding a solvent having a lower boiling point than bitumen to dissolve bitumen present in the oil sands material and facilitate extraction and separation of the bitumen from mineral solids in the oil sands material, thereby producing a solvent diluted bitumen stream comprising bitumen, solvent and fine mineral solids and a solvent diluted tailings stream comprising coarse mineral solids and solvent; separating fine mineral solids from the solvent diluted bitumen stream to produce a solvent affected fine tailings stream and a bitumen enriched stream; removing solvent from the solvent diluted tailings stream to produce a solvent depleted tailings material and recovered solvent; recycling the recovered solvent for reuse in the non-aqueous bitumen extraction; and processing the bitumen enriched stream to produce a bitumen product.

In yet another aspect, there is provided a non-aqueous extraction process for producing a bitumen product from oil sands material, including crushing and sizing the oil sands material to produce a sized oil sands material; moistening the sized oil sands material with solvent to initiate penetration of the solvent into bitumen rich lumps of the sized oil sands material, to produce a pre-treated oil sands material, wherein the moistening is performed in one or more sealed and inerted upstream units and facilitates subsequent digestion and extraction; supplying the pre-treated oil sands material downstream for digestion, extraction and separation via non-aqueous bitumen extraction including adding a solvent having a lower boiling point than bitumen to dissolve bitumen present in the oil sands material and facilitate extraction and separation of the bitumen from mineral solids in the oil sands material, thereby producing a solvent diluted bitumen stream comprising bitumen, solvent and fine mineral solids and a solvent diluted tailings stream comprising coarse mineral solids, bitumen and solvent; separating fine mineral solids from the solvent diluted bitumen stream to produce a solvent affected fine tailings stream and a bitumen enriched stream; removing solvent from the solvent diluted tailings stream to produce a solvent depleted tailings material and recovered solvent; recycling the recovered solvent for reuse in the non-aqueous bitumen extraction; and processing the bitumen enriched stream to produce a bitumen product.

In yet another aspect, there is provided a non-aqueous extraction process for producing a bitumen product from oil sands material, including crushing and sizing the oil sands material to produce a sized oil sands material; subjecting the sized oil sands material to non-aqueous bitumen extraction including adding a solvent having a lower boiling point than bitumen to dissolve bitumen present in the oil sands material and facilitate extraction and separation of the bitumen from mineral solids in the oil sands material, thereby producing a solvent diluted bitumen stream comprising bitumen, solvent and fine mineral solids and a solvent diluted tailings stream comprising coarse mineral solids, bitumen and solvent; separating fine mineral solids from the solvent diluted bitumen stream to produce a solvent affected fine tailings stream and a bitumen enriched stream; washing the solvent diluted tailings stream with solvent wash to produce a solvent wash liquor and a washed solvent affected tailings material, wherein the washing of the solvent diluted tailings stream includes counter-current washing with input of fresh solvent in a counter-flow rotary drum and includes the steps of supplying the solvent diluted tailings stream into a first end of the counter-flow rotary drum; supplying the solvent wash into at least an opposed second end of the counter-flow rotary drum; withdrawing the solvent wash liquor from the first end of the counter-flow rotary drum; and withdrawing the washed solvent affected tailings stream from the second end of the counter-flow rotary drum. The process further includes supplying at least a portion of the solvent wash liquor for use in the non-aqueous bitumen extraction of the solvent diluted tailings stream; and processing the bitumen enriched stream to produce a bitumen product.

In yet another aspect, there is provided a batch process for non-aqueous extraction of bitumen from oil sands material in a batch extractor comprising a batch vessel and a circulation system, including introducing a quantity of the sized oil sands material into a batch vessel; introducing a quantity of a solvent containing fluid into the batch vessel; sealing the batch extractor to form a generally closed extraction system that includes the batch vessel and the circulation system; circulating material in the batch extractor so as to fluidize the oil sands material and provide digestion and extraction; ceasing circulation and allowing gravity separation of mineral solids from solvent diluted bitumen thereby forming an upper hydrocarbon zone and a lower solids rich zone in the batch vessel; withdrawing a solvent diluted bitumen stream from the upper hydrocarbon zone and forming a solvent diluted tailings material; washing the solvent diluted tailings material to form a washed tailings material; and drying the washed tailings material to form a dried tailings material.

In yet another aspect, there is provided a batch extractor for non-aqueous extraction of bitumen from oil sands material, including a batch vessel configured to receive a quantity of oil sands material and solvent; a circulation system coupled to the batch vessel for withdrawing material from the batch vessel and reintroducing material back into the batch vessel, in order to fluidize the oil sands material and provide digestion and extraction during circulation; a sealing system for sealing the batch vessel and the circulation system to form a generally closed extraction loop for circulation; a solvent diluted bitumen outlet for withdrawing a solvent diluted bitumen from an upper hydrocarbon zone in the batch vessel, the upper hydrocarbon zone and a lower solids rich zone being formed after gravity separation of mineral solids from solvent diluted bitumen.

In another aspect, there is provided a non-aqueous extraction process for producing a bitumen product from oil sands material, including crushing oil sands ore to produce a crushed oil sands material; sizing the crushed oil sands material to produce a sized oil sands material; subjecting the sized oil sands material to non-aqueous bitumen extraction in batch mode in a batch extractor, including introducing a quantity of the sized oil sands material into the batch extractor; introducing a quantity of a solvent containing fluid into the batch extractor; sealing the batch extractor to form a generally closed extraction system, and circulating material in the batch extractor so as to fluidize the oil sands material and provide digestion and extraction; ceasing circulation and allowing gravity separation of mineral solids from solvent diluted bitumen thereby forming an upper hydrocarbon zone and a lower solids rich zone; withdrawing a solvent diluted bitumen stream from the upper hydrocarbon zone and forming a solvent diluted tailings material; preparing the batch extractor for a subsequent batch. The process also includes recovering solvent from the solvent diluted tailings material to produce dried solvent depleted tailings; and processing the solvent diluted bitumen stream to produce a bitumen product.

In another aspect, there is provided an extractor for non-aqueous extraction of bitumen from oil sands, including a primary extraction assembly having an upstream end and a downstream end, the primary extraction assembly having an extractor trough defining a chamber comprising a lower region and an upper region; at least one rotating element operatively mounted within and longitudinally along the lower region of the extractor trough, the rotating element comprising a shaft and a plurality of projections extending outwardly from the shaft; a motor system coupled to the at least one rotating element for driving rotation thereof; and a liquid outlet provided at the upstream end for withdrawing a solvent diluted bitumen stream; and an oil sands feed inlet provided at the upstream end for supplying oil sands material into the primary extraction assembly, wherein rotation of the at least one rotating element provides digestion and extraction of bitumen from the oil sands while advancing solids in a downstream direction, as solvent diluted bitumen accumulates in the upper region of the extractor trough and flows in an upstream direction toward the liquid outlet. The extractor further includes a classifier assembly having a lower upstream end fluidly connected to the downstream end of the primary extraction assembly and an upper downstream end, the classifier assembly including a classifier trough; a conveyance device mounted within the classifier trough and configured to convey the solids from the lower upstream end to the upper downstream end; a solvent inlet provided at the upper downstream end for receiving a solvent containing stream into the classifier trough; and a discharge outlet at the upper downstream end for discharging solvent diluted tailings stream as a generally moist solid or slurry material, wherein the solvent containing stream drains downwardly in the upstream direction through the solids within the classifier trough removing bitumen therefrom and flows into the extractor trough.

In yet another aspect, there is provided an extractor for non-aqueous extraction of bitumen from oil sands, including a first assembly having an upstream end and a downstream end, the first assembly having a first housing defining a chamber comprising a lower region and an upper region; at least one shear conveyor device operatively mounted within and along the lower region of the first housing; a liquid outlet provided at the upstream end for withdrawing a solvent diluted bitumen stream; and an oil sands feed inlet provided at the upstream end for supplying oil sands material into the first assembly, wherein the at least one shear conveyor device is configured to provide digestion and extraction of bitumen from the oil sands while advancing solids in a downstream direction through the first housing, as solvent diluted bitumen accumulates in the upper region of the first housing and flows in an upstream direction toward the liquid outlet. The extractor further includes a second assembly having an upstream end fluidly connected to the downstream end of the first assembly and a downstream end, the second assembly having a second housing that is elongated and inclined upwardly in the downstream direction; a conveyance device mounted within the second housing and configured to convey the solids from the upstream end to the upper downstream end; a solvent inlet provided at the downstream end for receiving a solvent containing stream into the second housing; and a discharge outlet at the downstream end for discharging solvent diluted tailings stream, wherein the solvent containing stream flows in the upstream direction counter-currently with respect to the solids within the second housing, thereby removing bitumen from the solids and flowing into the first housing.

In another aspect, there is provided an extractor for non-aqueous extraction of bitumen oil sands, including a first elongated horizontal assembly having an upstream end and a downstream end, a liquid outlet, and an oil sands feed inlet, the first elongated horizontal assembly configured to provide digestion and extraction of bitumen from oil sands supplied via the oil sands feed inlet while advancing solids in a downstream direction, and allowing solvent diluted bitumen to separate and accumulate above the solids while flowing in an upstream direction counter-currently with respect to the advancing solids and out of the liquid outlet; and a second assembly having an upstream end fluidly connected to the downstream end of the first assembly and a downstream end, a solvent inlet and a solids discharge, the second assembly being configured to convey the solids downstream to the solids discharge while flowing solvent from the solvent inlet in an upstream direction counter-currently with respect to the conveyed solids, thereby removing bitumen from the solids and flowing into the first elongate horizontal assembly.

In yet another aspect, there is provided an extractor for non-aqueous extraction of bitumen from oil sands, including a first section that is elongated and horizontal and comprises an upstream portion configured to receive a feed of oil sands ore and to produce a solvent diluted bitumen stream, and a downstream portion to receive solvent; and a second section that is inclined and comprises an upper downstream portion having a solvent inlet for receiving solvent and a lower upstream portion in fluid communication with the downstream portion of the first section, the second section being configured to flow solvent to the first section, receive solids therefrom, and convey the solids to the downstream portion of the second section.

In another aspect, there is provided a process for extracting bitumen from oil sands, including feeding oil sands and solvent to an extractor to produce a solvent diluted bitumen and a solvent diluted tailings comprising coarse mineral solids; supplying the solvent diluted bitumen to a first fines separator to produce a separator bottoms stream that includes solvent, residual bitumen and fines and an overflow solvent diluted bitumen stream with residual fines; supplying the overflow solvent diluted bitumen stream to a second fines separator to remove residual fines and produce a solvent diluted bitumen stream that is subjected to solvent recovery; supplying the fines streams to a washing stage to remove residual bitumen.

In yet another aspect, there is provided a process for extracting bitumen from oil sands, including displacing an oil sands material and a solbit liquid in counter-current and generally horizontal fashion with respect to each other, thereby forming a lower sand zone in contact with an upper solbit zone, the lower sand zone being subjected to mixing to extract bitumen from the oil sands material and cause extracted bitumen to dissolve into the solbit zone, wherein the lower sand zone has an upstream sand region having a high bitumen content; and a downstream sand region having a lower bitumen content compared to the upstream sand region; and the upper solbit zone includes an upstream solbit region above the downstream region lower sand zone and having a low bitumen content; and a downstream solbit region above the upstream region of the lower sand zone and having a high bitumen content. The process further includes recovering a bitumen enriched solbit stream from the downstream solbit region of the upper solbit zone.

In yet another aspect, there is provided a non-aqueous process for producing bitumen from oil sands, including contacting oil sands and solvent in an extraction stage to produce a solvent diluted bitumen and a solvent diluted tailings comprising coarse mineral solids; subjecting the solvent diluted bitumen to a first fines separation stage to produce a bottoms stream that includes solvent, residual bitumen and fines and an overflow solvent diluted bitumen stream with residual fines; subjecting the overflow solvent diluted bitumen stream to a second fines separation stage to remove residual fines and produce a second bottoms stream and a solvent diluted bitumen stream; subjecting the solvent diluted bitumen stream to solvent recovery to produce recovered solvent and a bitumen product; and subjecting the fines streams to a washing stage to remove residual bitumen, to produce a washed tailings and a solvent wash liquor comprising solvent and bitumen.

In some implementations, the first fines separation stage utilizes gravity separation.

In some implementations, the second fines separation stage utilizes enhanced solid-liquid separation.

In some implementations, the first fines separation stage utilizes an inclined plate separator and the second fine separation stage utilises a vertical centrifuge.

In some implementations, the first fines separation stage is operated to effect bulk fines removal and the second fines separation stage is operated to effect polishing to remove residual fines.

In some implementations, the first fines separation stage is operated to produce the overflow solvent diluted bitumen stream having below 5 wt % solids content.

In some implementations, the solvent diluted tailings and the first and second bottoms streams are combined and supplied together to the washing stage to produce the washed tailings and the solvent wash liquor.

In some implementations, the washing stage comprises filtration.

In some implementations, the washing stage comprises overhead washing.

In some implementations, at least a portion of the solvent wash liquor is supplied back into the extraction stage.

In some implementations, the solvent diluted bitumen is pumped from the extraction stage to the first fines separation stage.

In some implementations, the solvent diluted tailings are mixed with a fluidizing stream before being pumped to the washing stage.

In some implementations, at least part of the fluidizing stream comprises part of the solvent wash liquor from the washing stage.

In some implementations, the extraction stage is operated so as to perform the steps of displacing the oil sands and a solbit liquid comprising the solvent in counter-current and generally horizontal fashion with respect to each other, thereby forming a lower sand zone in contact with an upper solbit zone, the lower sand zone being subjected to mixing to extract bitumen from the oil sands material and cause extracted bitumen to dissolve into the solbit zone, wherein the lower sand zone comprises an upstream sand region having a high bitumen content; and a downstream sand region having a lower bitumen content compared to the upstream sand region; and the upper solbit zone comprises: an upstream solbit region above the downstream region lower sand zone and having a low bitumen content; and a downstream solbit region above the upstream region of the lower sand zone and having a high bitumen content; and producing the solvent diluted bitumen from the downstream solbit region of the upper solbit zone.

In some implementations, the extraction stage is operated with counter-current flow of liquids and solids.

In some implementations, the solvent is preheated prior to being fed into the extraction stage.

In some implementations, the solvent supplied to the extraction stage is obtained in part from the solvent wash liquor.

In yet another aspect, there is provided a non-aqueous process for producing bitumen from oil sands, including subjecting oil sands to solvent extraction in an extraction stage to produce a solvent diluted bitumen and a solvent diluted tailings comprising coarse mineral solids, wherein the extraction stage comprises: displacing an oil sands material and a solbit liquid in counter-current and generally horizontal fashion with respect to each other, thereby forming a lower sand zone in contact with an upper solbit zone, the lower sand zone being subjected to mixing to extract bitumen from the oil sands material and cause extracted bitumen to dissolve into the upper solbit zone, wherein the lower sand zone comprises an upstream sand region having a high bitumen content; and a downstream sand region having a lower bitumen content compared to the upstream sand region; and the upper solbit zone comprises an upstream solbit region above the downstream region of the lower sand zone and having a low bitumen content; and a downstream solbit region above the upstream region of the lower sand zone and having a high bitumen content; and recovering a bitumen enriched solbit stream as the solvent diluted bitumen from the downstream solbit region of the upper solbit zone; subjecting the solvent diluted bitumen to fines separation to produce fines enriched material that includes solvent, residual bitumen and fines and a solvent diluted bitumen stream depleted in fines; and subjecting the solvent diluted bitumen stream to solvent recovery to produce a bitumen product and recovered solvent.

In some implementations, the extraction stage further comprises displacing a bitumen depleted sand from the downstream sand region of the lower sand zone vertically above the upper solbit zone to produce an elevated bitumen depleted sand; and draining solvent and bitumen from the elevated bitumen depleted sand back into the upper solbit zone to thereby form the solvent diluted tailings.

In some implementations, the process further comprises adding a solvent containing stream into the elevated bitumen depleted sand to wash bitumen therefrom.

In some implementations, the process further comprises discharging the solvent diluted tailings as a solbit drained solid rich material.

In some implementations, the displacing and mixing is performed so that the lower sand zone is in slumped bed conditions.

In some implementations, the displacing and mixing is performed so that the lower sand zone is in expanded fluidized bed conditions.

In some implementations, subjecting the solvent diluted bitumen to fines separation comprises subjecting the solvent diluted bitumen to a first fines separation stage to produce a first bottoms stream that includes solvent, residual bitumen, the majority of fines and an overflow solvent diluted bitumen stream with residual fines; and subjecting the overflow solvent diluted bitumen stream to a second fines separation stage to remove residual fines and produce a second bottoms stream and a solvent diluted bitumen stream that is subjected to solvent recovery.

In some implementations, the first fines separation stage utilizes gravity separation and the second fines separation stage utilizes enhanced solid-liquid separation.

In some implementations, the first fines separation stage utilizes an inclined plate separator and the second fine separation stage utilises a vertical centrifuge.

In some implementations, the first fines separation stage is operated to effect bulk fines removal to below 5 wt % solids content, and the second fines separation stage is operated to effect polishing to remove residual fines.

In some implementations, the solvent diluted tailings and the first and second bottoms stream are combined and supplied together to a washing stage to produce washed tailings and solvent wash liquor.

In some implementations, a portion of the solvent wash liquor is supplied back into the extraction stage, and another portion of the solvent wash liquor is added to the solvent diluted tailings discharged from the extraction stage to enable fluidization thereof prior to pumping to the washing stage.

In some implementations, the portion of the solvent wash liquor supplied back into the extraction stage is preheated prior to being fed into the extraction stage.

DETAILED DESCRIPTION

Techniques described herein leverage the use of hydrocarbon solvent to extract bitumen from mined oil sands. Non-aqueous extraction (NAE) of bitumen can be carried out using a low boiling point organic solvent that has a high solubility for bitumen and allows easy separation from the bitumen after extraction. The solvent containing stream added to the oil sands for extraction can include both solvent as well as bitumen or bitumen derived materials, and can be referred to as "solbit". It is also noted that the term "solbit" can be used in the context of other streams and zones present in vessels that include a mixture of solvent and bitumen. The solid mineral materials from which bitumen is extracted can be disposed readily into a mine pit as reclamation material, thereby facilitating mine reclamation and significantly reducing tailings management requirements.

Non-aqueous extraction of bitumen with hydrocarbon solvents has potential for processing a broad range of oil sands ore qualities (e.g., 5 wt %-13 wt % bitumen), producing dry trafficable tailings material with less land disturbance, and lowering green house gas (GHG) emissions per barrel of bitumen compared to aqueous extraction techniques.

Various enhancements and advantageous techniques are described herein in the context of non-aqueous extraction. One notable approach can be the integration of multiple functionalities that are typically performed in multiple units—such as digestion, extraction and separation—into a single unit. Other processes and systems described herein also provide advantages in the context of recovering bitumen from oil sands ore and related processing.

Overall Non-Aqueous Extraction Process

Figure 1:
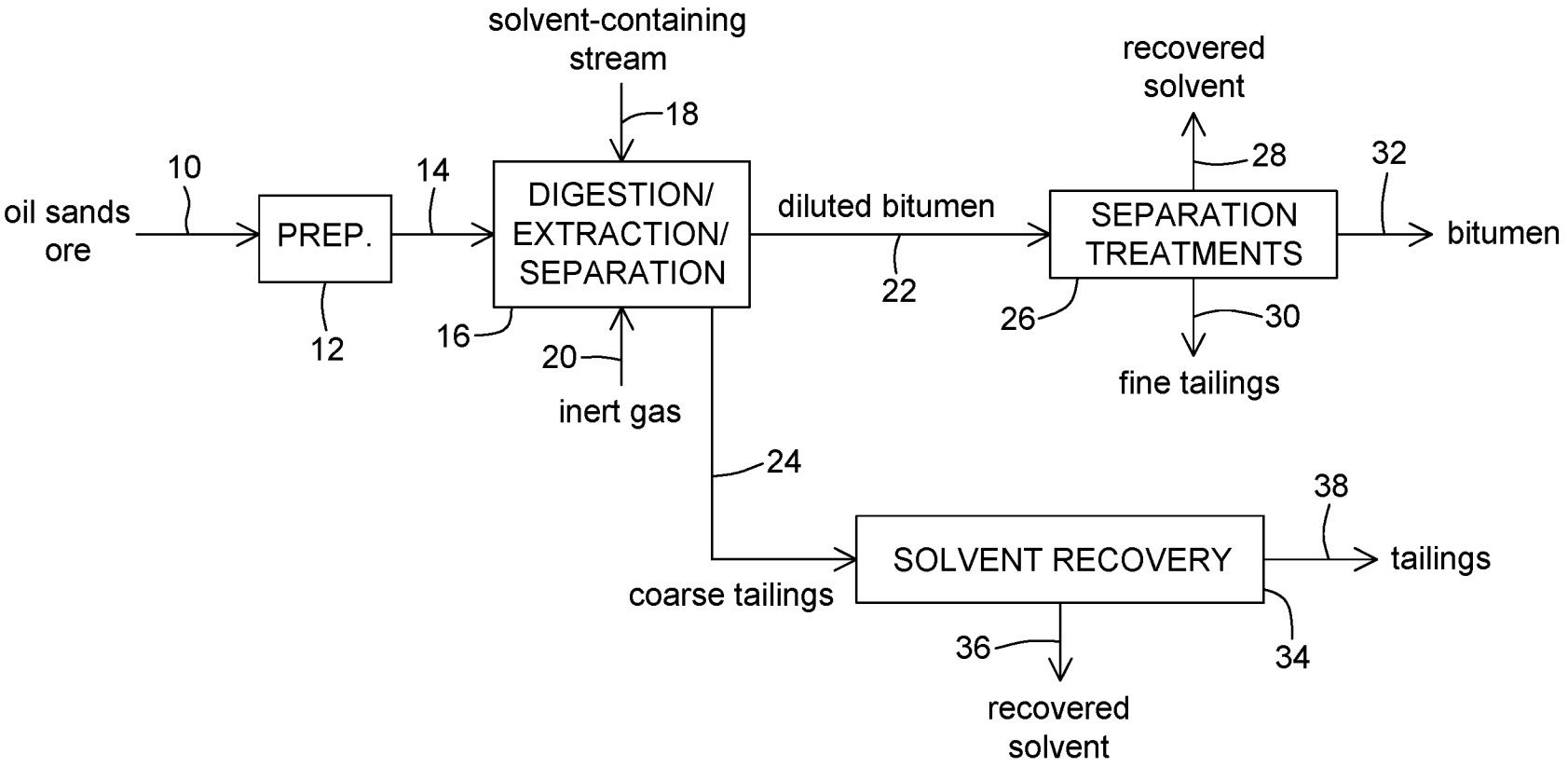
FIG. 1 is a block diagram of a process for extracting bitumen from oil sands.

Referring to FIG. 1, the process includes mining oil sands ore 10 and subjecting the ore to a preparation stage 12 prior to subsequent extraction of bitumen. The preparation 12 can include crushing, sizing, and pre-treating to produce a sized ore material 14 that can be introduced into a non-aqueous extraction stage 16 where a hydrocarbon solvent facilitates extraction of the bitumen from the mineral solids that make up the oil sands ore. Regarding the extraction stage 16, it can be an integrated stage that enables multiple features including digestion of the ore, extraction of the bitumen from the mineral solids, and separation of the solvent and bitumen from the mineral solids. In some implementations, this extraction stage 16 can be referred to as a digestion/extraction/separation stage that is implemented by in a single unit, although it should be noted that other implementations of the process may enable the operations of digestion, extraction and separation in multiple distinct units.

In the extraction stage 16, a solvent-containing stream 18 is supplied in order to dilute the bitumen and promote extracting and separation of the bitumen from the mineral solids. The solvent-containing stream 18 includes a hydrocarbon solvent that is selected to be more volatile than the bitumen to facilitate downstream separation and recovery of the solvent. The solvent-containing stream 18 can be derived from one or more downstream unit and can include a predominant portion of solvent and a minor portion of bitumen (generally referred to as "solbit", which will be discussed further below). The solvent-containing stream 18 can be a combination of several downstream fluids that include different proportions of solvent.

An inert gas 20 is also delivered to the extraction stage and associated units to displace any oxygen or maintain pressure to prevent in-leakage.

The extraction stage 16 produces solvent diluted bitumen 22 and solvent diluted coarse tailings 24. The solvent diluted bitumen 22 is subjected to additional separation treatments 26 including solvent recovery to obtain recovered solvent 28 for reuse in the process, fine tailings 30 composed mainly of fine particular mineral solids less than 44 microns as well as residual solvent and bitumen, and bitumen 32. The bitumen 32 can include some solvent and residual contaminants, and can be subjected to further processing, such as deasphalting and refining. More regarding potential separation treatments 26 will be discussed further below.

Still referring to FIG. 1, the solvent diluted coarse tailings 24 are subjected to further treatments, such as solvent recovery 34 to produce recovered solvent 36 and solvent depleted tailings 38. More regarding the various potential treatments of the diluted coarse tailings 24, such as solvent washing and drying, will be discussed further below.

Figure 2:
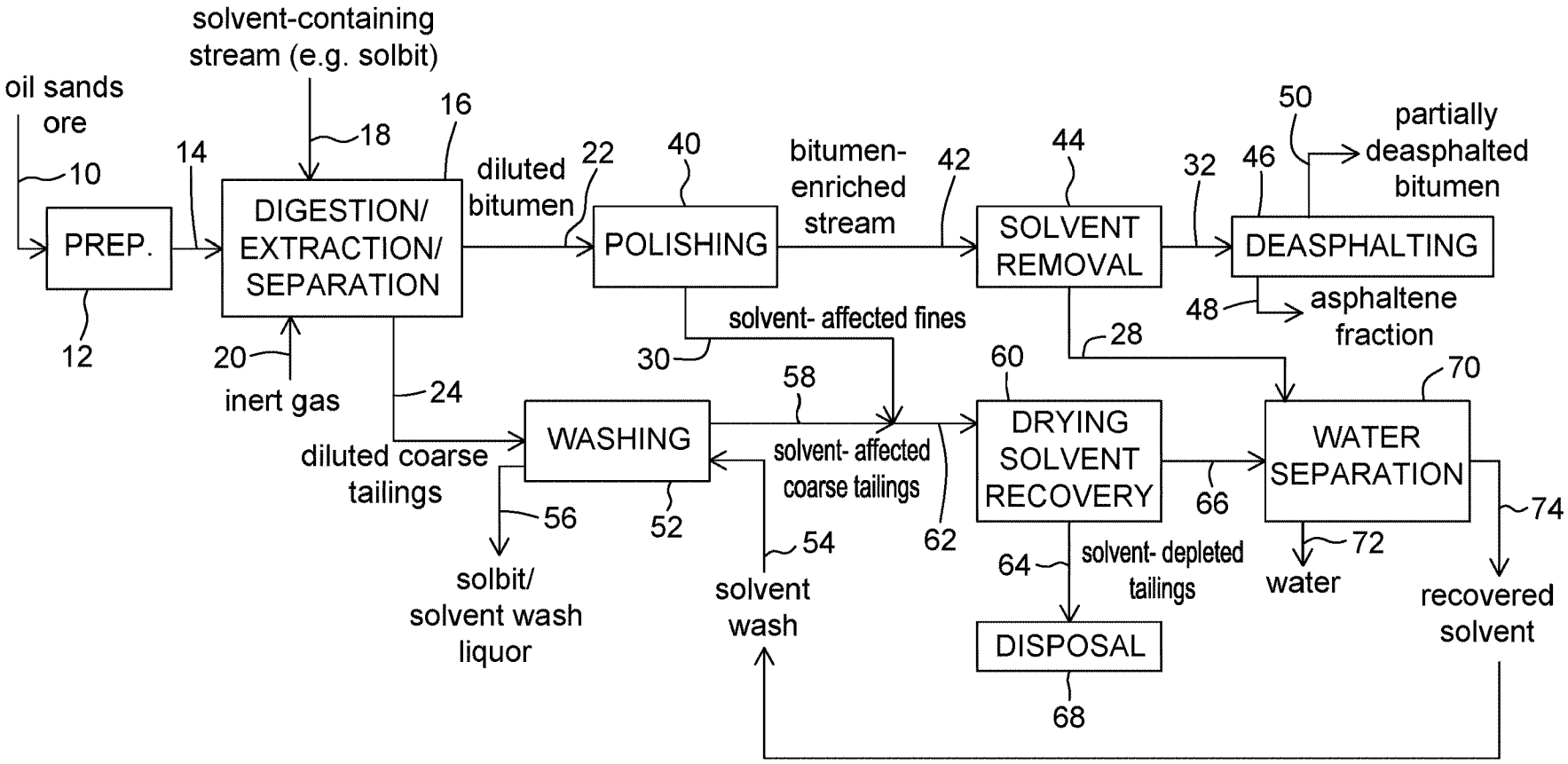
FIG. 2 is another block diagram of an example process for extracting bitumen from oil sands.
Figure 3:
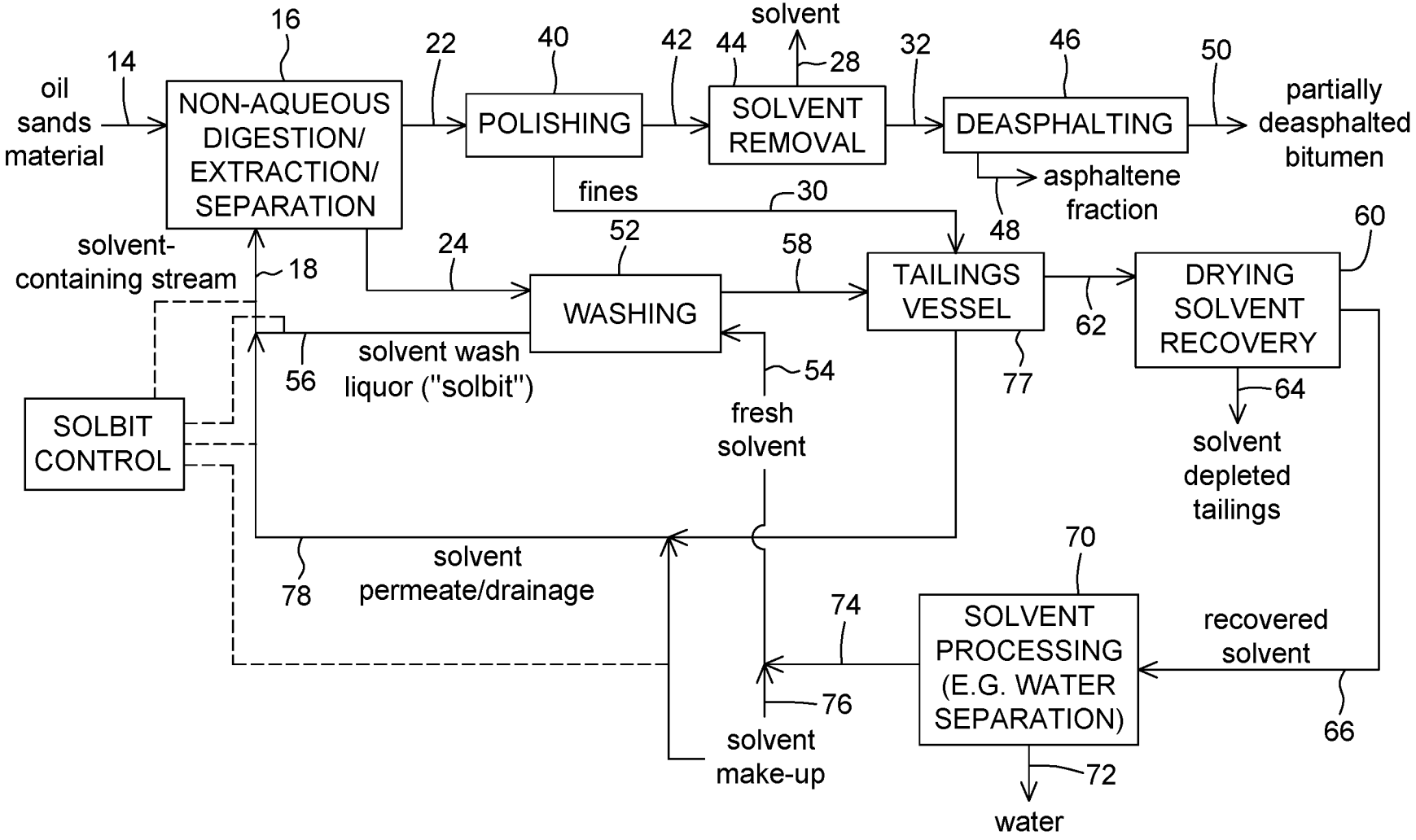
FIG. 3 is yet another block diagram of an example process for extracting bitumen from oil sands.

Referring now to FIGS. 2 and 3, more details regarding the treatment of the diluted bitumen 22 and the diluted coarse tailings will be described. The diluted bitumen 22, which includes solvent and fines, can be first subjected to polishing 40 to separate solvent affected fine tailings 30 from a bitumen enriched, solids depleted stream 42. The solvent affected fine tailings 30 can be treated to remove solvent, which can be done in conjunction with the solvent recovery from the coarse tailings 24, which will be further described below. The polishing 40 can be performed using a centrifuge, for example. The bitumen enriched stream 42 can be subjected to solvent removal 44 to produce the recovered solvent 28 and the bitumen 32, which can be further processed by deasphalting 46 to produce an asphaltene fraction 48 and a partially deasphalted bitumen 50.

Still referring to FIGS. 2 and 3, the solvent diluted coarse tailings can be subjected to washing 52 where solvent wash 54 is added to the tailings in order to remove residual bitumen from the tailings and produce a solvent-bitumen mixture 56 (referred to as "solbit" herein) and a solvent affected coarse tailings 58. The solvent wash 54 can be fresh or relatively pure or commercial grade solvent to promote cleaning of residual bitumen from the tailings. The solbit 56 that is produced by the washing 52 can be used as the sole or main source of solvent for the extraction stage 16.

The solvent affected coarse tailings 58 can then be subjected to further processing for solvent recovery, which may include a drying stage 60. The drying stage 60 can receive the solvent affected coarse tailings 58 as well as the solvent affected fine tailings 30, which can be introduced as a single solvent affected tailings stream 62 in certain cases. Separate processing of such tailings streams is also possible. The drying stage 60 produces recovered solvent 66 and solvent depleted tailings 64, which can be sent for disposal 68 for example as mine pit fill.

Referring still to FIGS. 2 and 3, the recovered solvent streams 28, 66, which are obtained from the fine and coarse tailings streams respectively, can be subjected to a water separation stage 70 in order to remove residual water 72 from the solvent 74. This water can originate from connate water present in the mined oil sands ore or from surface waters (e.g., rain, snow, ice) incidentally introduced in the course of oil sand mining operations.

Referring to FIG. 3 in particular, certain solvent supply and recycling strategies can be used in the context of the process. For example, solvent containing stream 18 that is supplied to the extraction stage 16 can include several solbit components, including solvent wash liquor 56 from the washing stage 52 and solvent permeate/drainage from solvent affected tailings streams 30 and/or 58, as well as solvent make-up 76. The solvent affected tailings streams 30, 58 can be deposited on a filter or within another type of vessel or drainage unit 77 from which a solvent rich liquid can drain to form a solvent permeate/drainage stream 78 as a solbit component. Solvent make-up 76 can also be added to form part of the solvent containing stream 18. It should be noted that composition characteristics (e.g., bitumen content, solvent content, solvent-to-bitumen ratio) can be monitored for the various solbit components (e.g., wash liquor 56, tailings drainage 78) and the components can be combined together in order to obtain desired properties for the solvent containing stream 18.

In addition, other solvent processing steps can be undertaken to produce the recovered solvent 74 that can be recycled back into other parts of the process, such as the washing stage 52. Solvent make-up 76 can be added to the recovered solvent 74 to form the solvent wash 54, for example.

It should be noted that various other solvent supply, recovery and processing techniques that have not been described or illustrated in FIG. 2 or 3 can be implemented. For example, solbit components can be recovered from various unit operations downstream of the extraction stage and they can be reused as a single solvent containing stream that is fed into the extraction stage or as multiple feed streams. In addition, according to some alternative implementations, fresh solvent can be used directly in the extraction stage and in other units of the process. Regarding solvent addition techniques, one may refer to different feed inlet approaches as single point feed, intermediate feed, or cascade feeds.

Various parts of the overall process—including ore preparation, extraction, diluted bitumen processing and tailings processing—will now be discussed in more detail.

Oil Sands Ore Preparation

Referring to FIG. 1, the mined ore can be subjected to various preparation treatments in advance of the digestion, extraction and separation. The preparation treatments can include crushing and sizing.

Figure 4:
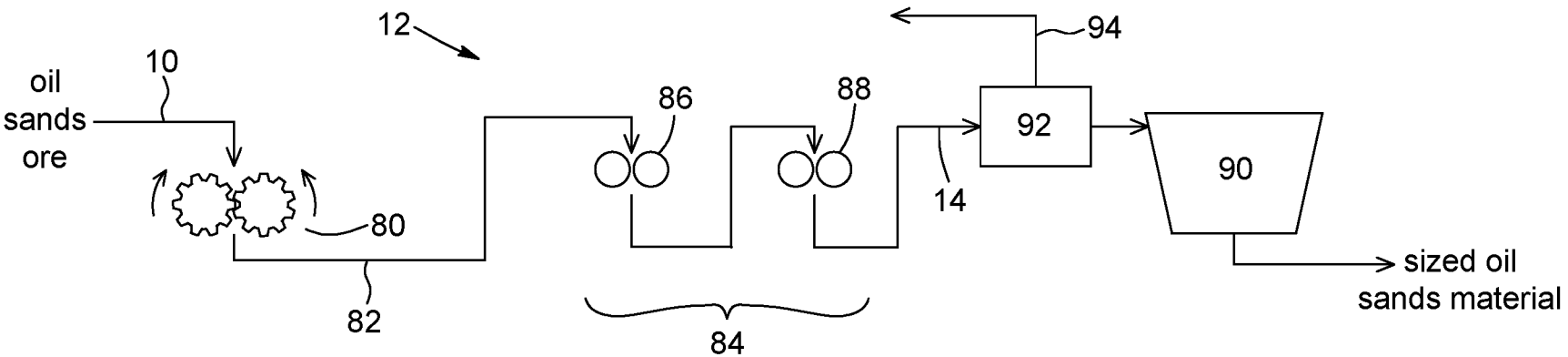
FIG. 4 is a block diagram of a process for preparing oil sands ore for extraction, including crushing and sizing.

Referring to FIG. 4, in one implementation the mined oil sands ore 10 is fed from an apron feeder or a feed conveyor into a primary crusher 80 that can include a pair of opposed drums with projections and configured to rotate in opposing directions so as to receive and crush the ore 10. The primary crusher 80 can be a stationary, periodically movable or mobile type unit. The primary crusher 80 produces a crushed ore 82 that can be delivered by conveyor, for example, to the next unit operation.

The crushed ore 82 can be fed to a sizing stage 84. The sizing stage 84 can include one or more units that convert the crushed ore into a more uniform and smaller sized feed material for downstream processing. The sizing can be done as dry sizing (i.e., with little to no added liquid) or wet sizing (i.e., with some added hydrocarbon liquid selected for compatibility with downstream processing and safety considerations). In some implementations, the sizing units can include a secondary double roll sizer 86 and a tertiary double roll sizer 88, which can be referred to as such since the primary crusher 80 does perform some ore sizing. The sized oil sands material 14 can then be fed into a hopper 90 prior to being supplied to downstream processing.

It should also be noted that other units can be used for sizing and for providing the sized oil sands material 14. For example, in one alternative, at least one double roll sizer is used to size the oil sands material which is then fed through a screen 92 in order to produce a uniform sized material passing through the screen 92, and oversized material 94 that can be recycled back into one of the upstream sizers or the crusher for size reduction.

In terms of the size of the oil sands lumps in the sized oil sands material 14, for a non-aqueous extraction process the target maximum size of the lumps can be 2 inches, 1.5 inches or 1 inch, for example. This smaller size limit can be viewed in contrast with hot water extraction (HWE) methods of oil sands processing where the sized ore lumps can be up to 4 inches. The smaller lump size in the sized oil sands material 14 can provide advantages in terms of faster digestion and extraction, particularly when the sized oil sands material 14 is fed directly to an extraction unit that includes integrated digestion. However, it is noted that in some implementations the target maximum size of the oil sands lumps can be 4 inches or 3 inches, for example.

It is also noted that the oil sands material can be contacted with a small amount of solvent prior to introduction into the extraction unit. This can be viewed as a solvent moistening pre-treatment of the oil sands material, which enables the solvent to begin to penetrate and mingle with the bitumen in the pores of the oil sands, and thus facilitate digestion as lumps become easier to break down. A solvent containing stream can be sprinkled or sprayed onto the oil sands material, and can be formulated to have a composition to minimize vaporization of the solvent (e.g., higher bitumen content in the solvent stream). The pre-moistening can be done in various units upstream of the extractor and such units would be sealed and inerted. For example, the solvent could be added into a holding vessel and/or a conveyor. These units would also be connected to a vapour recovery and management system, which could also be connected to other units in the overall process. The addition of solvent can also increase the pressure within the sealed vessel or conveyor or other upstream unit, which can also reduce air ingress. The solvent that is added for pre-moistening can be part of a solbit stream that is formulated for that particular purpose and/or may include hydrocarbon fractions generated in downstream bitumen processing operations. For instance, this solbit stream can have higher bitumen content.

The solbit stream can be formulated to have particular fluid dynamic properties for spraying via a particular nozzle configuration to achieve a desired spray pattern.

Digestion, Extraction and Separation

As will be explained in this section, there are a number of different process configurations and equipment designs that can be used to perform the digestion, extraction and separation operations. Before describing particular process and system implementations, general comments regarding digestion, extraction and separation will be described below.

"Digestion" can be considered to involve disintegrating the lumps in the sized oil sands material to smaller and smaller sizes using shear based means or a combination of mechanical, fluid, thermal, and chemical energy inputs, with the aim of providing a digested material where the lumps are reduced to individual grains that are coated with bitumen. Breaking down the adherence between the solid mineral grains can involve shearing with dynamic or static mixer devices and/or mobilization of interstitial bitumen using heat or solvent dissolution.

"Extraction" can be considered to involve dissociating bitumen from the mineral solids to which the bitumen is adhered. Bitumen is present in the interstices between the mineral solid particles and as a coating around particles. Extraction entails reducing the adherence of the bitumen to the solid mineral materials so that the bitumen is no longer intimately associated with the minerals. Effective digestion enhances extraction since more of the bitumen is exposed to extraction conditions, such as heat that mobilizes the bitumen and solvent that dissolves and mobilizes the bitumen. Effective extraction, in turn, aims to enhance separation performance in terms of maximizing recovery of bitumen from the oil sands ore and minimizing the bitumen that reports to the tailings. In commercial implementations, the target extraction level is typically at least 90 wt % of the bitumen present in the oil sands material, although other extraction levels or thresholds can be used.

"Separation" in this context can be considered to involve removing the extracted bitumen from the mineral solids, forming a distinct stream or material that is enriched in bitumen and depleted in solid mineral material. Separation mechanisms can include gravity separation in which density differences cause lighter solvent diluted bitumen to rise while heavier solid mineral material sinks within a vessel. In separation, there is a displacement of bitumen enriched, solids depleted material away from bitumen depleted, solids enriched material. In the context of FIG. 1, for example, the separation results in the production of the solvent diluted bitumen 22 and the solvent diluted coarse tailings 24. Solbit tends to have a low density and viscosity compared to water based separation methods, which are enhanced attributes for separation.

While digestion, extraction and separation are described above as distinct phenomena, they can of course occur to some degree simultaneously within a given vessel or unit. For example, if a feed stream of sized oil sands ore were fed into a conventional gravity separation cell, there would be some degree of digestion from fluid movement and contact with the separation cell walls; extraction of bitumen from small particulate material and from the external parts of non-digested lumps; and separation of bitumen extracted from solids by gravity settling mechanisms. However, in such a scenario, there may be insufficient digestion of lumps to enable extraction of target quantities of bitumen from the oil sands ore, such that the overall separation performance would be uneconomical.

Integrated Extraction Unit Implementations

In some implementations, the extraction stage is designed and operated such that digestion, extraction and separation are performed in a single unit, which can be referred to generally as an "integrated extraction unit". Alternatively, distinct or standalone units can be used for performing these operations (i.e., a digestion unit followed by an extraction unit, and then followed by a separation unit). In addition, a standalone unit can be combined with an integrated unit (e.g., a standalone digestion unit followed by an integrated extraction and separation unit). For the integrated extraction unit, there are a number of possible designs and implementations, which will be described in more detail below.

One advantage of an integrated extraction unit is process simplification which can reduce overall process cost and complexity. In addition, since NAE techniques that use a solvent having a lower boiling point than bitumen require inerting, it can be advantageous to have fewer vessels and units that are inerted to reduce or simplify the necessary sealed construction, piping, and inert gas management for the inerting process. Thus, by combining or integrating multiple functions typically achieved by separate units into a single unit, inerting can be facilitated.

The following configurations of integrated extractors have been developed. While some unit types and configurations are described below, it should be noted that certain features of the units can be used in other kinds of extractors as part of an overall NAE operation.

Gravity Settler Extractor

Figure 5:
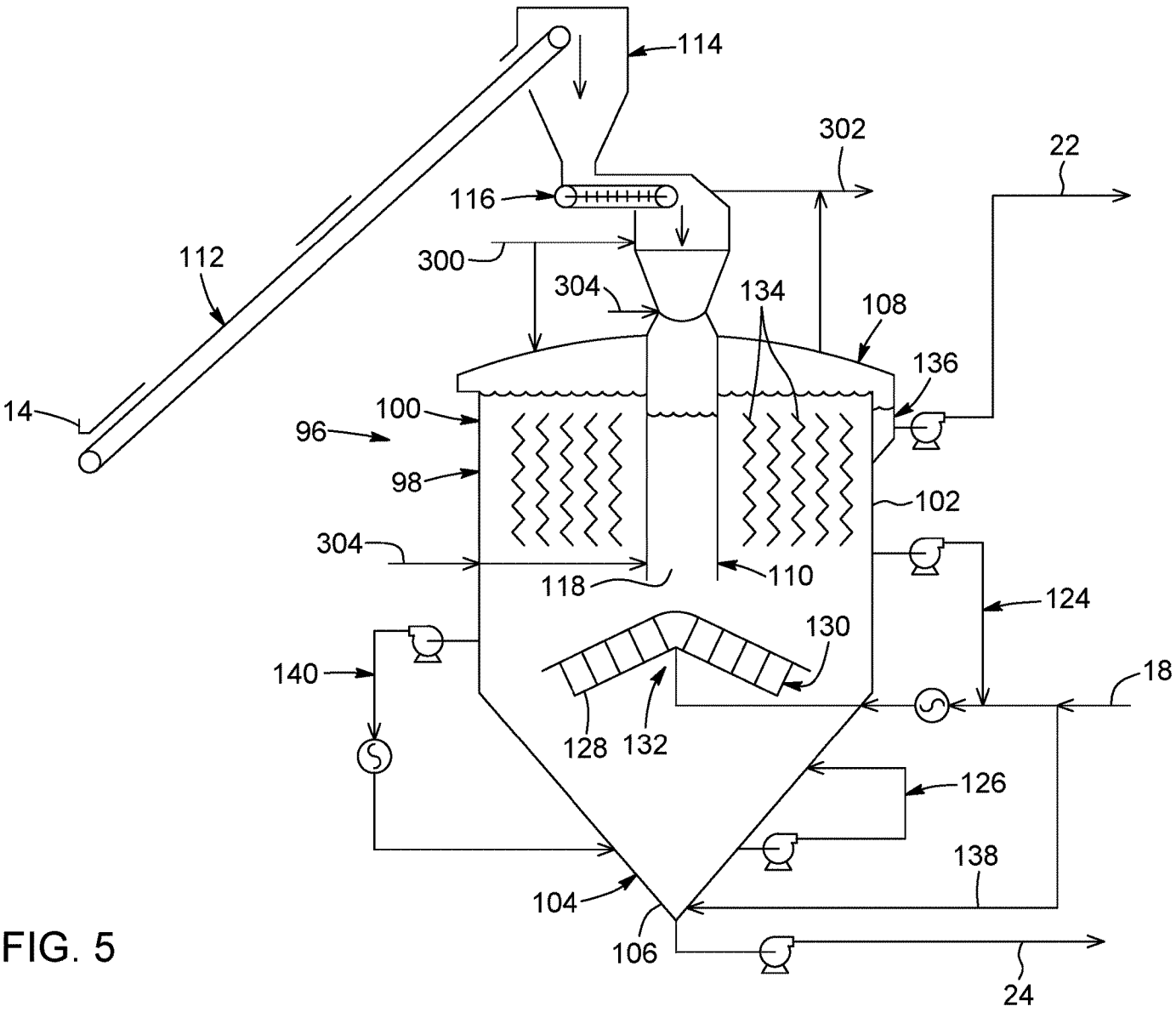
FIG. 5 is a schematic diagram of an example integrated extraction unit, particularly an integrated gravity settler extractor for digestion, extraction and separation of bitumen from oil sands material.
Figure 6:
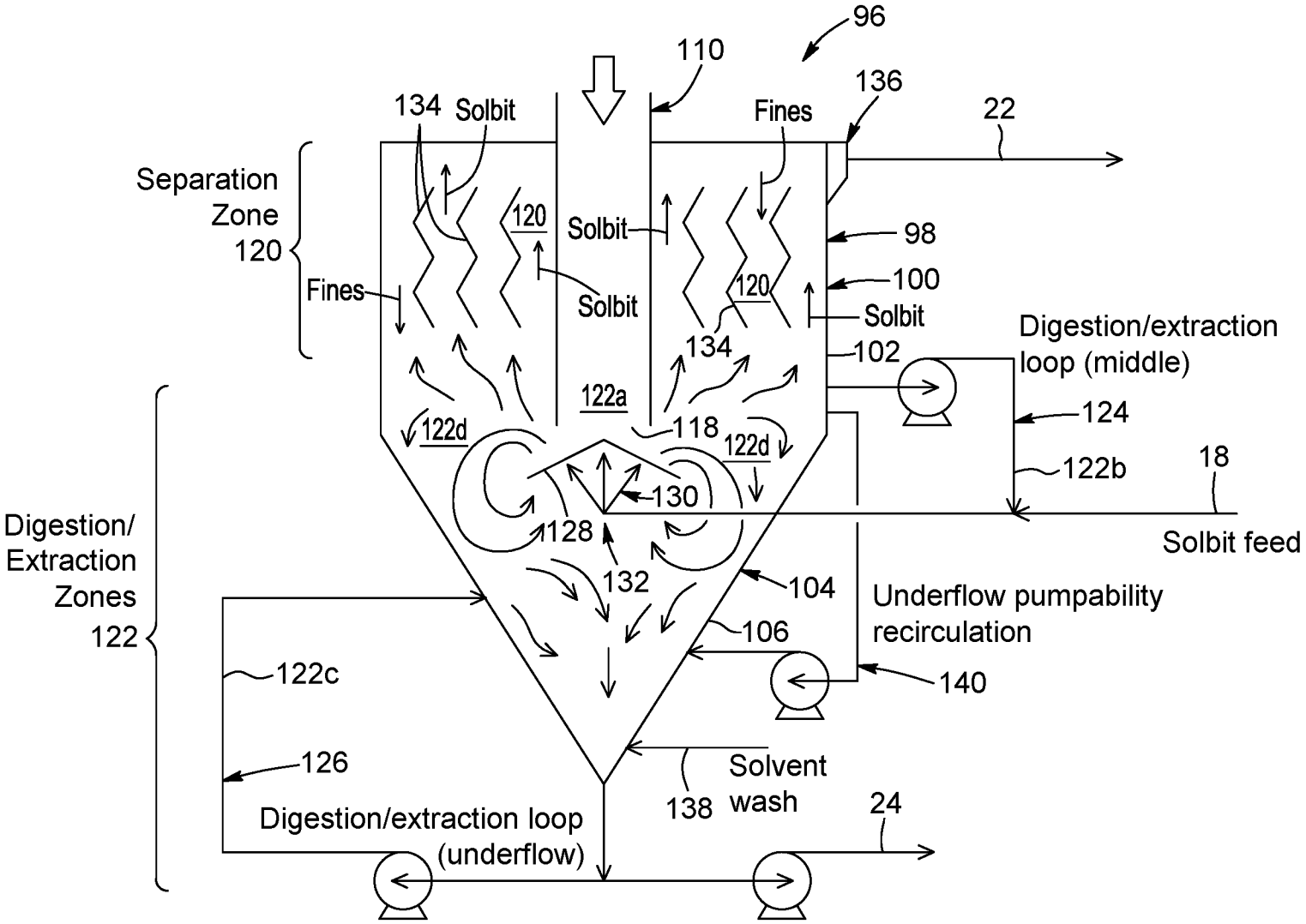
FIG. 6 is another schematic diagram of an example integrated gravity settler extractor.
Figure 7:
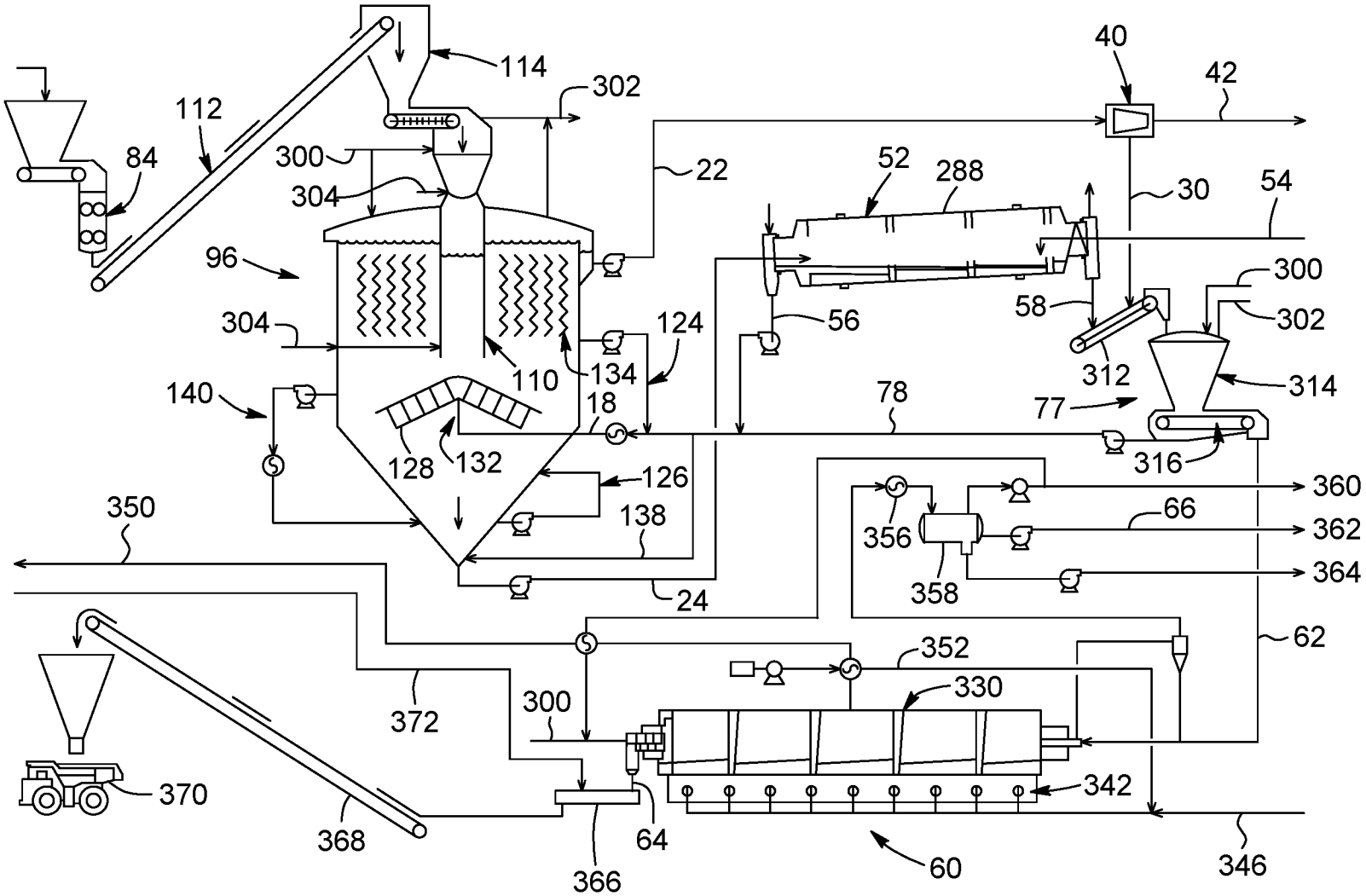
FIG. 7 is a flow diagram of a process for extracting bitumen from oil sands, including an integrated gravity settler extractor, a counter-flow rotary drum for washing solvent diluted tailings, and a drum drier for recovering solvent from washed tailings.

Referring to FIGS. 5 to 8, the integrated extraction unit can include a gravity settler extractor 96 that has digestion, extraction and separation functionality in the same processing vessel. FIGS. 5 and 6 illustrate the gravity settler extractor 96 while FIGS. 6 and 7 illustrate the gravity settler extractor 96 integrated within two example overall processes. FIG. 6 also illustrates material flow with the vessel with arrows to provide an example of fluid flow directions and turbulence.

Referring to FIGS. 5 and 6, the gravity settler extractor 96 can include a vessel 98 having an upper portion 100 with cylindrical side walls 102 and a lower portion 104 with conical side walls 106. The vessel 98 also includes a sealed top 108 that can be domed and through which a feedwell 110 extends into vessel 98. The sized oil sands ore 14 is provided onto a sized ore conveyor 112, into a sized ore hopper 114, and then into an extractor feed screw 116, for which the oil sands ore is supplied into the feedwell 110. The extractor feed screw 116 provides some preliminary digestion to the oil sands material. The feedwell 110 can be positioned to run down a central axis of the gravity settler extractor 96 and includes a discharge outlet 118 located within the interior of the vessel 98.

The gravity settler extractor 96 is configured and operated to enable digestion, extraction and separation in corresponding zones of the vessel 98. The gravity settler extractor 96 can include a separation zone 120 located generally in the upper portion 100 of the vessel 98, and digestion/extraction zones 122 located proximate the discharge outlet 118 of the feedwell 110 as well as within a middle recirculation loop 124 and an underflow recirculation loop 126.

A primary digestion zone **122*a* can be located within the feedwell 110 and around the discharge outlet 118 where a deflector plate 128 can be provided along with a fluid inlet 130 that injects fluid to promote turbulence and high shear in the discharge region of the oil sands material into the vessel 98. The fluid inlet 130 can be supplied by the middle recirculation loop 124 such that middling material is withdrawn from the vessel and reinjected to promote turbulence and digestion/extraction within the loop itself as well as upon injection back into the vessel 98. In the primary digestion zone 122***a*, the larger lumps of oil sands material are broken down into smaller lumps and particles.

In a portion of the feedwell 110, the oil sands material can be immersed in the solvent. The feedwell 110 can thus act as both a sealing system and an ore transport system to allow ore to transit through the vessel without disturbing the separation zone 120. As mentioned above, at the discharge outlet of the feedwell, the ore is exposed to high mixing energy to promote digestion of lumps while vigorously stripping and exposing new bitumen surfaces to the solvent to promote extraction. Various systems can be used to provide this mixing energy, including the example recirculation loops and vessel internals (e.g., deflector plate) illustrated in FIGS. 5 and 6.

Secondary digestion/extraction zones 122*b*, 122*c* can be present within the recirculation loops 124, 126, respectively, while a tertiary digestion/extraction zone can be present within a turbulent region beyond and adjacent the primary digestion zone 122*a*. In the secondary and tertiary digestion/extraction zones, remaining small oil sands lumps are further disintegrated into individual grains, while extraction of bitumen from interstices between and coatings around the small mineral solid particles occurs.

Extraction and digestion can be aided by the solvent introduced into the vessel 98. Solvent can be introduced at one or more locations within the vessel 98. A primary solvent inlet 132 can be provided to introduce the solvent-containing stream 18 (e.g., solbit) into the primary digestion zone 122*a*, such that the solbit feed first comes into contact with the oil sands material being discharged into the vessel 98. In one implementation, the solbit is combined with the material in the middle recirculation loop 124 before being introduced into the vessel 98. The middle recirculation loop 124 pumps back relatively low solids solbit which can be pre-heated to maintain the vessel operating temperature, which can be about 40° C. to 50° C. or about 45° C., for example.

The digestion and extraction zones of the gravity settler extractor 96 overlap to a large extent. In general, the central third of the vessel 98 provides residence time, mixing energy, and heat input to allow solvent dissolution of the bitumen from the oil sands solids. Residence times and recirculation loops can be provided to achieve digestion and extraction targets.

Still referring to FIGS. 5 and 6, the separation zone 120 can also include internal structures 134, which can be baffles or inclined plates, to facilitate or improve separation of mineral solids (e.g., particularly fines) from the solbit. At an upper point of the separation zone there is a diluted bitumen outlet 136, which can be an overflow weir or like system, from which the solvent diluted bitumen 22 can be withdrawn from the vessel 98.

The gravity settler extractor 96 can also include a solvent wash inlet 138 for supplying solvent or solbit into the bottom of the vessel 98 to facilitate or initiate washing of the underflow stream. More regarding washing of the tailings streams will be discussed further below.

The gravity settler extractor 96 can also include an underflow pumpability recirculation loop 140 configured to withdraw fluid from a middle region of the vessel 98 and reintroduce the material proximate the bottom of the vessel where the solids content of the underflow would be relatively high. The underflow pumpability recirculation loop 140 is configured and operated in order to provide sufficient fluid to facilitate pumpability of the underflow. The location of withdrawal of the recirculated fluid can be done so that the fluid has an appropriate viscosity and composition so that when combined with the underflow at the flow rate of the recirculation loop the resulting diluted underflow has a desired pumpability. Thus, fluid properties and flow rate can be provided to achieve this underflow pumpability.

Referring now to FIG. 5, the gravity settler extractor 96 can include various pumps and heaters to operate recirculation loops and to pre-heat certain fluids prior to introduction or reintroduction into the vessel. Heating can further promote digestion, extraction and separation and therefore heating certain streams can be advantageous. In addition, the heaters can be managed to so that the gravity settler extractor 96 operates within an overall operating temperature envelope. Operating temperatures can also be provided by heating certain parts of the extractor with steam. Pumps can also provide shear that can promote digestion and extraction.

The gravity settler extractor 96 can also include appropriate lines and piping to supply inert gas to form a gas blanket over the solbit at the top of the vessel 98, to remove certain vapours via a venting system, or to provide other operating fluids if desired. FIG. 5 illustrates some possible piping that can be provided for such purposes.

Figure 8:
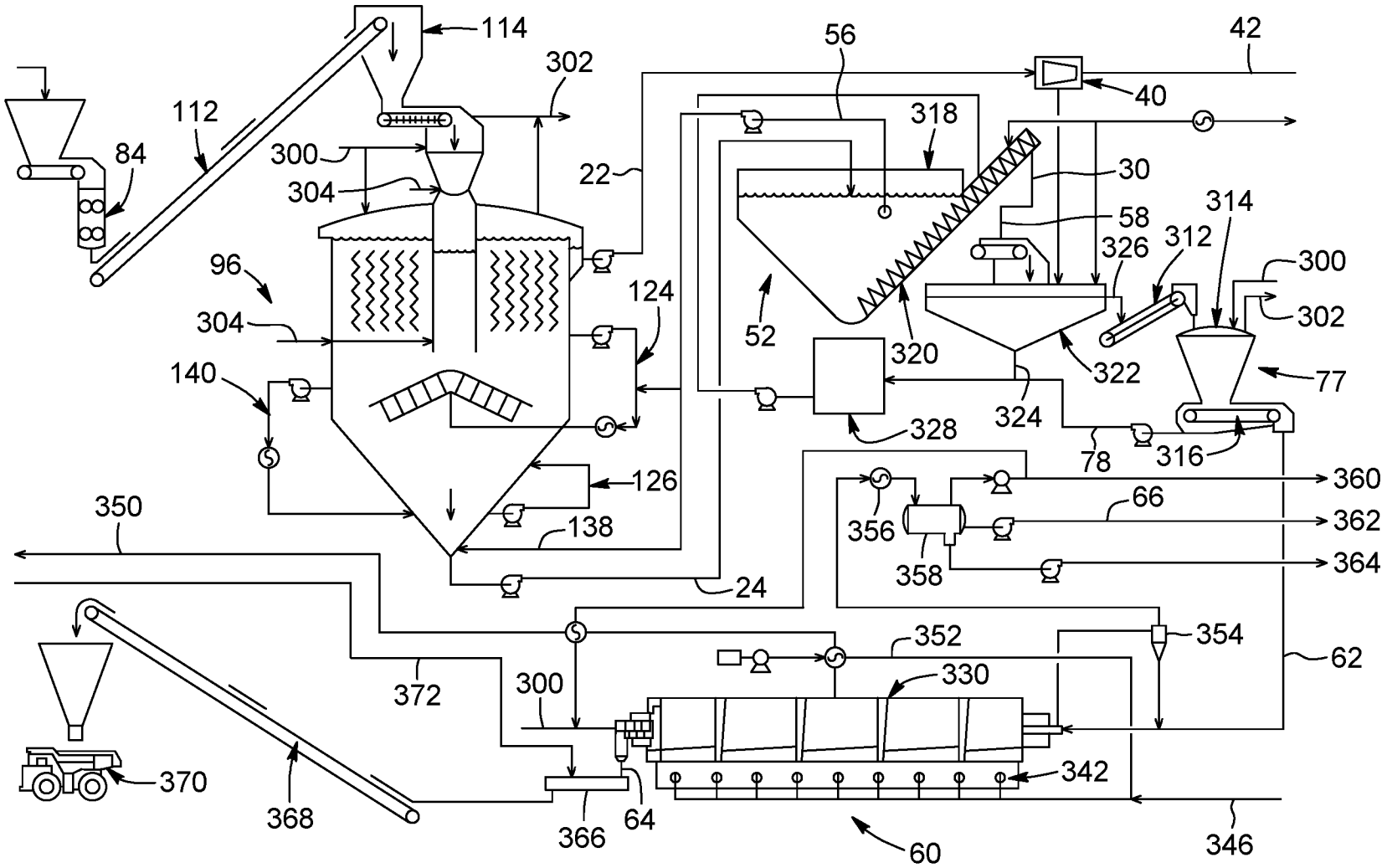
FIG. 8 is another flow diagram of a process for extracting bitumen from oil sands, including an integrated gravity settler extractor, an auger classifier for washing solvent diluted tailings, and a drum drier for recovering solvent from washed tailings.

Referring to FIGS. 7 and 8, the gravity settler extractor 96 can be integrated into the overall process in various ways. FIG. 7 shows integration with a counter-flow rotary drum as the unit for washing the tailings 24 withdrawn from the vessel, while FIG. 8 shows integration with an auger-assisted classifier as the washing unit. More regarding example washing units and other unit operations, such as drying, will be discussed further below with reference to FIGS. 7 and 8.

Rotating Conveyor Extractor, e.g., Auger Extractor

The integrated extraction unit can be an extractor including a vessel and a rotating conveyor that facilitates digestion, extraction and separation functionalities. The rotating conveyor can extend into the vessel to impart mixing energy to the oil sands and facilitate digestion and extraction while also conveying the oil sands material along the conveyor while solvent and extracted bitumen flow counter-currently toward the vessel and thereby removing bitumen from the solids. A co-current setup is a possible alternative. The vessel can also include an upper separation zone where extracted bitumen and solvent are allowed to separate from settling solids.

The rotating conveyor of this type of extractor can take various forms including at least one shaft from which mixing/advancing elements extend within a housing. For example, the rotating conveyor can be an auger conveyor, which will be described in detail below. Instead of using an auger, the rotating conveyor can use a shaft having baffles or paddles that are oriented and configured to provide mixing energy and to advance solids downstream. The rotating conveyor extractor will be described in greater detail mainly with respect to the auger conveyor example.

Figure 9:
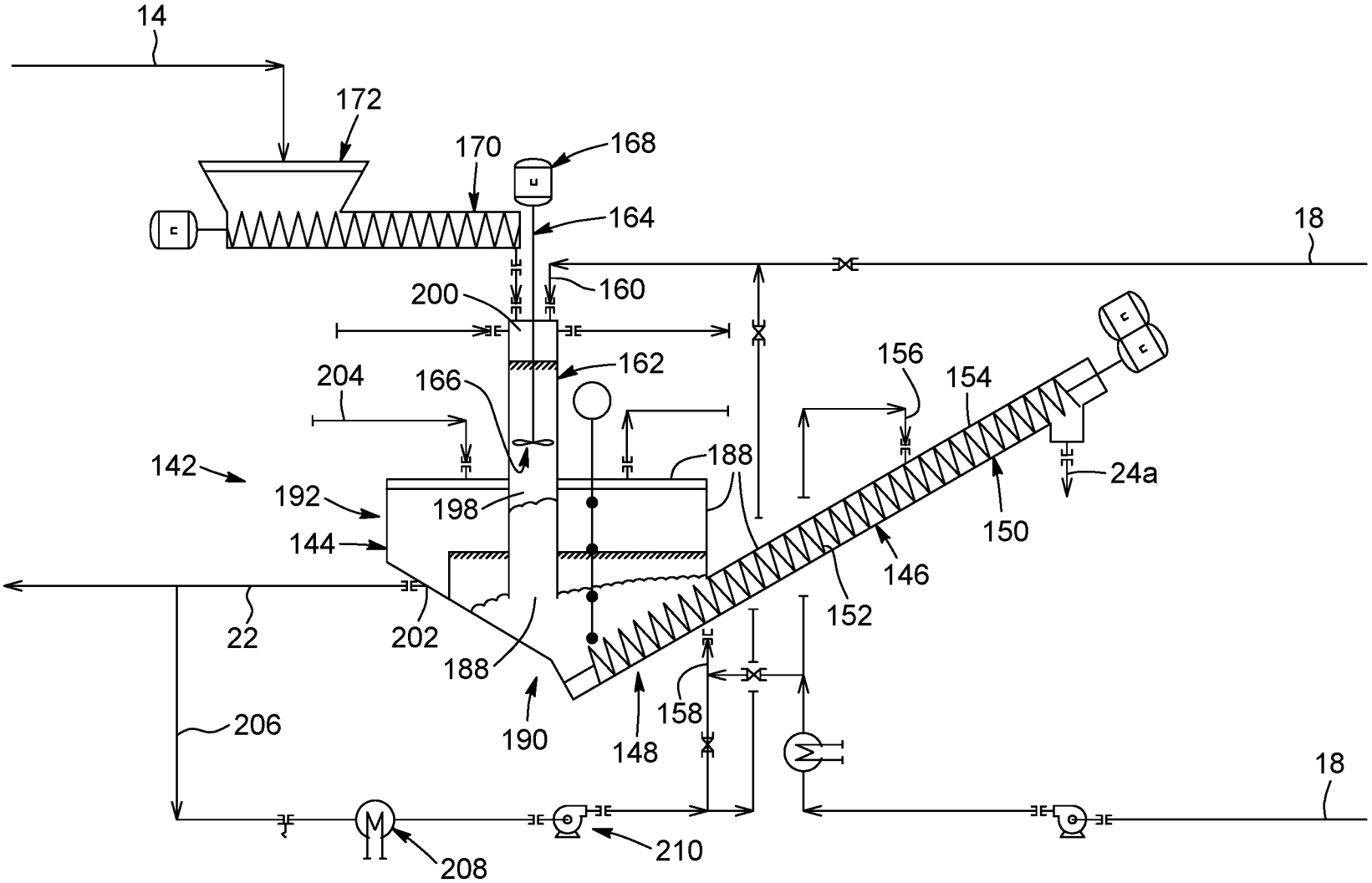
FIG. 9 is a schematic diagram of another example integrated extraction unit, particularly an integrated auger extractor for digestion, extraction and separation of bitumen from oil sands material.

Referring to FIG. 9, the integrated extraction unit can include an auger extractor 142 that has digestion, extraction and separation functionality.

The auger extractor 142 includes a main vessel 144 and an auger conveyor 146 having a lower upstream end 148 within a bottom of the interior of the main vessel 144 and an upper downstream end 150 extending out of the main vessel 144. The auger conveyor 146 has at least one auger 152 located within a barrel or housing 154. The lower upstream end 148 engages oil sands ore in the bottom of the main vessel 144 and, via rotation of the auger 148, the oil sands ore is transported toward the upper downstream end 150 while digestion and extraction are facilitated by shear imparted by the rotation of the auger 148 and the displacement and mixing of the material within the auger conveyor 146.

Solvent (e.g., in the form of solbit) is introduced into the auger extractor 142 to further promote digestion and extraction, and also to facilitate separation. As show in FIG. 9, the solvent-containing stream 18 can be introduced at various solvent inlets, such as a downstream solvent inlet 156, an upstream auger inlet 158, and a feedwell inlet 160. The oil sands material at the bottom of the main vessel 144 is thus immersed in solvent. As the oil sands material is transported and churned by the auger away from the lower upstream end 148, the mineral solids are generally forced toward the upper downstream end 150 while solbit flows counter-currently toward the lower upstream end 148 and extracts bitumen from the mineral solids. The solvent-containing stream 18 introduced at the downstream solvent inlet 156 can be of higher solvent content to promote cleaning of residual bitumen in the solids fraction, while the solvent-containing stream 18 introduced at other locations can be a solbit stream having higher bitumen content.

Thus, the tailings material discharged from the upper downstream end 150 is solids rich and bitumen depleted while containing residual bitumen and solvent. This solvent containing tailings material 24*a* will be different compared to the solvent diluted tailings underflow produced by the gravity settler extractor described above (e.g., 96 in FIG. 5), as this tailings material 24*a* would not typically be a pumpable material but will have relatively high solids content such that it would be subjected to dry materials handling and transport techniques. Alternatively, the tailings stream may be re-fluidized using an intermediate process fluid to facilitate hydraulic transport.

Referring to FIG. 9, the oil sands ore material is fed into the main vessel 144 via a feedwell 162 that can also be equipped with a mixer 164, which may include a paddle-type mixing element 166 and a mixer motor 168. The mixer 164 can be configured to extend into the feedwell 162 in order to provide some digestion by imparting mixing energy to the ore and solvent mixture. The feedwell 162 receives oil sands ore from a screw feeder 170 that is fed ore from a sized ore hopper 172.

The digestion and extraction zones are generally in the bottom of the main vessel 144, the feedwell 15, and in the auger conveyor 146, particularly its upstream section located within the interior of the main vessel 144.

The auger conveyor 146 can have various possible designs. For example, the auger conveyor 146 can include a single auger within a barrel-type housing, dual augers arranged side-by-side within the housing, or other configurations of multiple augers arranged within a correspondingly constructed housing. A dual auger arrangement can provide advantages in terms of reducing the length of the auger conveyor required to achieve certain mixing, separation and throughput targets, as well as coordinating with the main vessel to reduce dead zones and solids accumulation in the vessel, for example. It is also noted that multiple auger conveyors can be provided for a given main vessel, extending outward at different directions, and each auger conveyor can have a dual auger configuration. Other mixing or diversion equipment can also be provided to move material within the vessel, e.g., moving high solids material toward the auger conveyor input.

Figure 10A:
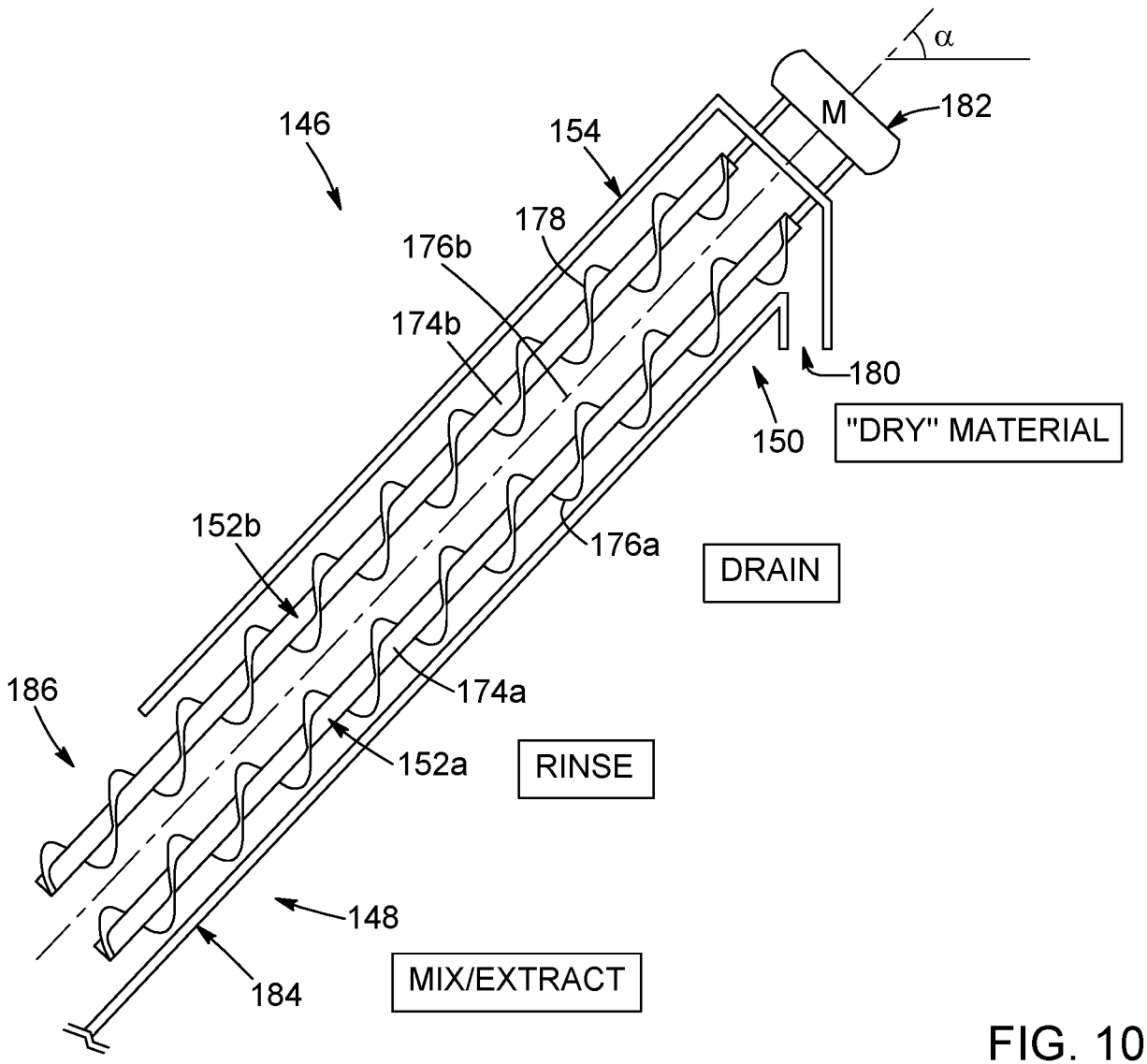
FIG. 10*a* is a cut side view schematic of an auger conveyor that can be used in an integrated auger extractor, illustrating two augers one above the other although the augers would be arranged side by side.
Figure 10B:
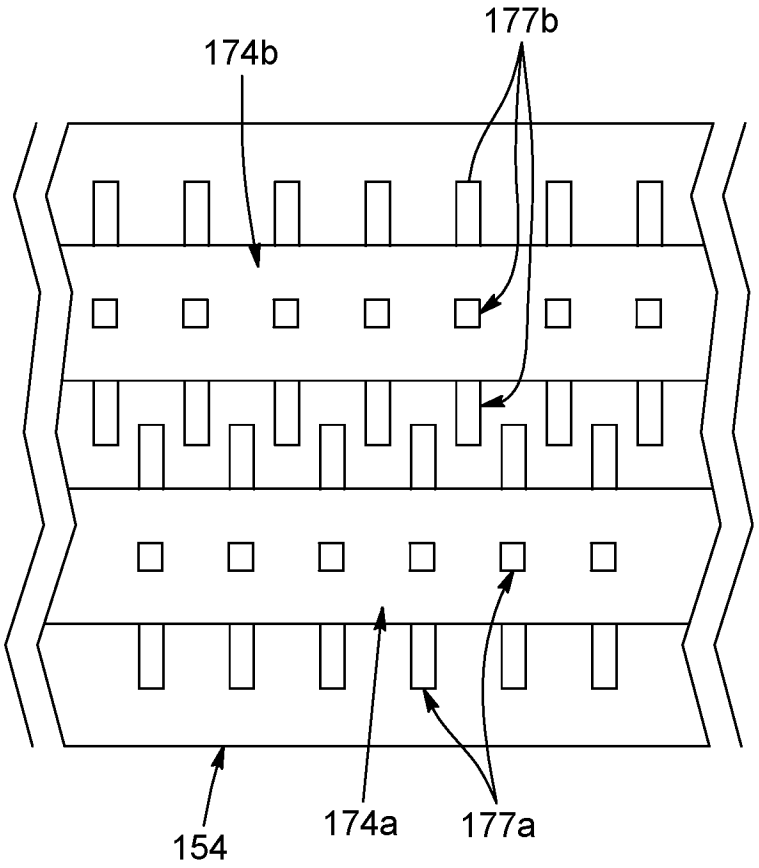
FIG. 10*b* is a cut top partial view schematic of an alternative type of rotating conveyor with dual shafts having discrete projections that can be used in an integrated rotating conveyor extractor.

Referring to FIG. 10, illustrating a dual auger type auger conveyor 146, each auger 152*a*, 152*b* has a corresponding shaft 174*a*, 174*b* as well as a blade or flighting 176*a*, 176*b* helically mounted around the corresponding shaft. The shafts can be symmetrically arranged on either side of a central axis 178 along the length of the housing 154. The flighting 176*a*, 176*b* can be sized and configured to facilitate the desired transport and mixing functionalities, while enabling drainage of solbit toward the upstream end 148. The housing 154 has a tailings discharge 180 at the downstream end 150 and there is a motor system 182 which can be mounted at the downstream end to drive rotation of the two augers within the housing 154. The upstream end 148 of the housing can include a closed bottom side 184 and an open top side 186. The closed bottom side can join with the walls of the main vessel 144. The open top side 186 enables the oil sands material and solvent to descend into the auger region to enable material to engage with the rotating augers 17 for transport downstream.

Referring still to FIG. 10, the auger conveyor 146 can be oriented at an oblique angle ($\alpha$) to facilitate back drainage of the solbit. The angle ($\alpha$) can be provided along with other parameters (e.g., auger design, sizing and spacing; speed of rotation; and auger conveyor length) in order to enable desired digestion, extraction and separation characteristics as well as extractor performance. Regarding auger design, in a dual auger configuration, the augers flights can be designed to promote mineral solids displacement downstream as well as solbit drainage upstream. This can involve flighting size, design and frequency of helical turns, the positioning of the augers relative to the central axis 178 and the side walls of the housing 154, and other parameters.

Figure 15:
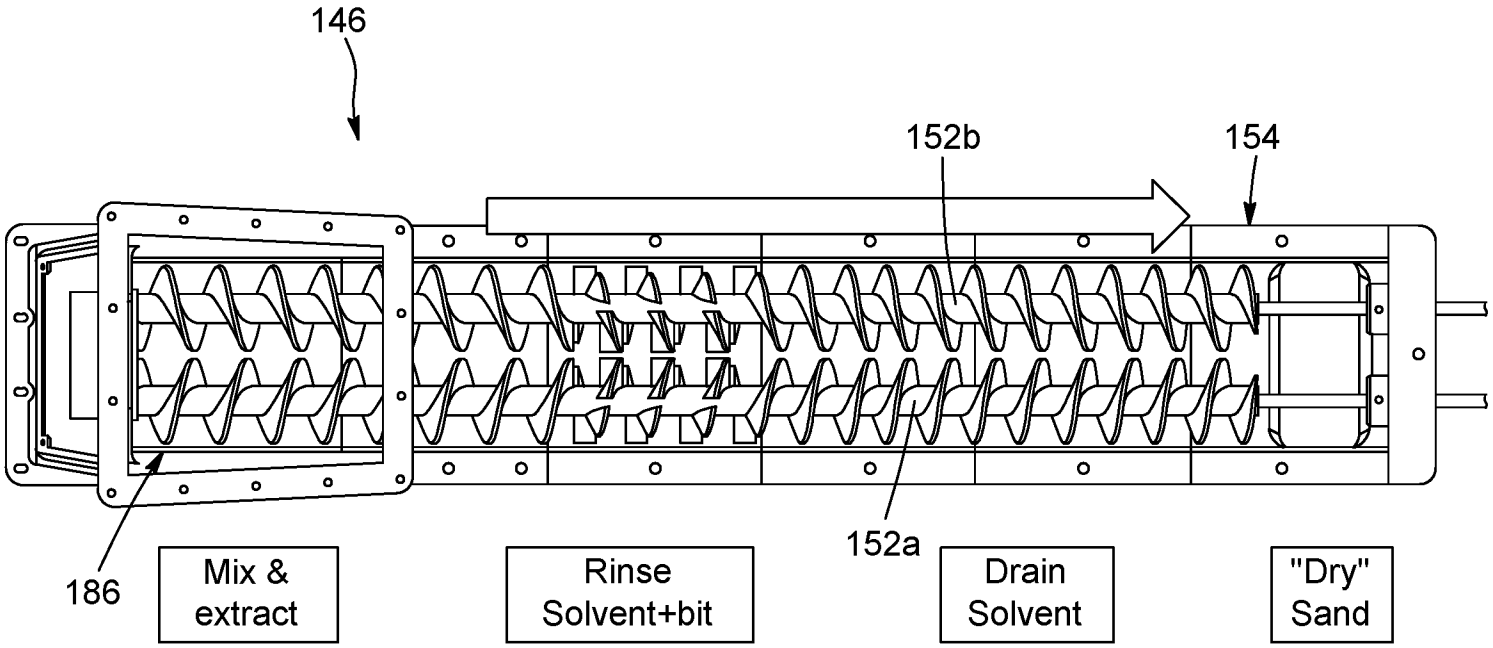
FIG. 15 is a cut top view schematic of another auger conveyor that can be used in an integrated auger extractor.

Referring to FIGS. 10 and 15, the auger conveyor 146 can be viewed as having different general processing stages along its length: (1) mixing and extraction stage where the solvent and oil sands material are subjected to mixing energy and bitumen extraction occurs, (2) solvent and bitumen rinsing stage where the solvent introduced into the auger conveyor rinses the bitumen from the mineral solids, (3) drainage stage where remaining solvent and bitumen drain back toward the upstream end of the auger conveyor as the mineral solids are transported downstream, and (4) a dry material discharge stage where the substantially solvent and bitumen depleted tailings are discharged from the auger conveyor. The auger conveyor can be configured to have a certain length and configuration so that the material discharged is essentially washed solids that is ready to be drained or supplied to the final solvent removal step, such as a filter or dryer.

Figure 11:
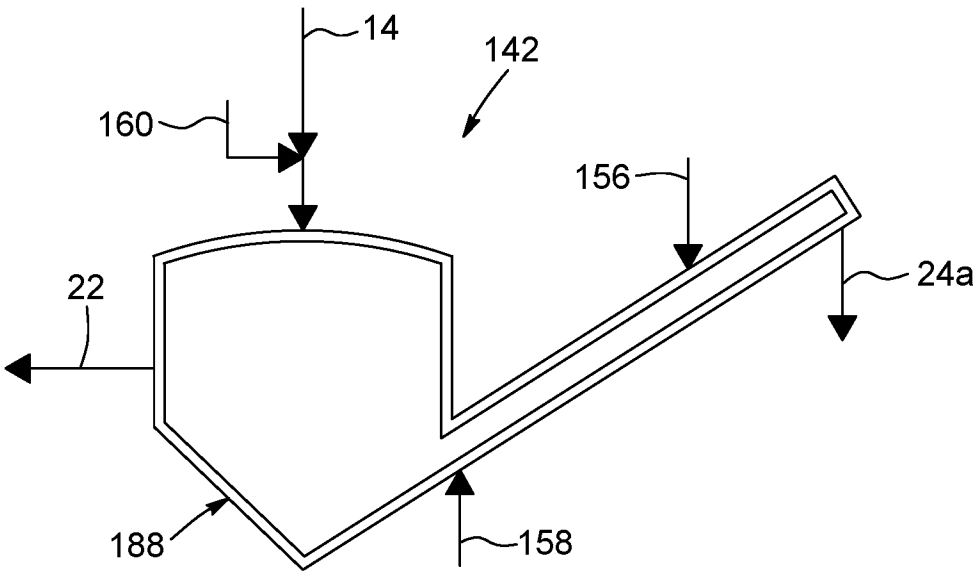
FIG. 11 is a schematic diagram of an integrated auger extractor schematically showing its sealed envelope.

Referring now to FIGS. 9 and 11, the auger extractor 142 can be constructed to include a sealed envelope 188, which can include walls of the main vessel 144 and the housing. The envelope 188 ensures that solvent vapour is retained within its interior. In this regard, providing the auger conveyor 146 with rotating augers 174*a*, 174*b* and a fixed static housing 154 enables the housing 154 to form part of the envelope 188.

Referring to FIG. 9, the main vessel 144 includes a lower portion 190 that can be generally conical, and an upper portion 192 that can be cylindrical. The feedwell 162 may be located along a central axis of the upper portion 192 terminating at a feed discharge 194 positioned in the lower portion 190. In operation, the oil sands material is fed through the feedwell so as to form a solid rich zone 196, and the solvent-containing stream 18 is supplied into the feedwell 162 so as to immerse the oil sands material and also form a liquid zone 198 above the solid rich zone 196. The space 200 above the liquid level is filled with inert gas.

Within the main vessel 144, solvent diluted bitumen that has been extracted from the oil sands material separates upward from the solids which report to the bottom of the main vessel 144. The solvent diluted bitumen forms a liquid zone above a lower solids zone, and a stream of solvent diluted bitumen 22 is withdrawn via a liquid outlet 202 located in a side wall of the main vessel 144. The liquid outlet 202 can be located in the lower conical portion of the upper cylindrical portion of the main vessel. An inerting line 204 provides inert gas to the main vessel 144.

Referring still to FIG. 9, a portion of the solvent diluted bitumen stream 22 withdrawn from the main vessel 144 can be recycled to a different part of the extractor 142, e.g., to the auger conveyor 146 and/or the feedwell 162, via a diluted bitumen recycle line 206 which can pass through a recycle pre-heater 208 and be displaced by a recycle pump 210. Prior to reintroducing the solvent diluted bitumen into the extractor 142, it can be mixed with another solvent stream which may be fresh solvent, solvent rich solbit from a downstream unit, or a combination thereof. FIG. 9 illustrates the recycle stream 206 being split and then each stream is combined with a solvent containing stream 18 before being introduced into the extractor 142.

Regarding the implementation illustrated in FIG. 9, the auger extractor can facilitate combining digestion, extraction, separation, as well as washing in a single unit. Digestion and extraction are promoted in the feedwell and in the bottom of the main vessel; separation is enabled in the upper liquid zone within the main vessel; and washing is promoted in the auger conveyor into which solvent is introduced and from which a solids rich tailings material is eventually discharged.

Figure 12:
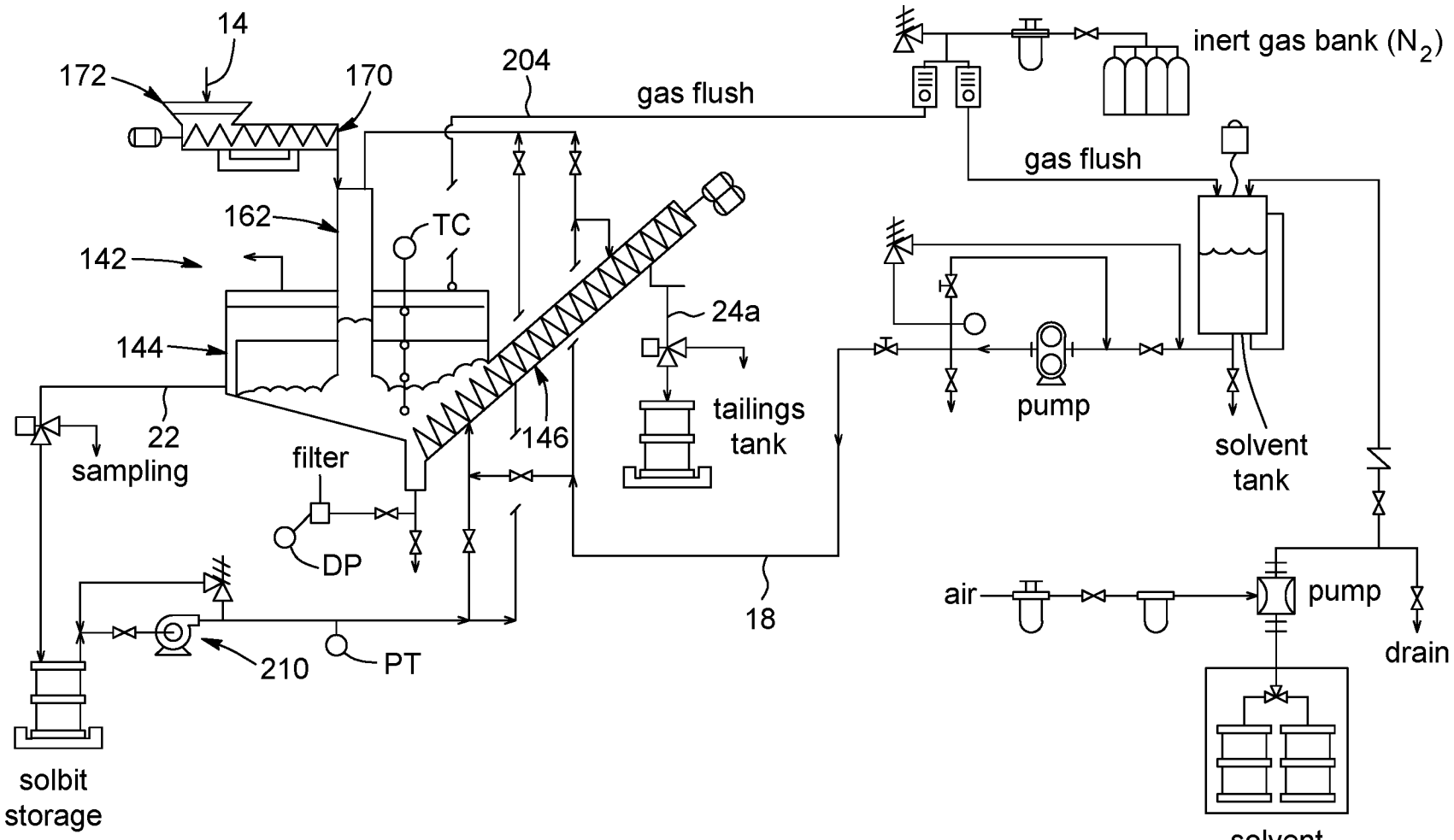
FIG. 12 is a flow diagram of a pilot test process for bitumen extraction including an integrated auger extractor.

Referring briefly to FIG. 12, the auger extractor 142 has been assessed as part of a pilot process generally illustrated in this figure. It should be noted, however, that the auger extractor 142 could be integrated within an overall process in which various other units would be present, e.g., hoppers, conveyors, a centrifuge, a rotary dryer, etc. In this pilot process figure, some storage tanks and fluid supply systems specifically set up for the scale of the pilot are illustrated.

Figure 13:
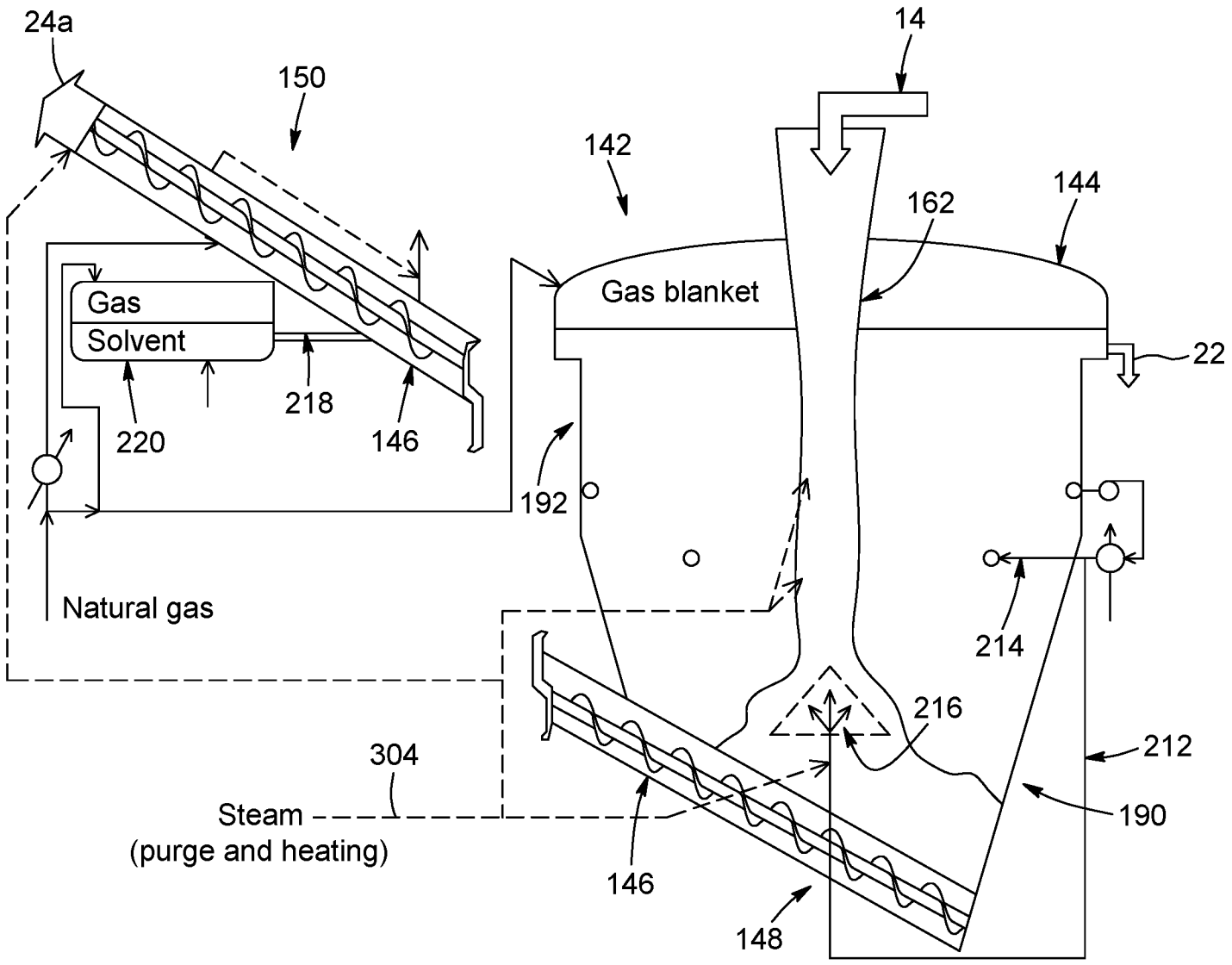
FIG. 13 is a partial view schematic diagram of an integrated auger extractor.

Referring now to FIG. 13, an alternative implementation of the auger extractor 142 is shown. In this implementation, recirculation systems 212, 214 as well as solvent injectors 216 to inject solbit into the incoming oil sands material are provided to facilitate digestion and extraction. Extraction is also promoted at the upstream end 148 of the auger conveyor where the oil sands material rich in bitumen is subjected to mixing energy. Washing and removal of coarse solids are facilitated by the auger conveyor 146 and solvent introduction 218 therein. Separation occurs in the upper portion 192 of the main vessel where quiescent conditions are provided to facilitate settling of fine solids. Natural gas or another gas can be supplied to provide gas blankets in the main vessel 144 and/or a solvent supply tank 220. The feedwell 162 can be similar to that of the previously described implementation, extending vertically down to a certain point in the interior of the main vessel 144.

Figure 14:
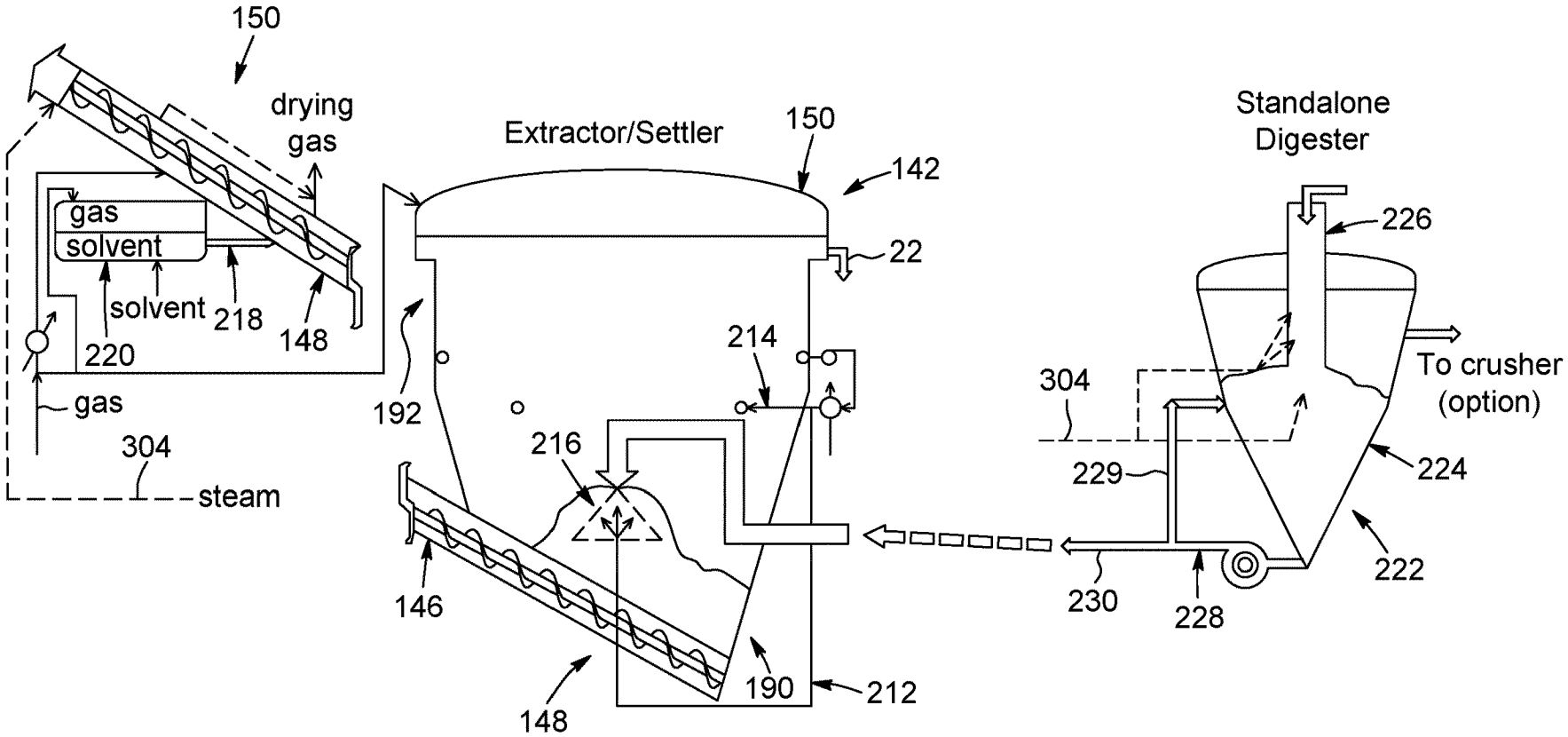
FIG. 14 is a schematic diagram of an integrated auger extractor coupled with an upstream standalone digester.

Referring to FIG. 14, another alternative implementation of the auger extractor 142 is described. In this implementation, there is a standalone digester 222 provided upstream of the auger extractor 142. The standalone digester 222 can include a conical bottomed vessel 224 having an oil sands feed 226 and an underflow recirculation circuit 228 configured to withdraw underflow from the bottom of the vessel 224 and pump it around back into the vessel 224 via a recycle line 229. The standalone digester 222 can also be operated such that solvent is present with the oil sands material, to facilitate digestion and to provide a slurry that can be pumped. Solvent addition could be done via various solvent inlets, and solvent could also be added upstream as part of a wet crushing operation. A feed line 230 can be coupled to the underflow recirculation circuit 228 to supply a portion of the stream to the auger extractor 142, which can have a generally similar configuration as that shown in FIG. 13 except less digestion would be required and thus the design and operating parameters of the feed, the recirculation systems 212, 214, and other extractor characteristics could be modified accordingly.

Referring to FIG. 15, an example auger conveyor is illustrated showing dual augers from a top view. The housing is box-shaped and the upstream end has an upward facing inlet for the solvent and oil sands material, while the downstream end has a downward-facing outlet for discharging the tailings. Different areas of the auger conveyor provide different primary functions, i.e., mixing and extraction, rinsing of bitumen via the solvent, draining of solvent and diluted bitumen, and production of a "dry" tailings material.

The auger extractor can facilitate combining digestion, extraction, separation, as well as washing in a single unit. Depending on the design and operation of the auger extraction, there may be an upstream standalone digester which performs part of the majority of the digestion operation. In addition, there may be a downstream standalone washer that receives tailings and provides a solvent wash, for example if the auger conveyor is operated such that the discharged tailings are not sufficiently washed or could benefit from additional solvent washing.

The auger and settler extractor options described herein can be operated at or near atmospheric pressure if the feed entry point sealing is conducted using the feedwell as described herein.

The auger functionality can also be achieved through other designs such as baffles, paddles, blades and/or washers or other types of projections. For example, referring to FIG. 10*b*, the rotating shaft or shafts 174*a*, 174*b* can have projections 177*a*, 177*b* extending from the outer surface of the shafts, and configured to impart mixing energy to the oil sands material while advancing solids downstream and allowing back flow of solbit. The projections 177*a*, 177*b* can have various shapes, sizes, orientations and constructions. The projections 177*a*, 177*b* can be removably mountable to the shafts for ease of maintenance and replacement; they can be the same along the length of the shafts and between the two shafts, as the case may be, or they can be different at different locations based on the functions at different points along the rotating conveyor; and/or they can be made of a wear resistant material or have a wear resistant coating.

The displacement system (e.g., auger conveyor or alternative type of rotating conveyor) can have design differences along the length of the conveyor to provide different functionalities at different locations. For example, different designs of operation can be provided in the upstream extraction section of the augers versus the middle and downstream sections. This could include different flighting size or spacing. In addition, the upstream auger sections could be configured to rotate faster than the downstream ones. Further, the inclination angle of the upstream augers could be less than downstream ones.

It is appreciated that the digestion, extraction and/or separation operations can be done using other implementations of extractor units, such as units including a pair of rotating conveyors connected to one another, or units including a primary extraction assembly with rotating elements, as will be described further below.

Batch Mode Integrated Extraction Unit

Figure 16:
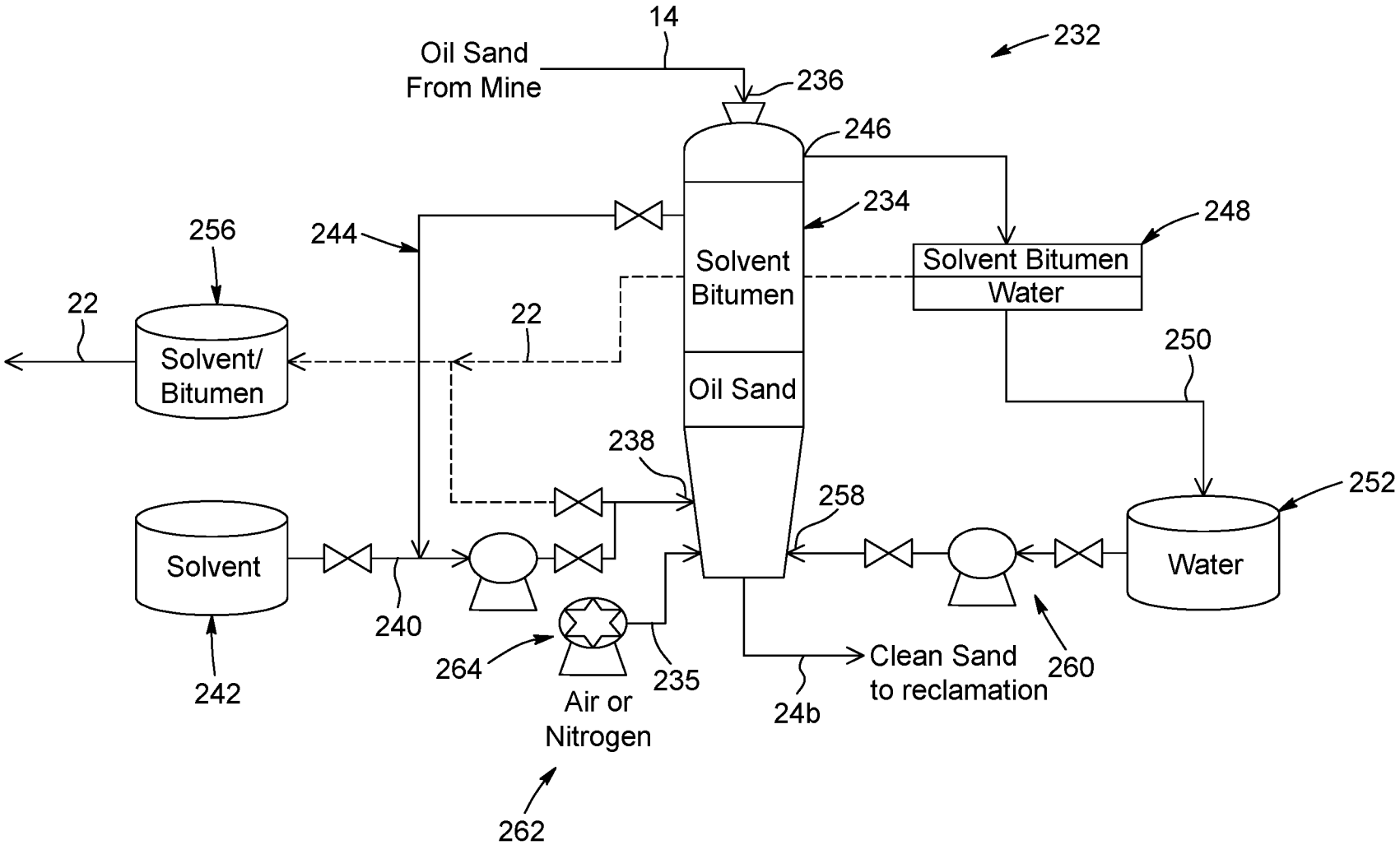
FIG. 16 is a flow diagram of a batch extraction process and associated equipment for extracting bitumen from oil sands.

Referring to FIG. 16, the integrated extraction unit can include a batch extractor 232 that has digestion, extraction and separation functionalities. The batch extractor 232 could be integrated within an overall continuous process by providing appropriate holding and surge tanks for various input and output streams.

In the batch mode implementation, the batch extractor 232 includes a vessel 234 having an oil sands material inlet 236 for receiving crushed or sized ore and a solvent inlet 238 for receiving a solvent containing fluid 240 from a solvent source 242. Once the vessel 234 is filled with ore and solvent as well as an inert gas 235, the batch process can be initiated and includes operating a batch recirculation system 244 for recirculating the solvent and oil sands material to promote digestion and extraction. The recirculation system can be arranged to remove liquids from the top part of the vessel 234 for reintroduction back into the bottom of the vessel 234. During recirculation treatment, the other inlets and outlet are closed such that the vessel and the recirculation system form a closed loop circuit. After subjecting the materials to recirculation for a certain residence time or based on other parameters that may be pre-determined or monitored, recirculation is ceased, and the materials are allowed to rest within the vessel 234, thus enabling gravity separation. The mineral solids settle to the bottom and the solvent and bitumen separate upward and accumulate at the top of the vessel.

After separation has occurred, the diluted bitumen is withdrawn via a diluted bitumen outlet 246 and can be supplied to a water separator 248 for removing water originating from connate water in the ore from the dilute bitumen. The water 250 can be sent to a water holding tank 252 for use later in the process. The water depleted diluted bitumen 254 can be sent to a bitumen holding tank 256.

The solvent affected mineral solids in the bottom of the vessel 234 are then further treated to remove solbit from the pore space between the solid mineral particles. In this batch washing phase, a wash fluid such as water or fresh solvent can be introduced into the vessel 234 via a wash fluid inlet 258, for example. An additional tank can be provided for holding fresh solvent for use as wash fluid, and associated piping would also be provided. The wash fluid is introduced to remove residual solvent and bitumen. In one implementation, there is a wash fluid recirculation system 260 that includes various lines as well as an inlet and outlet from the vessel, so that the wash fluid can be introduced into the vessel and then the wash liquor with entrained solbit can be removed from the vessel and, optionally, fed through a wash fluid separator to remove bitumen and/or separation wash fluid from the entrained hydrocarbons. When water is used as a wash fluid, the water separator and associated piping can be used as part of the wash fluid recirculation system 260, as illustrated in FIG. 16.

The batch extractor 232 can also include a gas drying system 262 that is configured to force gas (e.g., air or nitrogen) into the vessel after washing is complete in order to dry the solid mineral material by removing wash fluid from the pore space of the solids. The gas drying system 262 can include a gas compressor 264 and inlet line 235 to force gas into the vessel 234 and through the mineral solids. The wash fluid laden gas is then rejected via a gas outlet (not shown) and can be further processed to remove gas from the wash fluid. The recovered wash fluid can be reused in the process, if desired, and the gas can also be recycled and reused.

After drying, the solid mineral material in the vessel is generally dry and includes very low residual bitumen and solvent. This dried material can be removed from the vessel 234 and transported by solids handling means for disposable (e.g., within a mine pit) or further processed (e.g., for recovery of valuable minerals or other non-hydrocarbon components that may be present in the dried tailings material; or for additional removal of bitumen or solvent within another processing unit).

Regarding the batch extraction methodology more generally, the non-aqueous batch extraction process can facilitate bitumen recovery from oil sands material by using a one-vessel process to extract bitumen, wash the solvent-bitumen mixture, and dry mineral solids materials for reclamation. The batch process can include the following steps:

- Filling the batch extraction vessel with oil sand material. The filling can be done to a pre-determined height within the batch vessel and can be facilitated using hopper and screw feed systems similar to those shown for continuous process implementations, although the feed system could be operated intermittently based on the batch operation. The feed of the oil sands material can be performed via a feedwell or via a simple inlet opening, which can be located in a top of the vessel or in a side wall of the vessel. This feed inlet should be sealable during the batch operation and circulation.
- Filling the vessel with solvent (e.g., cyclohexane, hexane, pentane). The solvent can be fed to the vessel via a solvent inlet, which can be located in a side wall of the vessel or at the top of the vessel, or indeed at multiple locations around the vessel if desired. The solvent inlet can be a distinct dedicated inlet that is sealed and not used during batch circulation, or it can be part of the batch recirculation system 244. In the latter case, as illustrated in FIG. 16, the line from the solvent tank 242 and the batch recirculation system 244 can be sealed (e.g., using a valve) during the circulation. Solvent can be introduced in an amount based on the amount of oil sands material introduced into the vessel. In addition, the solvent introduction can be performed simultaneously with feeding the oil sands material, but it can also be commenced after oil sands material has been introduced which can facilitate the requirements for the oil sands feed system in terms of inerting. In other words, it may be simpler in terms of operation and equipment design to commence solvent introduction after the oil sands have been introduced and the oil sands feed inlet has been sealed.
- Circulating the solvent and fluidizing the oil sands material to extract bitumen. In this step, the vessel and the recirculation system 244 form a circuit through which the material flows. In the illustrated implementation, there is a single recirculation system 244 but there could alternatively be multiple recirculation systems that withdraw from different points (same or different heights and/or radial locations) of the vessel and reintroduce material back into the vessel at different points. The approach to the recirculation system can be to provide desired fluid dynamic properties and flow regimes in the vessel and in the pipes and pumps of the system during recirculation in order to provide the desired bitumen extraction.
- Draining or otherwise removing the solvent-bitumen mixture from the vessel. This step can also be viewed as including an initial settling step to allow separation of the solvent and bitumen from the mineral solids to form an upper hydrocarbon zone and a lower solids rich zone in the vessel. Withdrawal of the solvent-bitumen can be done as a single step where a liquid outlet is opened, and the hydrocarbons are removed continuously until removal is complete. The liquid outlet can be positioned on the vessel to provide good removal of liquid hydrocarbons, e.g., by locating the outlet above but close to the lowest part of the hydrocarbon zone or its interface with a solids rich zone. The liquid outlet can be positioned to communicate with the hydrocarbon zone and once opened the pressure in the vessel enables flow of the hydrocarbons out of the vessel. Alternatively, the withdrawal of hydrocarbons can be performed in stages during the settling, to enable removal of low solids hydrocarbons while higher solids hydrocarbons are still undergoing settling and then removing the remaining hydrocarbons after further settling has occurred. Other removal methodologies can also be implemented.

Washing the remaining solvent bitumen mixture from mineral solids (e.g., sand) by adding a washing fluid that can be water and/or solvent to float off hydrocarbon material. The washing fluid can be done by adding solvent, which could be the same or different solvent compared to the solvent added to the oil sands material for extraction. The washing fluid can be water, which can be derived at least in part from water separated from the bitumen and solvent rich liquid removed from the vessel. The washing fluid can be fresh solvent, which can include recovered solvent from the process. A combination of solvent and water could also be used. The selection of the wash fluid can be done based on various factors, such as the ease of drying the mineral solids after washing, the cost of wash fluids (e.g., solvent), and downstream processing requirements to separate solvent, bitumen and wash fluid for reuse. The wash liquor exiting the vessel can be processed further in order to remover wash fluid and also obtain solvent and/or bitumen components that can be supplied to appropriate tanks.

Forcing a gas, such as air or nitrogen, into the vessel and through mineral solids to dry remaining solids. Depending on the wash fluid used in the previous step, the gas-assisted drying can be impacted in terms of drying times, gas flow rates required, and ability of the gas to strip wash fluid from the pore space of the mineral solids. For example, if solvent is used as wash fluid, solvent-laden gas exiting the vessel could be supplied to a solid absorption bed or another unit for purification. The gas exiting the vessel will include some wash fluid entrained therein, and the gas can then be subjected to a separation stage in which the wash fluid is recovered for potential reuse in a subsequent batch or even a same batch.

Draining or otherwise removing the dried mineral solids from batch extraction vessel. The dried solids can be further processed or disposed of in a mine pit for example.

It is noted that for the batch extraction process, the upstream crushing, sizing and feed system to the extractor can be adapted to the batch mode operation. Holding facilitates can be provided in order to store material until required for a given batch. In addition, in one implementation, multiple batch extractors can be operated in parallel such that the upstream ore preparation as well as downstream diluted bitumen processing can be operated in a continuous mode while the extraction is operated in batch mode. The batch extractors can thus be operated according to an operating schedule or pattern to facilitate seamless integration with upstream and downstream processing that may be continuous.

With respect to the batch extraction process, laboratory piloting (500 g-1 kg) can be performed to test a batch system. Certain advantages could be achieved using batch extraction, e.g., significant reduction of plant size, enhanced safety and simplicity in process design, and production of dry tailings ready for reclamation. Such advantages can also lead to a reduction of capital and operating cost for mined oil sand processing, the production of dry tailings materials instead of larger amounts of fluid tailings; and a smaller and simpler plant footprint compared to the examples of continuous solvent extraction plants.

Alternative Arrangements for Digestion, Extraction and Separation

It should be noted that example integrated extraction unit designs described above can be combined with other standalone units that provide additional operations, such as digestion, extraction, washing, and the like.

For example, the extractor can be preceded by a standalone digester that facilitates digestion using a recirculation system (see FIG. 14 where a standalone digester 222 is followed by an auger extractor 142). A standalone digester can be provided upstream of various other extractors described herein; and it can have a design such as that shown in FIG. 14 or another design.

Figure 17:
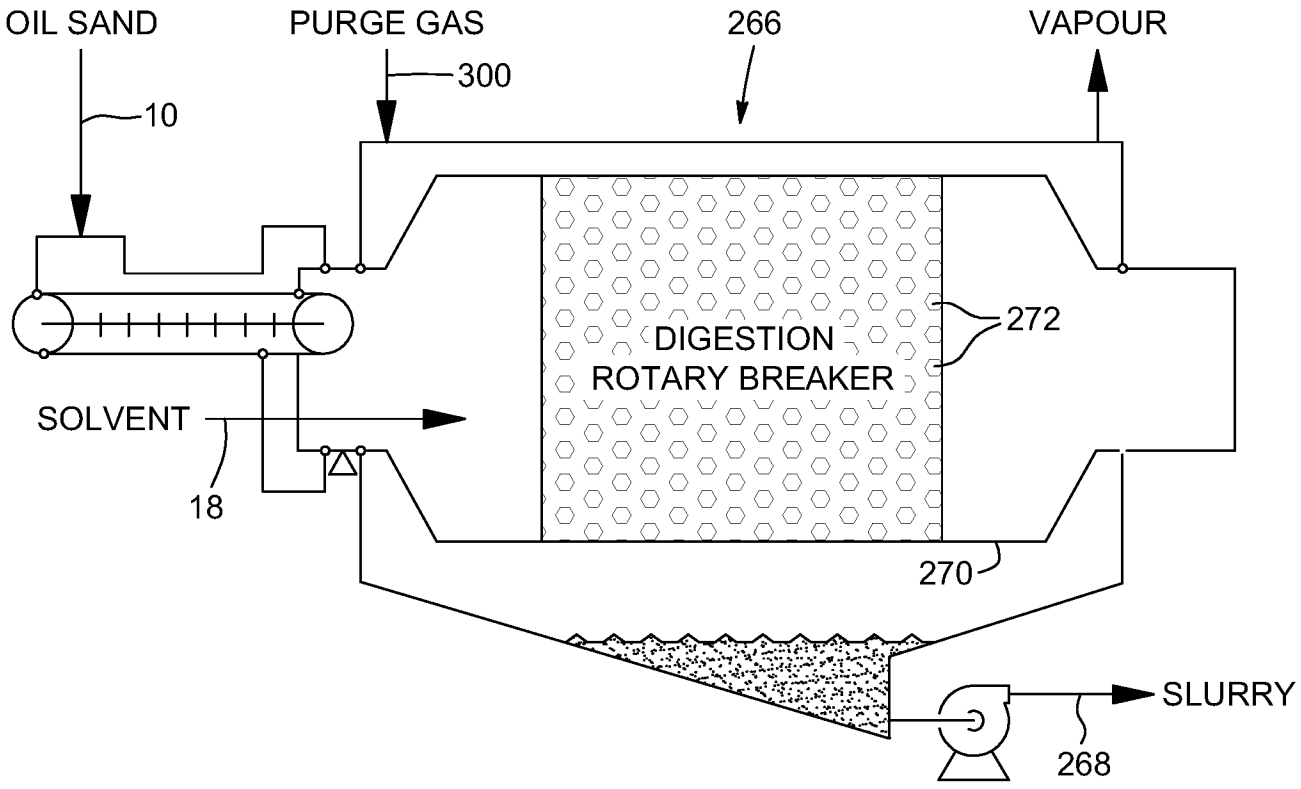
FIG. 17 is a schematic diagram of an example rotary digester unit.
Figure 22:
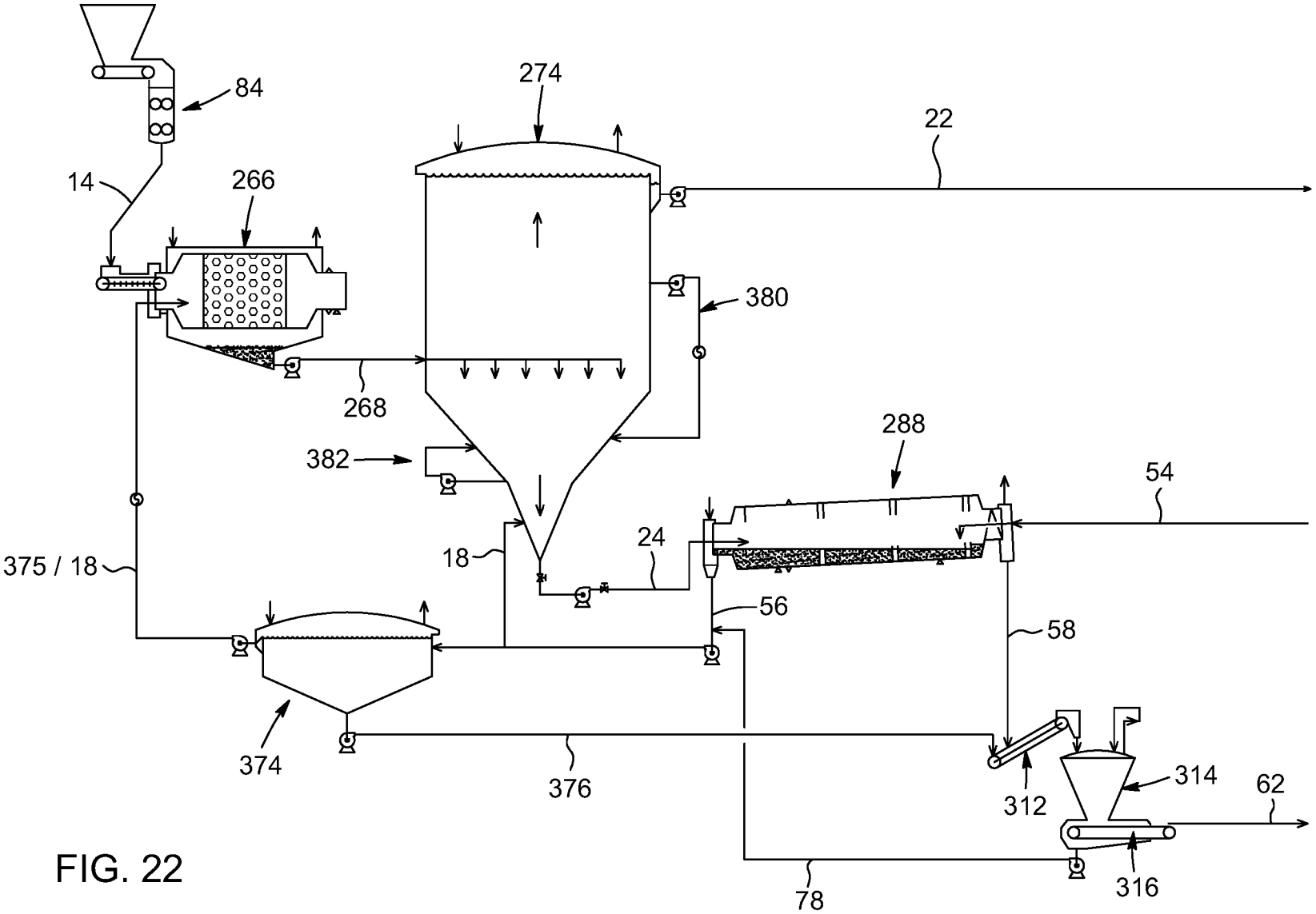
FIG. 22 is a schematic diagram of another example process for extracting bitumen from oil sands, including a rotary digestion unit, a gravity extraction and separation unit, a fines settling unit, and a counter-flow rotary drum washing unit.

Referring to FIG. 17, a rotary digester 266 can be provided as another type of standalone digester upstream of the extractor. This rotary digester 266 can receive oil sands 10 which may be sized, solvent 18 and purge gas in order to produce a digested solvent slurry 268 that can be fed to a downstream extractor. The rotary digester 266 can include a rotating drum 270 with perforations 272 and may also have breaker, lifter and advancer elements extending from the drum wall internally. An example of the rotary digester 266 used as part of a larger process configuration is shown in FIG. 22 where the digested solvent slurry 268 is fed to an extractor/separator unit 274.

Figure 18:
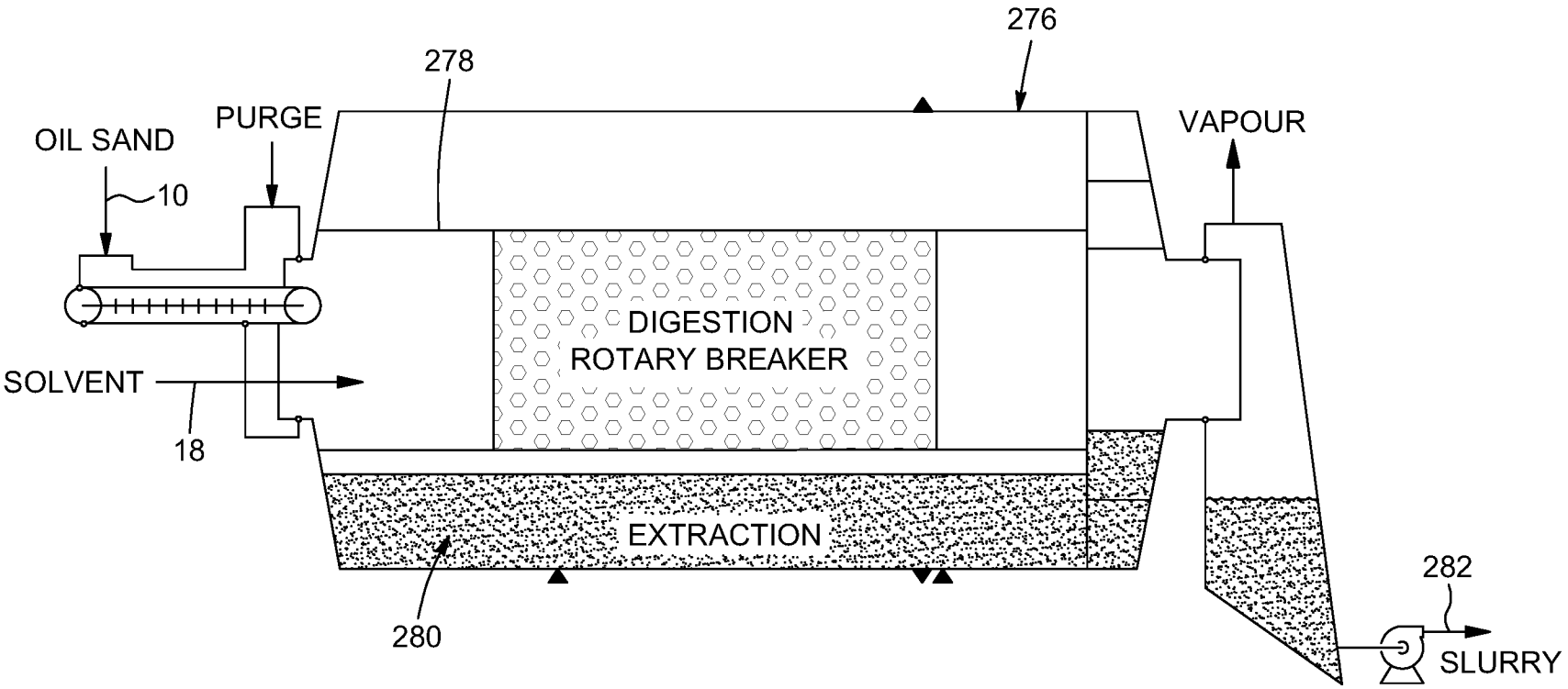
FIG. 18 is a schematic diagram of an example integrated digestion and extraction unit.

Referring to FIG. 18, an alternative unit is shown for providing digestion and extraction, and the resulting slurry can be supplied to a separation unit. This unit can be referred to as a digestion and extraction unit 276. The digestion and extraction unit can include a rotary breaker drum component 278 for digesting, breaking and sizing the oil sands ore as it is mixed with solvent introduced into the rotary drum. The digestion and extraction unit 276 can also include an extraction chamber 280 than receives solvent and the sized digested material and provides moderate mixing and residence time sufficient to extract bitumen from the mineral solids. The resulting extraction solvent slurry 282 can be pumped from the extraction chamber to a downstream standalone separator unit (see, e.g., gravity settler separator 284 of FIG. 26 or auger-type separator 286 of FIG. 24). Thus, for this case, an integrated digester and extractor is followed by a standalone separator.

As another example, which can be combined with the digestion and extraction unit of FIG. 18, a standalone separator can be used downstream of the extractor to receive a solids containing hydrocarbon stream that includes solvent, bitumen and solid mineral materials. The standalone separator can be a settler vessel configured to promote settling of solids and production of a solids depleted hydrocarbon material. The standalone separator can be coupled with an integrated extractor that provides some separation (e.g., extractor designs of FIG. 5, 9, 13, 14 or 16) and can thus be viewed as enabling additional solids removal after primary removal has occurred in the extractor. For example, when the integrated extractor produces a diluted bitumen stream that still has a certain quantity of mineral solids, due to extractor operation or upset conditions, the separator enables additional solids removal in a distinct unit. Alternatively, the standalone separator can be designed and configured to receive a non-separated oil sands and solvent slurry, such as the output slurry stream of the digestion and extraction unit of FIG. 18. Two examples of standalone separators are the gravity settler separator 284 of FIG. 26 and the auger-type separator 286 of FIG. 24.

Furthermore, in some implementations, the integrated extractor can also include integration of solvent deasphalting to facilitate removal of ultra fine solids in the diluted bitumen overflow that is produced, while also removing some of the asphaltenes within the bitumen and thus resulting in a higher value, pipelineable bitumen product requiring less diluent than regular bitumen. Such deasphalting integration could include the use of certain paraffinic solvents at solvent-to-bitumen (S/B) ratios and operating conditions (e.g., temperature) that would cause precipitation of asphaltene aggregates, which would form part of the tailings underflow.

Processing of Solvent Diluted Bitumen

Referring to FIGS. 7 and 8, the diluted bitumen 22 produced by the extractor is supplied for further processing. The diluted bitumen 22 can be subjected to polishing in one or more centrifuges. The centrifuges can be operated to primary remove fines from the diluted bitumen, and thus produce a solvent affected fines stream 30. Polishing units other than centrifuges can also be used to remove residual solids from the diluted bitumen 22 and can be designed and implemented depending on the quantity and size of the solids, for example.

The bitumen enriched, solids depleted stream 42 includes predominantly solvent and bitumen. This stream 42 can be supplied to various upgrading or other processing operations. For example, the bitumen enriched, solids depleted stream 42 can be supplied to a deasphalting unit to produce a deasphalted oil and an asphaltene fraction. Other partial or full upgrading operations can be used to process the bitumen stream 42, including thermal treatments, coking, and so on, depending on the end products to be produced and sold.

The bitumen stream 42 can also be subjected to a solvent removal step, as shown in FIG. 2 for example, prior to subsequent processing. This solvent removal 44 can enable the solvent used in the extraction to be recovered and recycled back into the extraction operation, while the solvent depleted bitumen can be processed or diluted for transportation or storage. The solvent removal step can be performed by distillation, for example.

Processing of Solvent Affected Tailings

Referring to FIGS. 7 and 8, the solvent diluted coarse tailings 24 produced by the extractor are supplied to a washing unit 52, which can have various designs. FIG. 7 illustrates a counter-flow rotary drum type washing unit, while FIG. 8 shows an auger classifier type washing unit. Other washing unit designs are possible, such as a co-current unit which may require more stages than a counter-current unit.

Counter-Flow Rotary Drum Type Washing Unit

Figure 19:
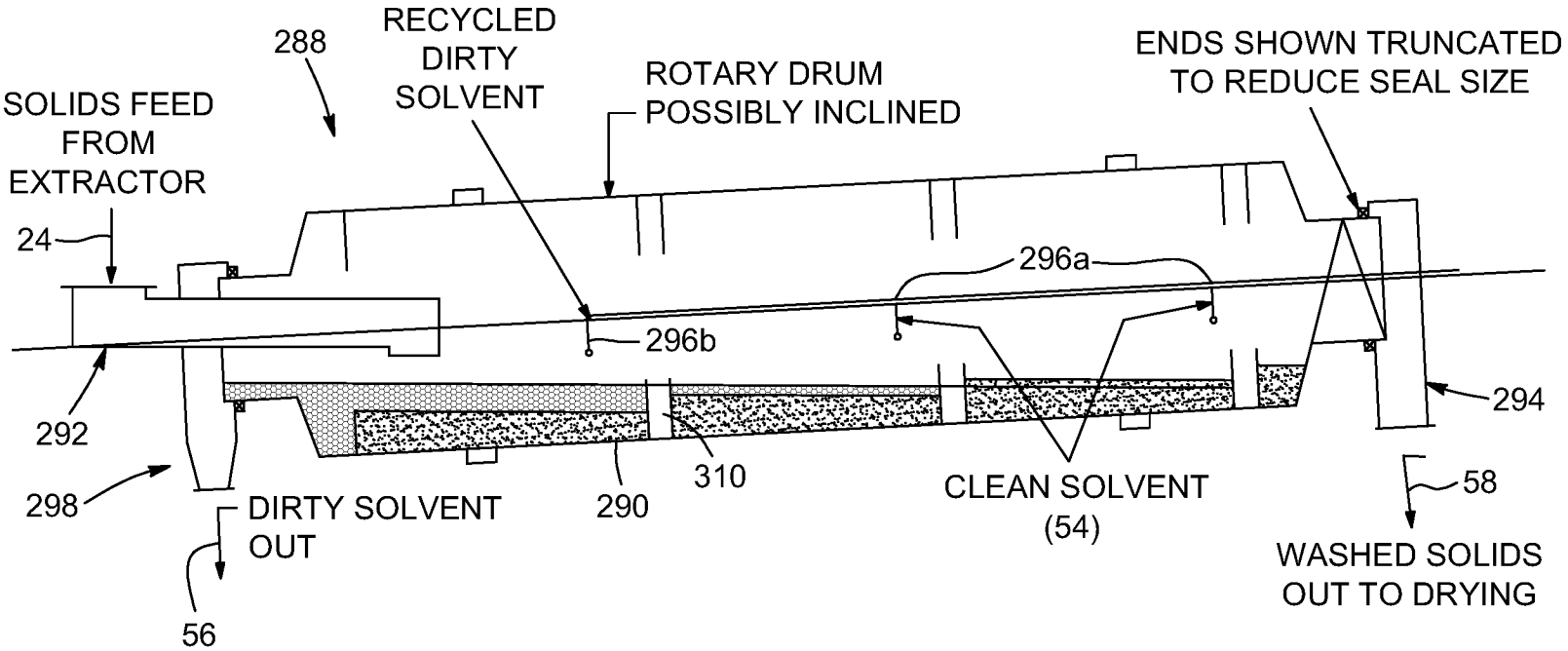
FIG. 19 is a schematic diagram of an example counter-flow rotary drum washing unit.

FIG. 7 shows the integration of the counter-flow rotary drum 288 within the overall process. FIG. 19 shows a close-up view of unit itself.

The counter-flow rotary drum 288 includes a drum vessel 290 that is inclined upward in a downstream direction. There is a tailings inlet 292 provided at an upstream end of the drum vessel 290, and a washed tailings outlet 294 provided in a downstream end of the drum vessel. One or more solvent inlets 296*a*, 296*b* can be provided for supplying solvent into the drum vessel 290 to contact the tailings and clean bitumen from the pore space of the mineral solids. The inclination of the drum vessel 290 facilitates drainage of the solvent toward the upstream end where a wash liquor outlet 298 is provided for withdrawing the wash liquor that includes solvent and bitumen (which can be referred to as solbit). The drum vessel 290 is also equipped with internal baffles, dividers and/or pusher elements 310 extending from an inner wall of the drum and oriented to divide the drum into stages and/or to displace the tailings toward the downstream end when the drum rotates.

Fresh solvent can be added at the downstream end via one or more solvent inlets 296*a* so that the purest solvent contacts the cleanest tailings, thereby facilitating the production of a washed tailings material that has low residual bitumen. The solvent can be introduced at multiple locations, as illustrated in FIG. 19. There may be multiple fresh solvent inlets 296*a* arranged along the length of the drum vessel but generally located in the downstream half or downstream region of the drum vessel, while there may be another solvent inlet 296*b* positioned further upstream and configured to receive a solbit recycle stream rather than fresh solvent. Multiple solvent inlets can be provided around and along the drum vessel 290, and the solvent streams supplied via such inlets can have different compositions and bitumen contents, with downstream inlets typically receiving solvent streams with higher solvent and lower bitumen contents.

Within the drum vessel 290, liquids travel counter-currently by gravity compared to the solids, which travel via the pusher elements and rotation of the drum vessel. Mixing devices (not illustrated) can also be provided within the drum vessel 290 to provide mixing of the liquids and solids at different points in the drum vessel. Speed control of the drum rotation can also be used to adjust solids flow and levels. Internal baffles and separators can also be provided in the drum vessel to provide mixing or create internal compartments within the drum vessel.

The solids discharge end of the drum can be configured for free drainage or dumping of the solids, resulting in a washed solids output that has about 20 wt % of solvent. The washed tailings 58 can then be supplied to a subsequent unit, such as a drainage unit 77 and then a dryer 60, for solvent recovery. As shown in FIG. 7, the washed tailings can be supplied to a conveyor 312, followed by a surge bin 314, and then a conveyor 316 with drainage capacity to produce solvent drainage 78 and drained tailings that can be supplied to a dryer 60.

Auger Classifier Type Washing Unit

Figure 20:
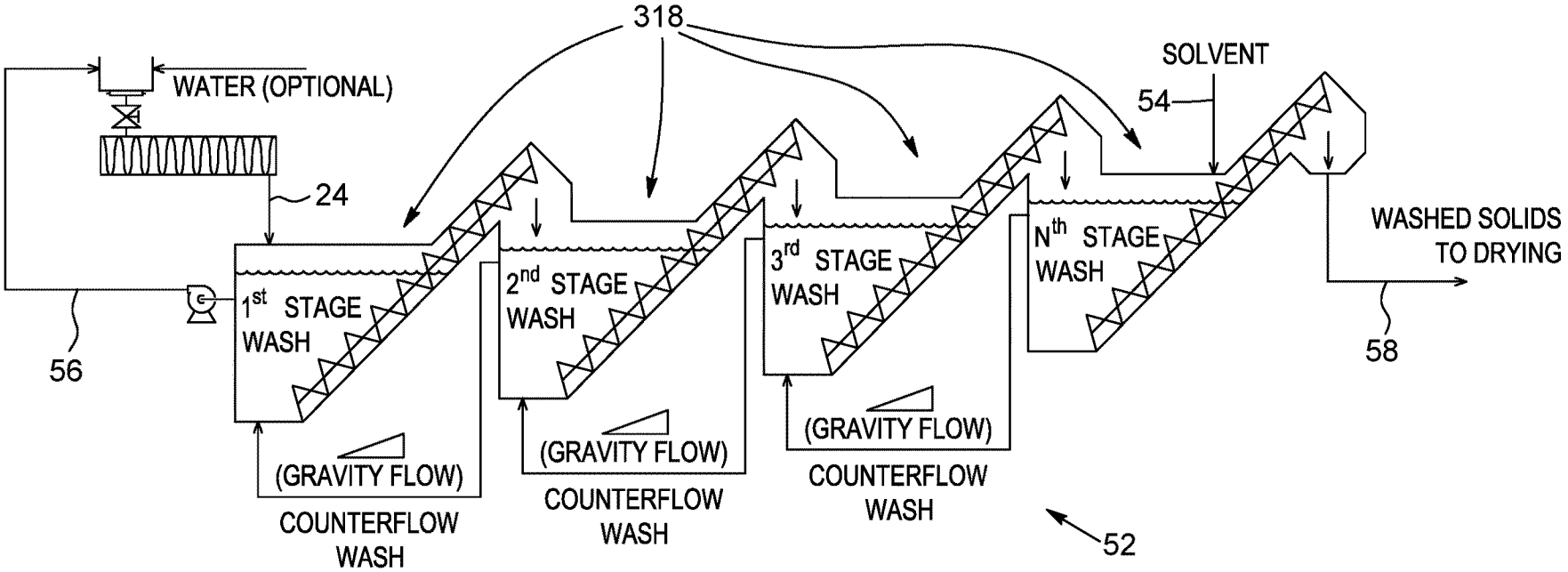
FIG. 20 is a schematic diagram of an example arrangement of multiple auger classifier type washing units in series.

FIG. 8 shows the integration of the classifier washing unit 318 within the overall process. FIG. 20 shows an example where there are multiple auger classifiers 318 arranged in series.

Referring to FIG. 8, the classifier 318 includes a main vessel into the bottom of which classifier conveyor (e.g., auger type) 320 is positioned with the downstream end of the auger conveyor extending out of the main vessel. The coarse tailings 24 are fed into the main vessel where the mineral solids tend to settle to the bottom and the solvent and dissolved bitumen tend to separate upward. The solids depleted solbit 56 can be removed from an upper portion of the main vessel. The mineral solids at the bottom or the vessel engage the upstream end of the classifier conveyor 320 and are transported by the classifier conveyor 320 toward a discharge end as the solbit in the pore space drains back toward the bottom of the main vessel.

Referring still to FIG. 8, one or more solvent inlets can supply fresh solvent into the classifier conveyor in order to wash bitumen and solbit from the pore space of the mineral solids as they are transported along the classifier conveyor. When a single auger classifier is used, this type of solvent addition can enhance the washing operation. Solvent of different purities can be introduced into the classifier 318, with the higher purities being preferred at more downstream locations along the classifier conveyor. For example, fresh solvent can be supplied at a downstream location, while a solbit stream can be supplied to an intermediate location along the classifier conveyor, as shown in FIG. 8. The solbit stream that is fed into the classifier conveyor 320 can be derived from various other units, e.g., downstream drainage or filtering units. Alternatively, fresh solvent can be introduced at multiple locations along the length of the auger conveyor.

Referring to FIG. 20, when multiple classifiers 318 are employed in series for the washing unit 52, a different counter-flow and solvent addition strategy can be provided. In this implementation, fresh solvent 54 can be added at the last classifier stage, and for each stage solbit can be removed the upper part of the main vessel of the stage and introduced into the main vessel of the previous stage, as illustrated. This solbit removal and introduction between classifier stages can be done by pumping or by gravity.

It is also noted that the multiple classifiers arranged in series can employ other types of rotating conveyors besides auger conveyors. For example, rotating conveyors can have shafts with baffles or paddles or other types of projections can be used for these classifiers.

In addition, depending on the operating conditions and design, the classifier type washing unit 318 can produce washed tailings having different properties. For example, in some implementations, the washed tailings 58 are suitable to be fed from the classifier 318 to a drainage unit 77 including a surge bin 314, and then a conveyor 316 with drainage capacity to produce solvent drainage 78 and drained tailings that can be supplied to the dryer 60, similar to the configuration shown in FIG. 7. Alternatively, as illustrated in FIG. 8, the washed tailings produced by the classifier washer 318 can first be fed to a vacuum filter 322 or another type of separator prior to being fed to the dryer 60.

Vacuum Filter

Referring to FIG. 8, washed tailings 58 produced by the washing unit 52 can be supplied to a filter 322 to remove additional solvent and produce a tailings stream that is further depleted in solvent. The filter can be a vacuum filter, a pressure filter, or a balanced draft filter, for example. The vacuum filter 322 can recover a permeate solvent stream 324 than can be recycled back into the washing operation, as for example a relatively pure solvent stream that has a bitumen content lower than other solbit streams but higher than fresh solvent. FIG. 8 shows that this permeate solvent stream 324 can be fed into an intermediate section of the classifier conveyor 320. The permeate solvent stream 324 can also be combined with other solvent containing streams for various uses in the overall extraction process, as shown in FIG. 8.

The vacuum filter 322 also produces a retentate tailings material 326 that can be fed onto the conveyor 312, into a hopper or surge bin 314, and then into a feed system for supplying the material to a solvent recovery system, such as a dryer, as shown in FIG. 8.

A vacuum and inert gas system 328 can also be provided for enabling the vacuum for the vacuum filter, and to provide inert gas to various units that require inerting.

In addition, the tailings supplied to the vacuum filter 322 can include washed tailings that are primarily composed of coarse mineral solids (e.g., sand) as well as fine tailings 30 from the polishing step (e.g., centrifuges). The fine tailings 30 can be combined with the washed coarse tailings 58 prior to feeding into the vacuum filter 322 or the two tailings streams can be fed separately to the same part or different parts of the vacuum filter 322. As noted above, the coarse and fine tailings streams can be combined in various ways and in various proportions in a number of different unit operations of the process.

Still referring to FIG. 8, fresh solvent 54 can be introduced into the vacuum filter 322 as a final washing operation. In this sense, the vacuum filtration can be part of the overall washing step 52. The solvent along with any removed residual bitumen passes through the filter and forms part of the permeate 324. The solvent supplied to the vacuum filter 322 can be controlled depending on the level of washing and/or the permeate composition and quantities that may be desired.

It should be noted that while the vacuum filter 322 is illustrated for the overall process of FIG. 8 in which an integrated gravity settler extractor 96 is used in combination with a classifier type washing unit, a vacuum filter 322 could also be combined with various other types of extractor and washing units in order to remove additional solvent from the washed tailings and/or provide additional washing. Implementation and design of the vacuum filter can also depend on downstream units, such as the type of solvent recovery unit to be used, in order to prepare the tailings to have the proper range of solvent content before being supplied to the solvent recovery unit (e.g., dryer).

The vacuum filter can also be viewed as a preliminary part of the tailings solvent recovery operation. For instance, the tailings solvent recovery operation can include an initial solid-liquid separation stage operated at mild conditions and where the solvent remains in liquid phase (e.g., vacuum filtration); followed by a second solvent removal stage in which the remaining solvent is separated by evaporation using heat (e.g., drying). A solid-liquid separation stage followed by an evaporative drying stage can facilitate the recovery and reuse of solvent as well as the production of a tailings material ready for reclamation.

It should also be noted that the washing can be performed by vacuum filtration methods rather than by auger classifier or rotary drum type washing units. These techniques can also be combined together, an example of which is shown in FIG. 8 (auger classifier and vacuum filter combination). One or more vacuum filters can be arranged and one or more solvent supply lines can be provided to enable the desired washing and solbit production.

Solvent Affected Tailings Handling and Transport

Referring to FIGS. 7 and 8, the washed tailings and/or the retentate tailings material can be transported to the solvent recovery unit 60. The transportation of this solvent affected tailings material 62 can be performed in various ways.

For example, screw conveying and enclosed trough or drag chain conveying are two potential methods that facilitate sealing and high capacity. Vacuum belt conveyors can be used as well in certain situations. Chain conveying can be advantageous for reduced wear and elevating the tailings to a washed tailings surge bin. The conveyors and bins can also be designed to allow free drainage of solvent during transport for collection and discharge of the drained solvent. The drained solvent can be removed from the tailings and reused in the process.

Since the solvent recovery operation (e.g., drying) is advantageously run as a thermal recovery process, it is thus advantageous to provide a consistent feed rate and feed composition. The tailings material to be fed to the solvent recovery unit 60 will be moist and relatively difficult to transport and to achieve reliable bin flow. The bin 314, conveyor 316 and chute designs can thus be provided to facilitate a consistent feed. The bin will be purged, fully enclosed, and equipped with a drain system.

Tailings Solvent Recovery Unit and Methods

Referring to FIGS. 7 and 8, a solvent recovery unit 60 is illustrated integrated within an example of an overall process. Various types of tailings solvent recovery units and methods can be used, including drying with direct or indirect heating in a drum dryer, steam or inert gas stripping, and/or microwave-based separation, which have been successfully tested. One or more types of dryers can be operated in series or parallel, and could be implemented for different solvent affected tailings streams.

The tailings solvent recovery unit 60 can receive a solvent affected tailings stream 62 that includes both coarse and fine mineral solids, or there may be multiple units that receive different solvent affected tailings streams having different compositions and the units can be designed and operated accordingly. In some implementations, at least two separate units or processing trains are provided for treating fine tailings and coarse tailings, respectively, to remove solvent. In addition, units and processing designs can be provided for treating one or more combinations of fine and coarse tailings of different compositions, e.g., one vessel can be provided for treating a certain composition of fine and coarse tailings and other vessels can be provided for treating other compositions of fine and coarse tailings and/or fine and coarse tailings separately.

Drum Dryer

Figure 21:
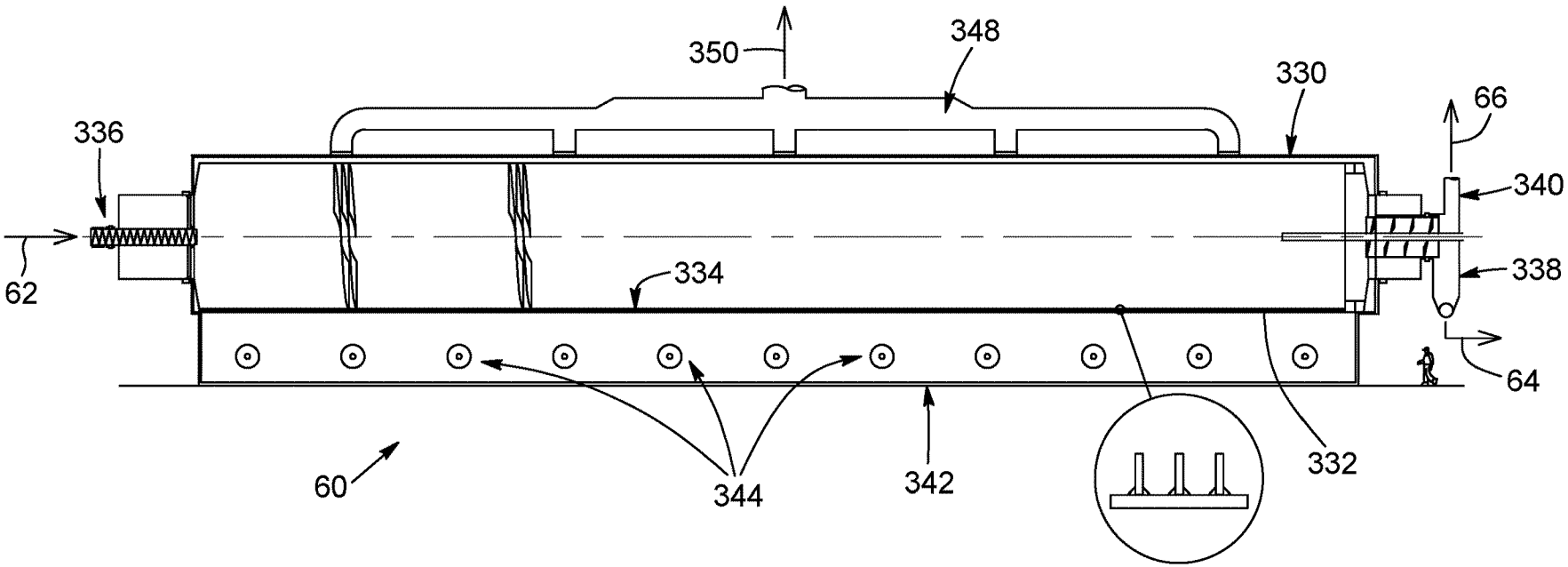
FIG. 21 is a schematic diagram of an example drum dryer that can be used as part of a tailings solvent recovery unit.

FIG. 21 shows an example of a drum dryer 330 type solvent recovery unit 60. In this implementation, as shown in FIG. 21, the drum dryer 330 includes a drum 332 with internal solids advancing elements 334, a tailings inlet 336, a dried solids outlet 338, a vaporized solvent outlet system 340, and an indirect heating system 342 with various heating elements 344. The rotation of the drum 332 enables the solids to be advanced through the drum as the heat vaporizes liquid solvent from the surfaces and pore space of the mineral solids, thereby drying the solid material and recovering solvent vapour 66 that is removed from the drum for processing and reuse. The drum dryer 330 can be operated at about 85° C. and/or about 5° C. above the boiling point of the solvent, for example.

The drum dryer type solvent recovery unit can have various construction and operational features other than those shown in FIG. 21, and can be combined with other types of dryers, if desired.

Referring to FIGS. 7, 8 and 21, the indirect heating system 342 can receive fuel 346 such as natural gas. Alternative heating arrangements are also possible and other fuels can be used, including fuels derived directly from the extraction process. In addition, the drum dryer 330 has a flue gas collection system 348 for collecting flue gas from the drum. The flue gas 350 can be used to preheat air 352 for the indirect heating system and/or other streams.

The solvent vapour 66 withdrawn from the drum dryer 330 would be collected, condensed and compressed back for reuse as liquid solvent. A central vapour recovery system can be used for this purpose. More particularly, the vapour solvent stream 66 can first be supplied to a solvent vapour cyclone 354 and the solids can be recycled back into the tailings feed to the drum dryer 330 while the solids depleted solvent can be sent to a solvent condenser 356 followed by a solvent separator 358 which produces a vapour stream 360, a solvent stream 362 and a water stream 364. Vapour can be reused as part of the purge gas for the dryer, as shown in FIGS. 7 an 8. Non-condensable vapour can also be used as fuel gas for the dryer burner system, for example.

Steam Stripping

In another implementation, steam stripping can be used to remove solvent from the solvent affected tailings material. The steam stripper (not shown) can include a stripper vessel, a tailings inlet, a dried tailings outlet, and a steam inlet. The solvent stripping gas would then be subjected to separation methods to separate the gas from the solvent. This steam stripping vessel could have a number of different design features used for such units. In addition, other types of solvent removal equipment could be used instead of a steam stripper.

Microwaves

In yet another implementation, microwaves can be used to remove residual solvent from the tailings material. After the bulk solvent is removed, e.g., via draining or drum type drying, it has been found that microwave drying can reduce the remaining solvent concentration to below 100 ppmw, which can allow for direct disposal of the dried solids in the mine for immediate reclamation.

Figure 31:
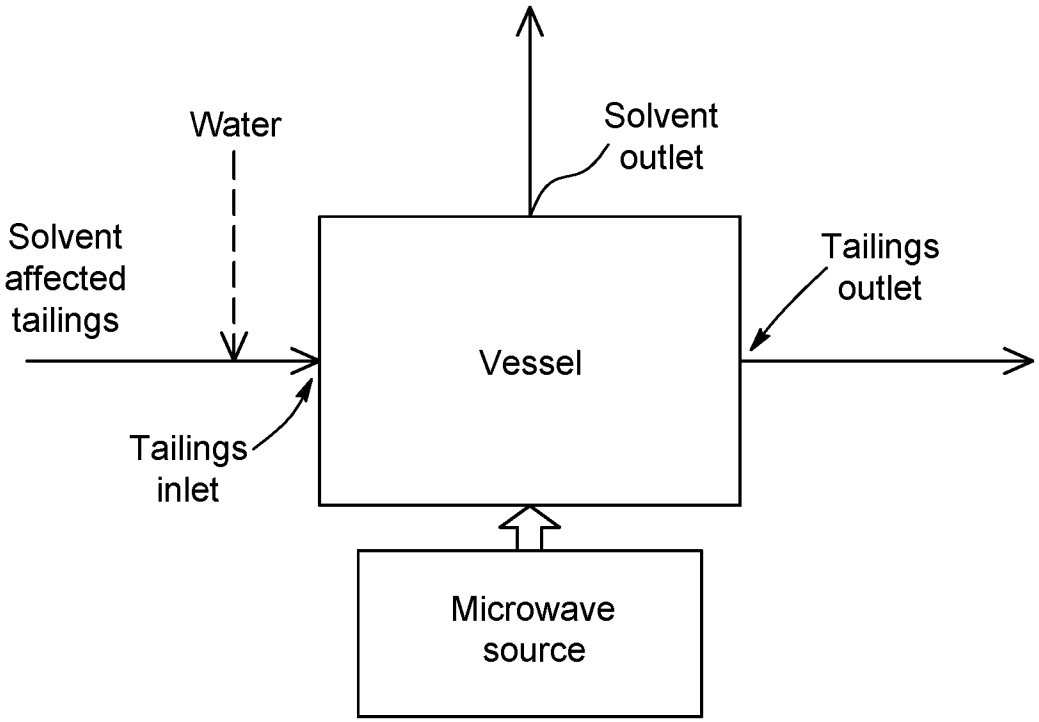
FIG. 31 is a block diagram of a microwave based solvent recovery system.

The microwave based drying unit (see, e.g., FIG. 31) can include a vessel, a tailings inlet, a dried tailings outlet, and a microwave source for generating microwaves that are directed at the solvent affected tailings material. The microwave based drying unit would also include a solvent vapour outlet for recovering evaporated solvent as a vapour stream. The vessel can be configured and operated in various ways, including as a rotating drum to aid exposing the tailings to the microwaves or on a belt conveyor.

In some implementations, water can be added to the solvent affected tailings prior to microwave based solvent recovery. Added water can facilitate solvent removal through microwave drying, as water has certain microwave energy absorption and vaporization properties.

While the microwave based solvent recovery unit can be used as a drying unit that receives washed and drained tailings from upstream units, it should be noted that it can also be used in connection with various other types of solvent recovery applications for tailings. Microwave based methods can present a number of advantages including lower fuel requirements and flue gas production compared to other thermal drying techniques.

Disposal and Handling of Solid Material

Referring to FIGS. 7 and 8, the dried solids 64 can be removed from the dryer and supplied, via screw conveyor 366 and then other solids transportation systems such as a tailings conveyor 368, for example, to a hauler 370 for final transport and disposal. The mineral solid material that is generated for disposal can have certain features, such as a solvent content below 4 barrels, 3 barrels, 2 barrels, or 1 barrel of solvent per 1000 barrels of bitumen extracted, a bitumen content corresponding to 90 or 95 wt % or more bitumen extraction, and so on.

The solid material 64 can include both coarse and fine mineral solids that have been combined upstream in the process, or there can be multiple distinct solid material streams (e.g., a coarse stream and a fines stream) that are generated separately and then disposed of.

The final disposal site can be a mine pit void that was created from oil sands mining operations. For example, a mine pit or area that has been fully exploited can be used as a disposal site such that the dried solid material is used as backfill. Once dried solid material has generally filled the mine pit, other solid materials such as overburden can be used to form a cover. The overall mine pit backfilled with dried solid material can then be subjected to various reclamation activities.

In some implementations, some water 372 can be added to the dried tailings 64 after existing the dryer 330, and prior to depositing the solids back into the mining pit. Water addition can be done in the screw conveyor 366, and can be performed to facilitate transportation and provide dust suppression.

The solid material 64 exiting a drying unit can also be subjected to additional solvent removal using methods such as microwave solvent removal, as mentioned above.

Treatment of Wash Liquor or Solbit

The washing stage 52, which can be implemented with one or more washing units described herein, generates wash liquor 56 which can be used as solbit that is introduced into the extractor or other units. In some instance, it may be desirable to treat the wash liquors prior to introduction into the extraction. Different treatments can be performed on different solbit streams (e.g., solbit streams 56, 78, 324) depending on the properties of the solbit streams and recycle purposes.

Treatments can include modifying the temperature, pressure or composition of the stream. In one example, the wash liquor may include fines and could be subjected to a fines removal step prior to introduction into the extractor. Fines removal can be done, for example, by supplying the stream to a gravity settling type unit. An example of such a gravity settling unit 374 can be seen in FIGS. 22, 23, and 26, and could be integrated with other units in various ways, some of which are illustrated in the figures. Other types of units, such as centrifuges, could also be used. The fines gravity settling unit 374 can produce a solids depleted solvent stream 375 and a solids enriched stream 376. The solids enriched stream 376 can then be supplied along with other washed tailings streams to the surge bin 314 prior to being sent to solvent recovery and drying.

As mentioned above, the wash liquor can also be combined with one or more other solvent containing streams in order to produce one or more solvent streams, of the same or different composition and solvent content, for introduction into the extractor and/or into other units (e.g., washing units, digester units, and so on).

Alternative Implementations of NAE Process and Units

Referring to FIGS. 22 to 26, 32 and 33 a number of alternative examples are provided for processing oil sands ore using non-aqueous extraction techniques. Various units and processing arrangements are illustrated and will be briefly described below.

FIG. 22 shows an example system for extracting bitumen from oil sands, including a rotary digestion unit 266, a gravity extraction and separation unit 274 with certain recirculation systems 380, 382, a fines settling unit 374, and a counter-flow rotary drum washing unit 288.

Figure 23:
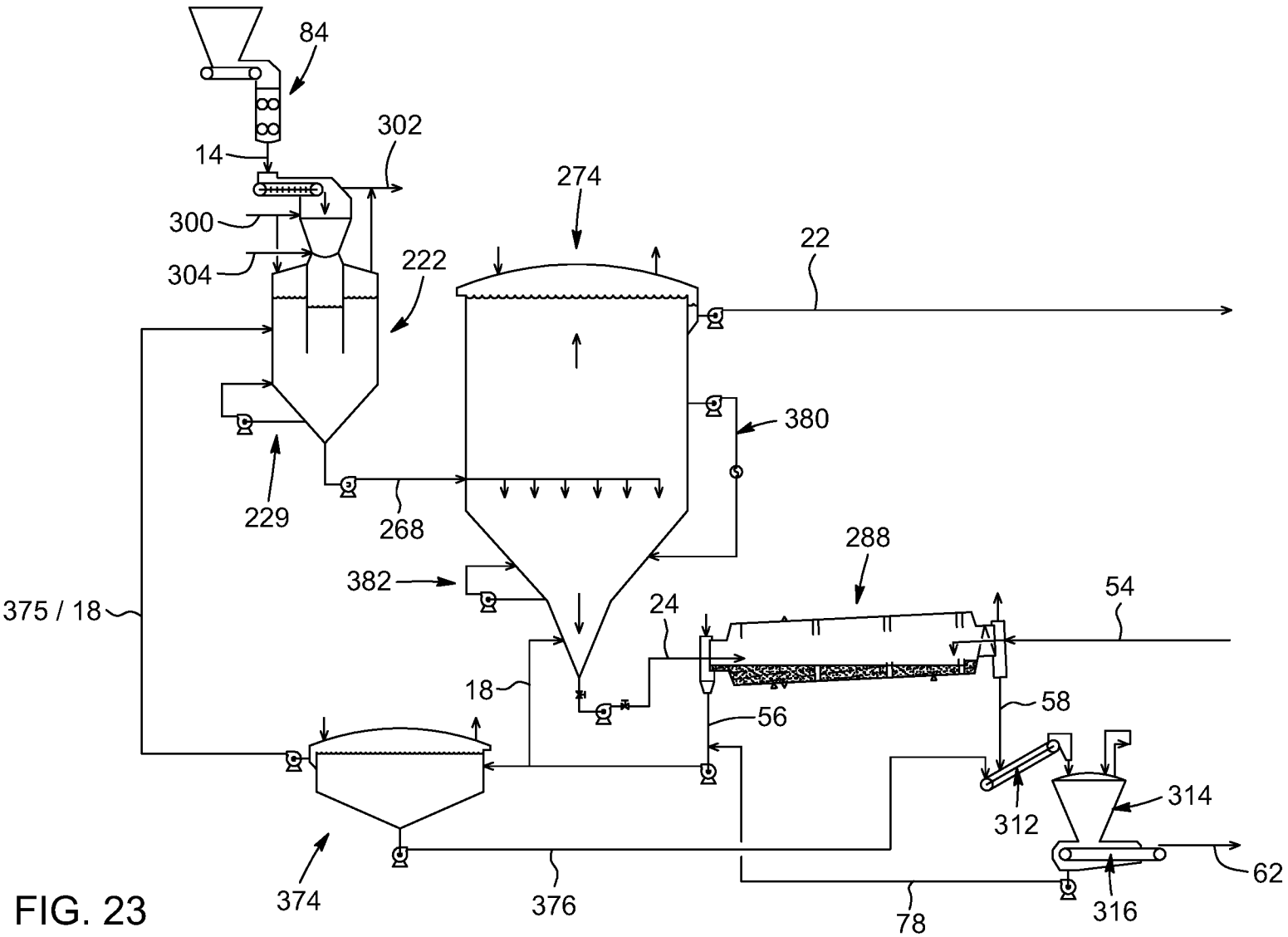
FIG. 23 is a schematic diagram of yet another example process for extracting bitumen from oil sands, including digestion unit with a recirculation system, a gravity extraction and separation unit, a fines settling unit, and a counter-flow rotary drum washing unit.

FIG. 23 shows an example system including a standalone digestion unit 222 with a recirculation system, a gravity extraction and separation unit 274 with certain recirculation systems 380, 382, a fines settling unit 374, and a counter-flow rotary drum washing unit 288.

Figure 24:
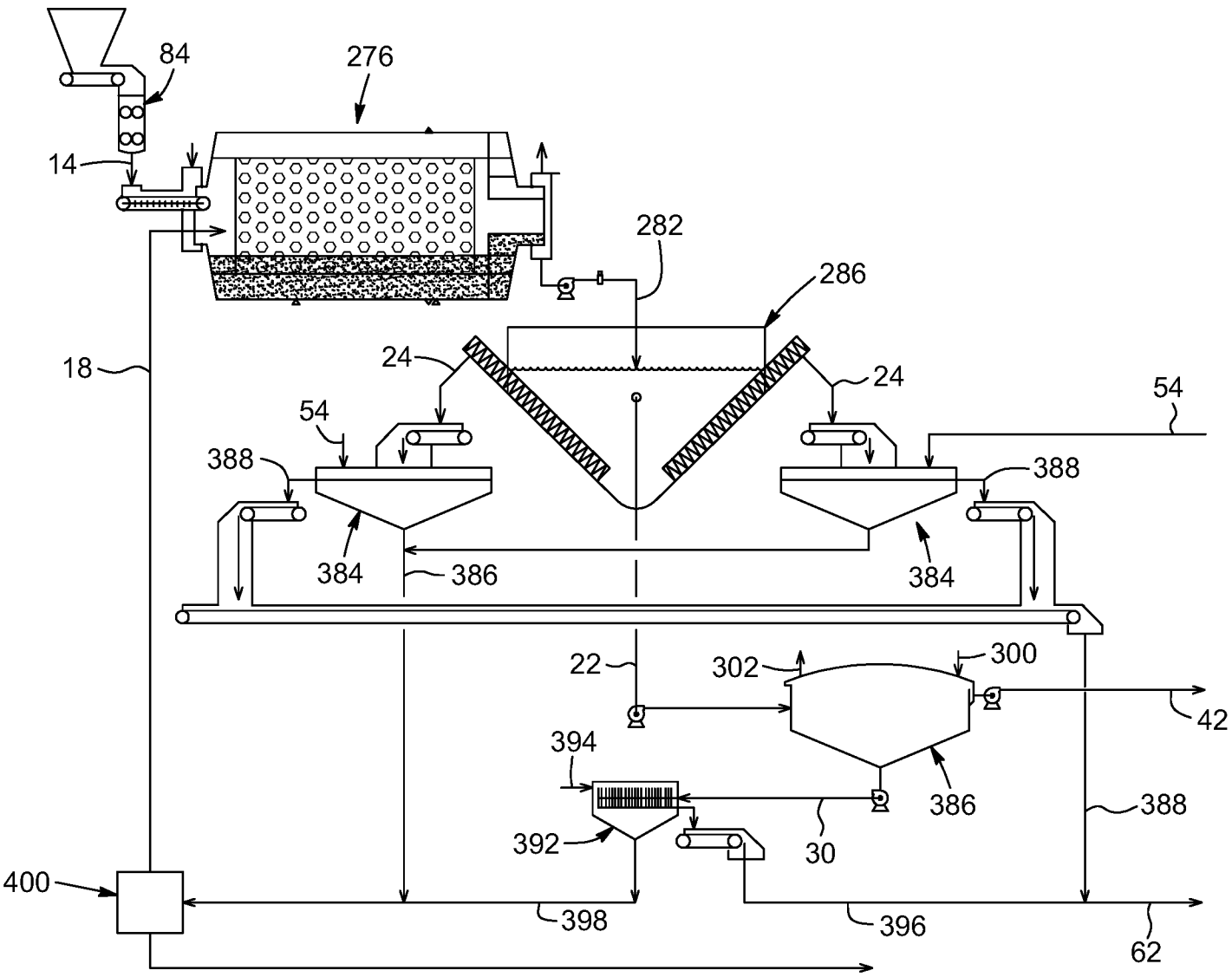
FIG. 24 is a schematic diagram of another example process for extracting bitumen from oil sands, including a digestion and extraction unit, an auger classifier type separation unit, filter type washing units, a thickener and a disc filter.

FIG. 24 shows an example system including a digestion and extraction unit 276, an auger classifier type separation unit 286 which can also be configured to provide washing in the conveyor components of the unit 286, filter type washing units 384 that produce permeate streams 386 and filtered tailings material 388, a thickener 386 that receives the diluted bitumen overflow stream from the classifier separation unit 286 and produces a solids depleted dilbit stream 42 and a fines stream 30 as a solids underflow stream, and a disc filter 392 for receiving the fines stream 30 and a solvent stream 394 to produce a filtered fines stream 396 and a disc filter permeate 398. The permeate streams can be combined together to for the solvent containing stream 18 for the extraction. A vacuum system 400 can also be provided for the filtration units. The filtered tailings material 388 and the filtered fines stream 396 can be combined and then conveyed to a drying unit as a solvent affected tailings stream 62.

Figure 25:
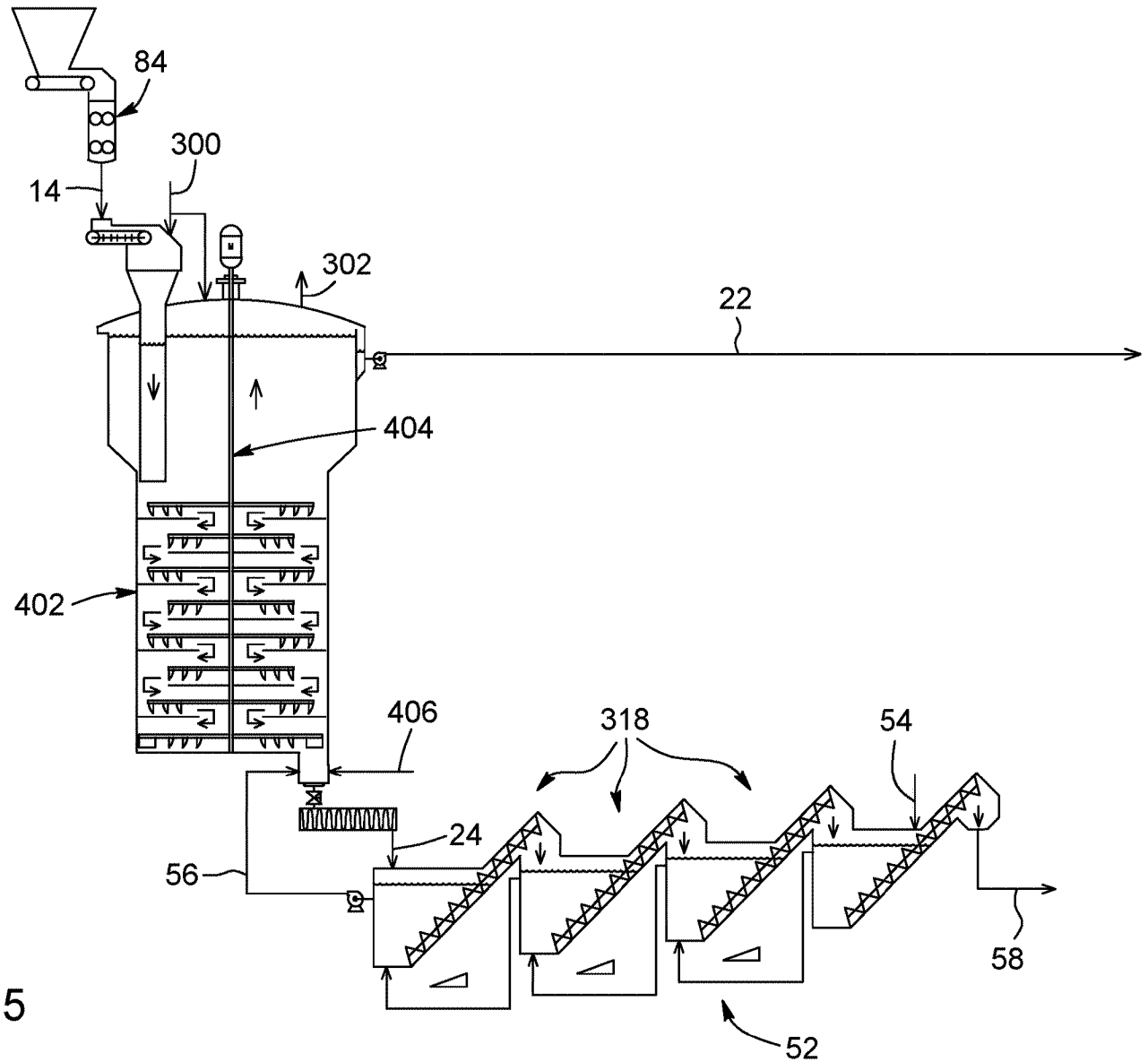
FIG. 25 is a schematic diagram of another example process for extracting bitumen from oil sands, including an integrated extraction unit with a vertically rotating mixing device, and a series of auger classifiers for the washing unit.

FIG. 25 shows an example system including an integrated extraction unit 402 with a vertically rotating mixing device 404 enabling solids cascade flow, and then a washing unit 52 in the form of a series of auger classifiers 318. Water 406 can be added into the underflow if desired.

Figure 26:
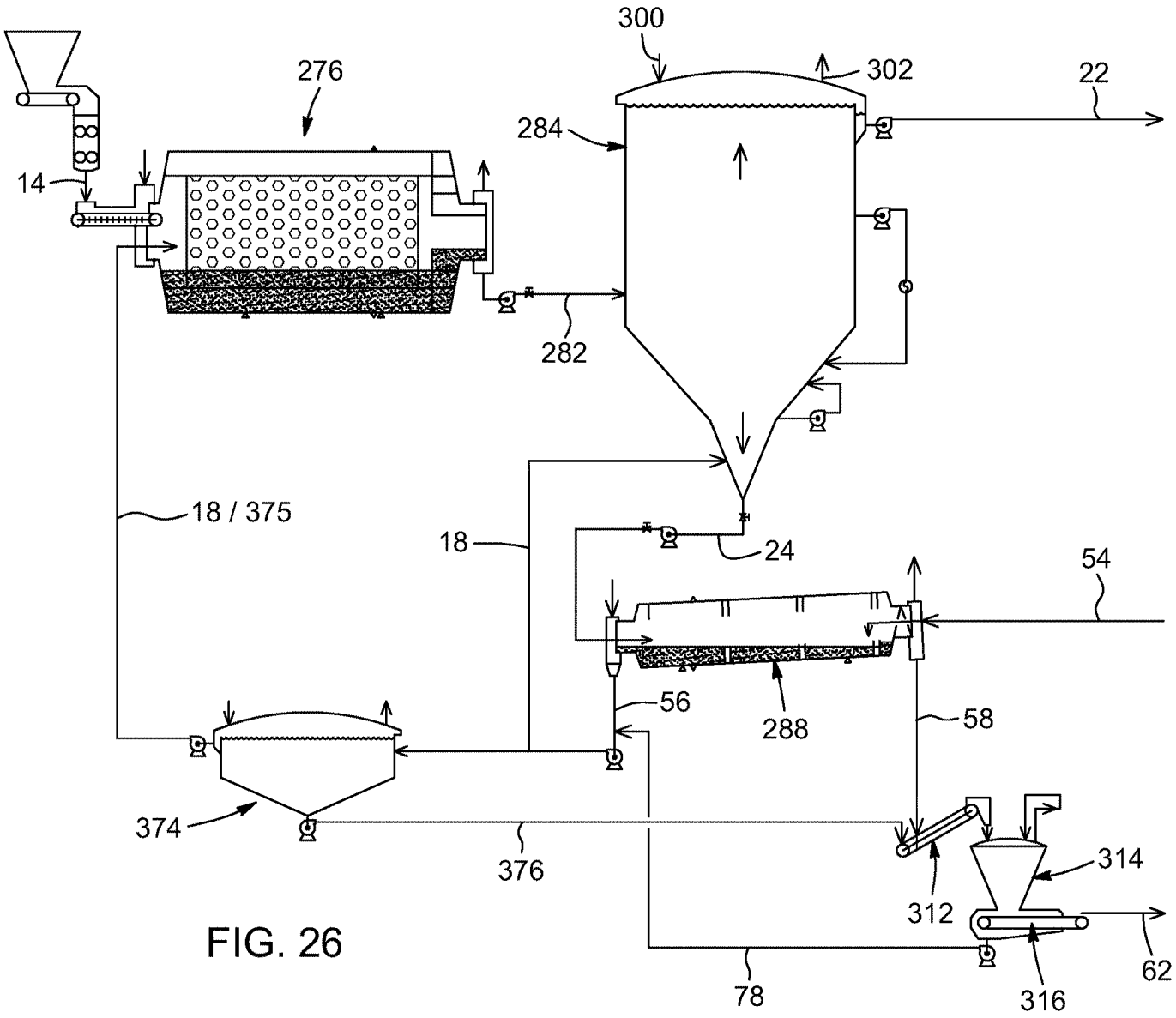
FIG. 26 is a schematic diagram of another example process for extracting bitumen from oil sands, including a digestion and extraction unit, a gravity settler type separation unit, counter-flow rotary drum washing unit, and a fines settling unit.

FIG. 26 shows an example system including a digestion and extraction unit 276 followed by a gravity settler type separation unit 284, a counter-flow rotary drum washing unit 288, and a fines settling unit 374.

Figure 32:
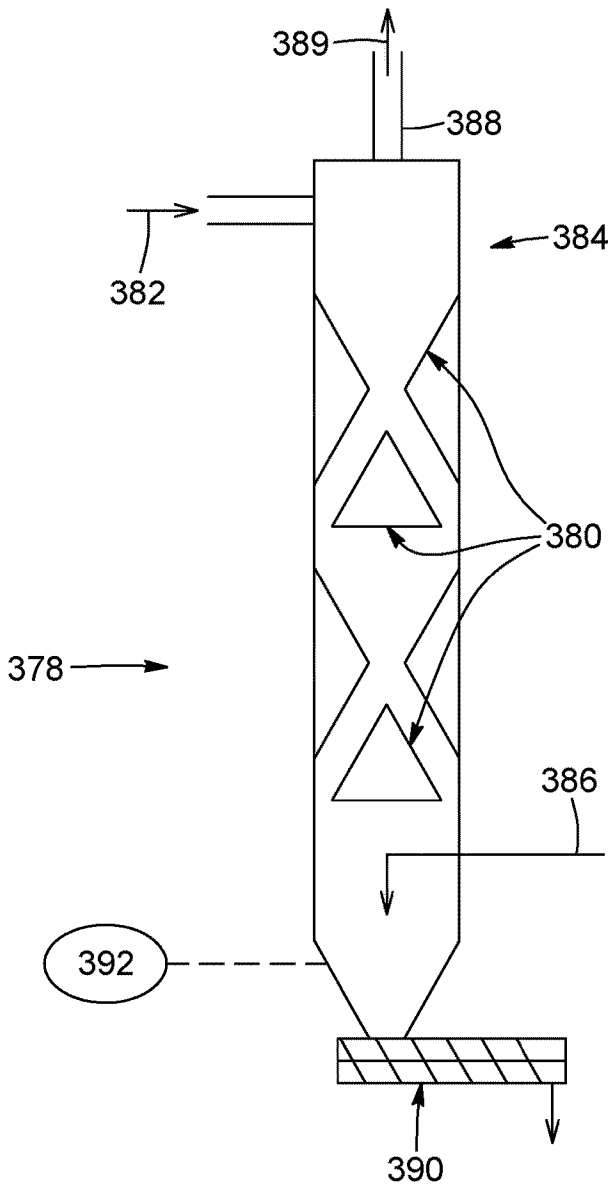
FIG. 32 is a side cut view schematic of a gravity wash column.

FIG. 32 shows an example system that can be referred to as a gravity separation and wash column 378 or a counter-flow gravity wash column. The column itself can be configured as a vertical static steel column containing internal components 380. The column 378 can operate fully flooded with a continuous inflow and outflow of fluids and a continuous discharge of washed solids. The operating pressure and temperature of the column 378 may be altered to achieve optimum viscosity conditions of the operating fluid and solvent(s). Capacity may be increased by increasing the diameter of the vessel and/or by installing multiple vessels in parallel.

Still referring to FIG. 32, the slurry infeed 382 to the column 378 is a pumped flow of digested and extracted slurry from the upstream process step (e.g., solbit plus all ore solids). The diameter of a top portion 384 of the column 378 may be selected to determine the coarse-fines split. The slurry in flow could be baffled or cyclonic depending upon desired PSD that is to be rejected and to prevent large particle carryover. The column 378 can be designed to be similar to a shed deck equipped process column where solids flow downward by gravity and the washing fluid continuously migrates upwards at low velocity. There can be multiple shed-decks 380 or other internals providing for multiple contact stages. Each shed deck can be designed to cause solids to avalanche off the edge in a distributed manner and drop through the fluid thereby achieving a mild wash. As solid material flows downwards, it is exposed to progressively cleaner solvent for each mild wash event. The column can be operated fully flooded with fluid; wash solvent 386 (e.g., pure solvent) is introduced at the bottom with the concentration gradient progressing to become solbit at top outlet 388. The upper stream can be solbit and slimes overflow 389. Solids collect at the bottom of the column 378 and are discharged by a solids discharge device 390 (e.g., screw illustrated) which can be controlled by solids level sensor 392. A commercial scale implementation of the wash column could incorporate shop fabricated column modules installed in a cluster to limit field fabrication.

Figure 33:
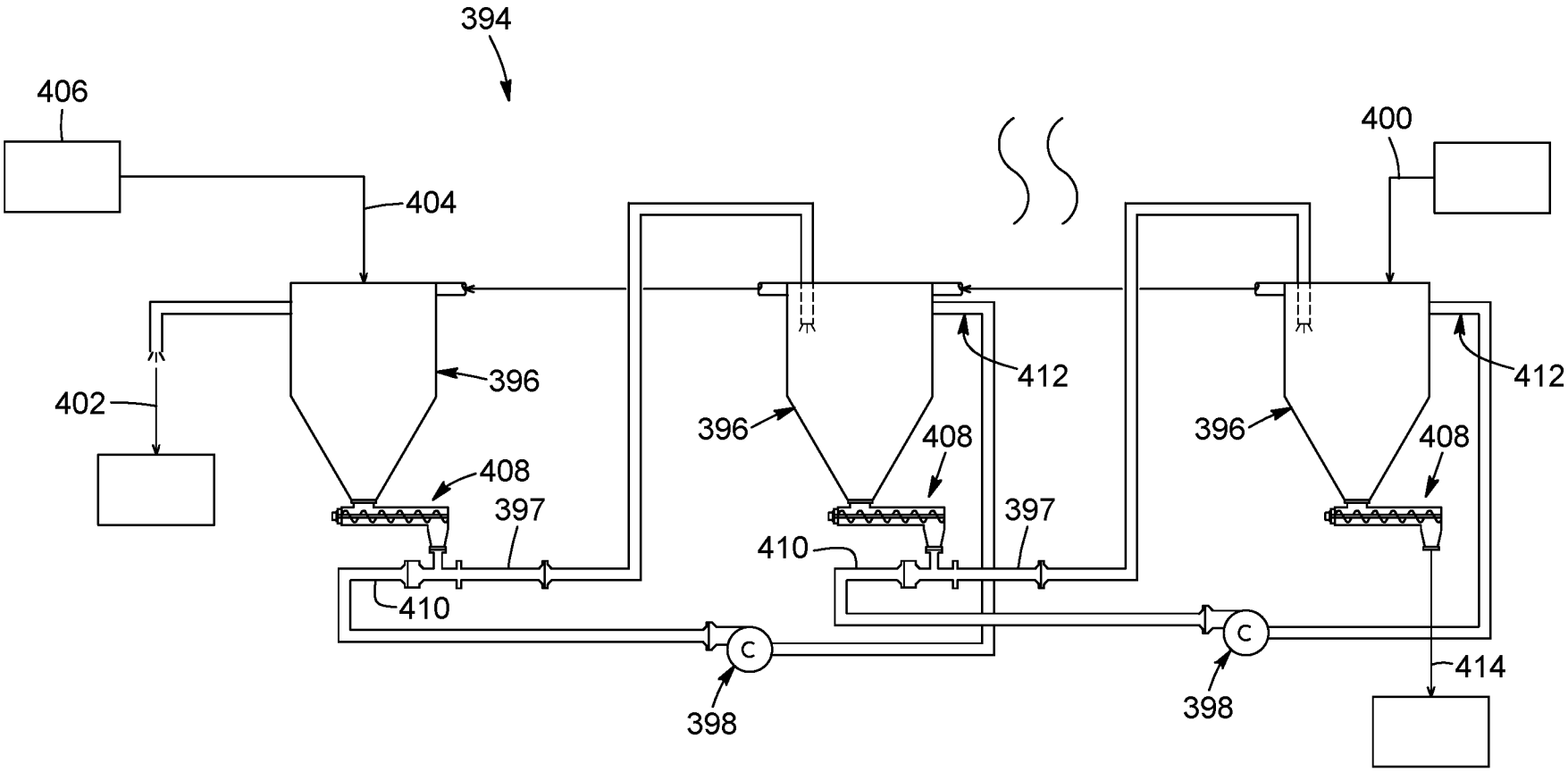
FIG. 33 is a block diagram of a process using a series of separator vessels and eductors to transport underflow from one vessel to another.

FIG. 33 shows an example system that can be referred to as an eductor washing system 394. The general scheme involves the transport of large volumes of solids between a series of atmospheric pressure process vessels (e.g., tanks A to C). For each wash stage, the incoming solids are intimately contacted with the fluid in that vessel. The general fluid flow through the wash sequence is countercurrent to the solids flow such that the level of bitumen in the fluid mixture reduces with each wash stage. The desired process implementation is continuous flow and the equipment configuration provides for secure and high integrity sealing of the system.

Thus, a non-aqueous extraction process for producing a bitumen product from oil sands material can include subjecting oil sands ore to digestion and extraction in the presence of a solvent to produce a solvent diluted bitumen slurry; and providing separation and washing using a counter-flow gravity wash column. The counter-flow gravity wash column can have one or more features as described herein.

Still referring to FIG. 33, the eductor washing system 394 includes a series of static, atmospheric pressure vessels 396. The system 394 operates fully flooded with a continuous inflow and outflow of both solids and fluids on each stage. Solids are washed and transported between each stage via the energy imparted by eductors 397; each eductor 396 is fed by a pump 398 drawing fluid from the respective downstream vessel. Fresh wash fluid 400 is introduced to the vessel furthest downstream (e.g., tank "n" in FIG. 33); fluid movement is counterflow to the solids with the product fluid stream 402 (solbit) discharging from the first vessel in the series.

The upstream-most vessel 396 (vessel A) receives digested and extracted oil sands slurry 404, which has been prepared in a separate upstream process step illustrated as 406 in FIG. 33. The fluidized solids from the upstream extraction operation are transported in to wash vessel A. Wash vessel A is relatively quiescent; the solids gravity settle in the vessel. The sol-bit (including entrained fines) flows off the top of the vessel as stream 402 and is supplied to downstream processing. A short tubular screw feeder type device 408 at the bottom of wash vessel A extracts the settled solids and delivers them in to the throat of the eductor 397.

A small sub-stream 410 of the motive fluid is introduced at the end of the screw to mobilize the solids in to the eductor throat. The eductor 397 conveys and lifts the solids in to wash vessel B which is also a relatively quiescent vessel. The solids again disengage from the fluid by gravity. The motive fluid for the educator 397 can be the free board liquid in wash vessel B, withdrawn via a conduit 412; fluid is delivered to the eductor 397 at the required rate and pressure by pump. These wash steps are repeated a number of times to achieve the requisite degree of washing. FIG. 33 illustrates three stages. The solids 414 discharge from the final vessel (wash vessel "n") in the series report to the drying process unit (not shown in FIG. 33).

Thus, a non-aqueous extraction process for producing a bitumen product from oil sands material can include subjecting oil sands ore to digestion and extraction in the present of a solvent to produce a solvent diluted bitumen slurry; and providing separation and washing using a series of vessels where an eductor is used to transport the underflow from each upstream vessel to an adjacent downstream vessel. The eductor can use a motive fluid that is also derived from the process. The motive fluid can include or consist of a stream obtained from a downstream vessel, e.g. the next downstream vessel. The motive fluid can be obtained from an upper zone of the vessel. The motive fluid can indeed have a higher solvent content compared to the underflow with which it combines in the eductor, thus facilitating washing effects in the eductor and the feed piping from the eductor to the downstream vessel.

The eductors can each be sized and configured to handle the underflows and motive fluids that are used. It is also noted that a similar principal can be used for other applications in the context of solvent based processing of oil sands by using eductors to transport slurries for extraction and washing, for example.

Solvent and Inerting Implementations

As mentioned above, the solvent used for non-aqueous extraction techniques described herein can have various advantageous properties to facilitate bitumen extraction as well as solvent recovery from the bitumen and mineral solids after extraction.

The solvent can be a low boiling point hydrocarbon solvent having high solubility for bitumen and allowing easy separation from the bitumen after extraction.

In one implementation, the solvent is cyclohexane, which has a boiling temperature of about 80° C., while bitumen has a boiling point of more than 100° C. Such a boiling point differential (e.g., 20° C. or more) can facilitate solvent recovery and separation via flashing or other vaporization methods.

In other implementations, the solvent can be aliphatic low boiling point hydrocarbons, such as $C_3$ to $C_7$ paraffins or various mixtures thereof, cycloalkanes, halogenated solvents, amines (e.g., diisopropylamine), or mixtures thereof. The solvent can also be a mixture of multiple solvent species and isomers (e.g., various isomers of hexane). The cycloalkanes can be selected from the group consisting of unsubstituted cycloalkanes, substituted cycloalkanes, and mixtures thereof. Non-limiting examples of unsubstituted cycloalkanes include cyclopentane, cyclohexane and cycloheptane. Non-limiting examples of substituted cycloalkanes include methylcyclopentane and methylcyclohexane. The halogenated solvents can be a chlorinated solvent. For example, the chlorinated solvent can be selected from the group consisting of dichloromethane, chloroform and mixtures thereof.

The solvent can also be selected to have other properties, such as a low affinity for sand and clay so that the solvent recovery from the tailings can be facilitated.

Inerting and sealing can be done using various techniques. Feed entry points can be sealed by a combination of skirtings on feeders and/or positive feed devices (e.g., flooded screw conveyors, lock hoppers), submerged feedwells, combined with purge and vent systems. Particular sealing systems will depend on the unit being sealed. Sealing of transition points between dynamic and static components (e.g., rotating drum and plenums) can be accomplished through large diameter mechanical seals, for example. Additional sealing and zone segregation can be done, if required, using other techniques.

Referring to FIG. 7 as an example, various units can be provided with purge inlets 300 and vapour outlets 302, which can be coupled to a central system. In addition, one or more steam feed lines 304 can be provided into certain units for providing heat as well as pressurization.

Counter-Current Flow Extractor Implementations

Referring to FIGS. 34 to 40, the integrated extraction unit can be an extractor including at least two conveyors in series each comprising rotating assemblies and being connected to one another for facilitating digestion, extraction and separation functionalities. The first upstream conveyor can be generally horizontal and be configured as a primary extraction assembly, while the second downstream conveyor can be upwardly inclined and configured as a classifier type unit with augers to separate and wash the solids. The primary extraction assembly can be configured to receive the ore and provide digestion and extraction as well as downstream transport of the solids via rotation of the rotating elements, and the classifier assembly can be configured to receive the solids from the primary extraction assembly and provide transport out of the solbit and back drainage of the solbit to produce a bitumen depleted tailings material. The integrated extraction unit can be configured for counter-current operation, whereby solids are conveyed in a first direction via the conveyors, and solvent is introduced into the extractor such that it flows in a second direction substantially opposite to the first direction, in order to remove bitumen from the solids. For example, the conveyors can be disposed in relation to one another in a manner such that an angle is defined there between, which would typically involve orienting the upstream conveyor horizontally and orienting the downstream conveyor with an upward incline. It is appreciated that having the downstream conveyor at an angle with respect to the upstream conveyor facilitates washing of the solids and gravity separation of the solbit from the solids.

Conveyors of this type of extractor can take various forms. For example, each conveyor can include a housing that accommodates at least one shaft from which mixing and advancing elements extend within the housing. For example, each conveyor can be an auger type conveyor, as previously described, or a rotating conveyor using a shaft having rods, baffles, blades, flights, and/or paddles (or a combination thereof) that are oriented and configured to provide mixing energy to the oil sands and to advance solids downstream. In some implementations, both the primary extraction assembly and the classifier assembly having respective rotating elements that rotate about the longitudinal axis of the assemblies in order to provide mixing energy and transport the solids. In one example that will be described in detail below, the primary extraction assembly includes at least one rotating element that rotates about its longitudinal axis and is configured as a "log washer" that includes a longitudinal shaft and elements extending outward from the shaft to provide high mixing energy while advancing the solids to facilitate digestion and extraction, while the classifier assembly includes at least one auger that receives the solids advanced by the log washer and transports the solids upward to enable back drainage and washing of the solids prior to discharge as a tailings material.

The rotating elements of the primary extraction assembly and the classifier assembly can have various designs, operations and corresponding functions. In some implementations, the rotating elements of the two assemblies have different designs to provide different functions. For example, the rotating elements of the primary extraction assembly can be configured and operated to provide relatively high mixing energy to the solid rich material while slowly advancing the material downstream; whereas the rotating elements of the classifier assembly provides lower mixing energy while advancing solids downstream. In such configurations, the rotating elements of the primary extraction assembly focus on mixing while the rotating elements of the classifier assembly focus on transport. Some further aspects of the rotating elements and other features of this extractor will be described further below.

Figure 34:
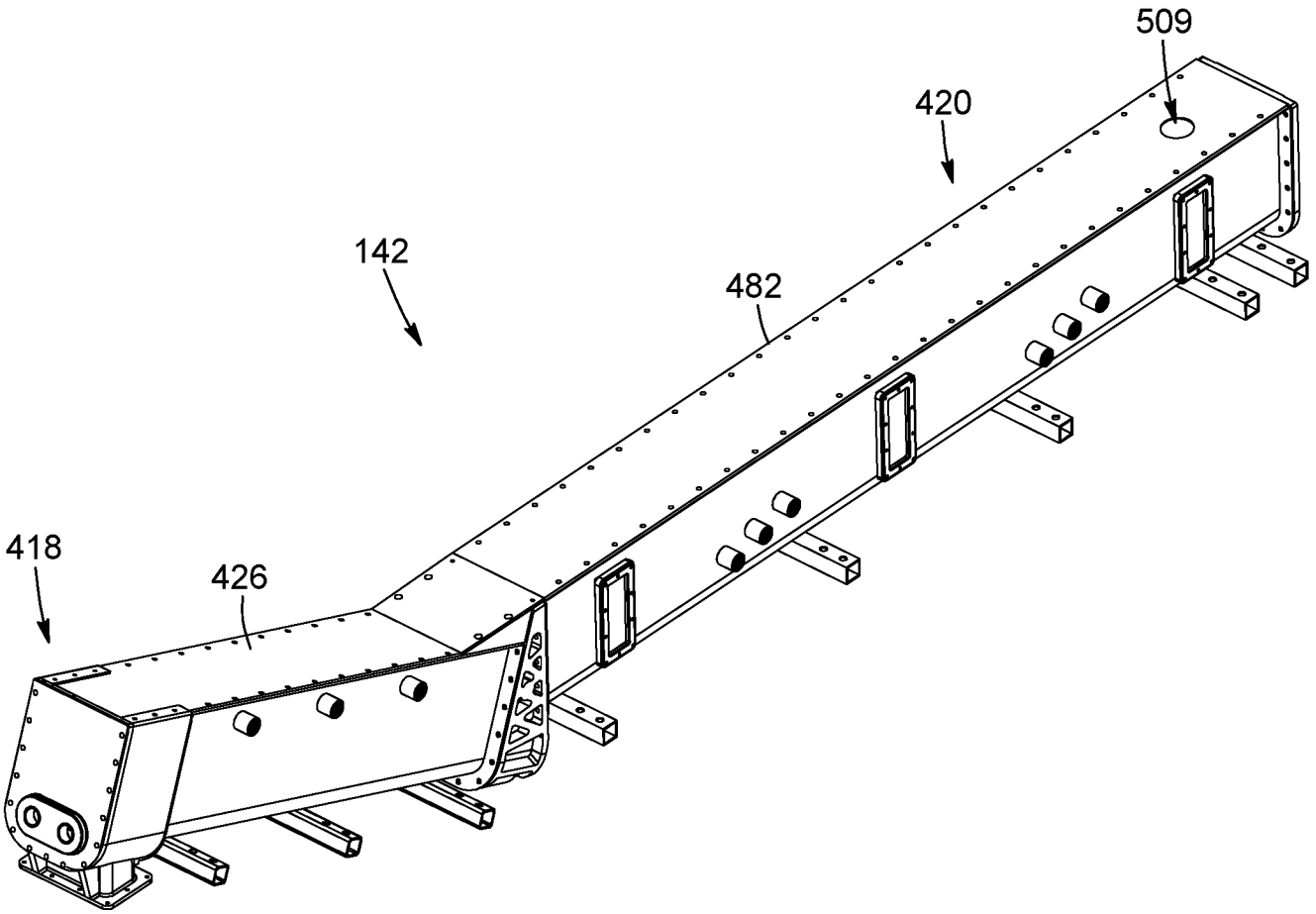
FIGS. 34 to 40 illustrate various parts of another optional implementation of an extractor which can include a primary extraction assembly having rotating elements that are arranged longitudinally along an extraction trough and which can be operated with counter-current movement of solbit and solids.
Figure 35:
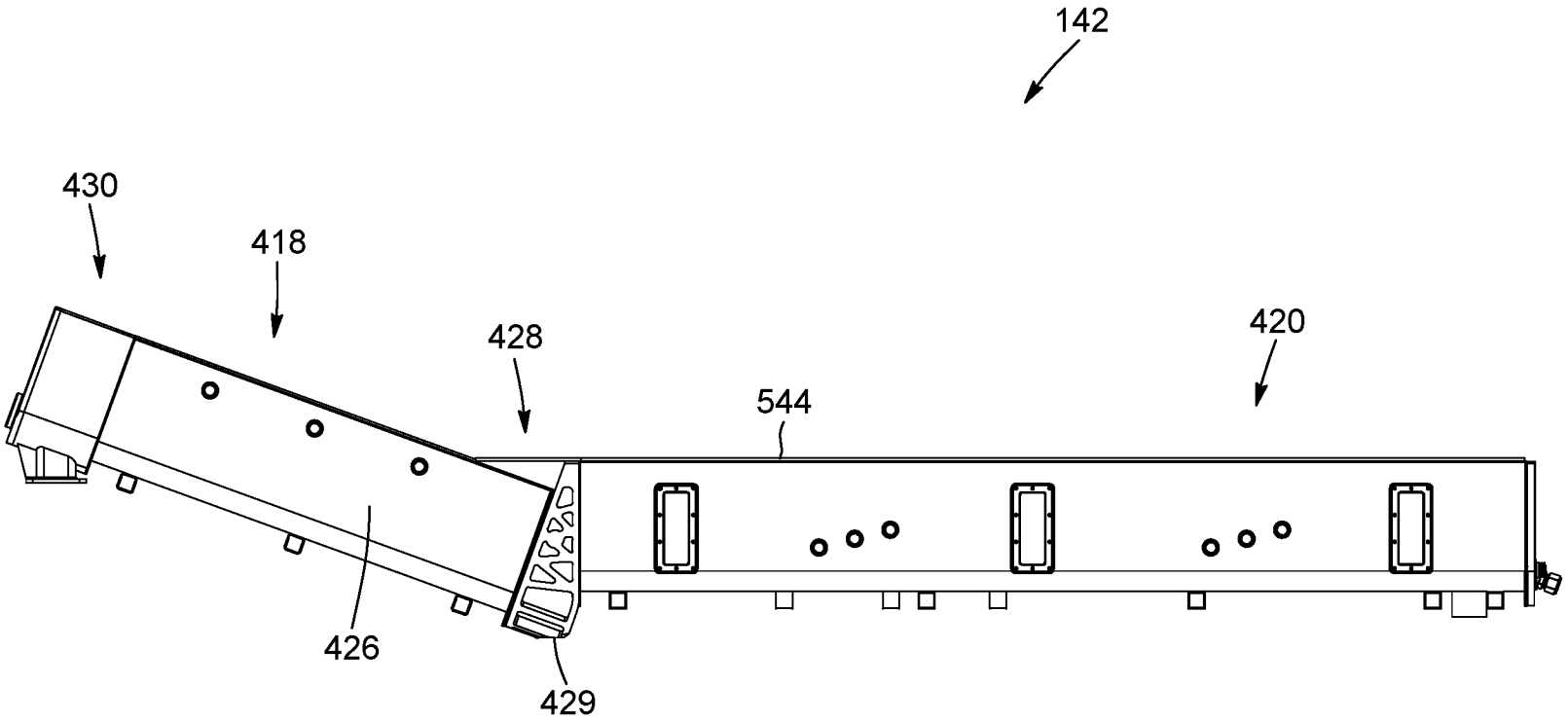

Referring to FIGS. 34 and 35, an implementation of an integrated extractor is shown where an upstream extraction section is coupled to a downstream inclined classifier section. The upstream extraction section can also be referred to as the primary extraction assembly, and the downstream classifier section can also be referred to as the classifier assembly. This extractor implementation can also be seen as a variant of the auger extractor 142 described further above, as the downstream inclined classifier section can in some implementations be configured as an auger assembly. The overall extractor 142 has digestion, extraction and separation functionality and can also enable some washing. The extractor includes a classifier assembly 418 connected to a primary extraction assembly 420. The oil sands are fed into the upstream end of the primary extraction assembly 420 while the solvent containing stream is fed into the classifier assembly 418 (e.g., at its downstream end) to enable counter-current movement of the oil sands and solids vis-à-vis the solvent and solbit liquid. The extractor further includes a motor assembly adapted to operate the rotating elements of the corresponding assemblies 418 and 420.

Referring to FIG. 35, the classifier assembly 418 includes a classifier trough 426 having a lower upstream end 428 connected to the primary extraction assembly 420 via a transition 429, and an upper downstream end 430 extending away from the primary extraction assembly 420.

Figure 36:
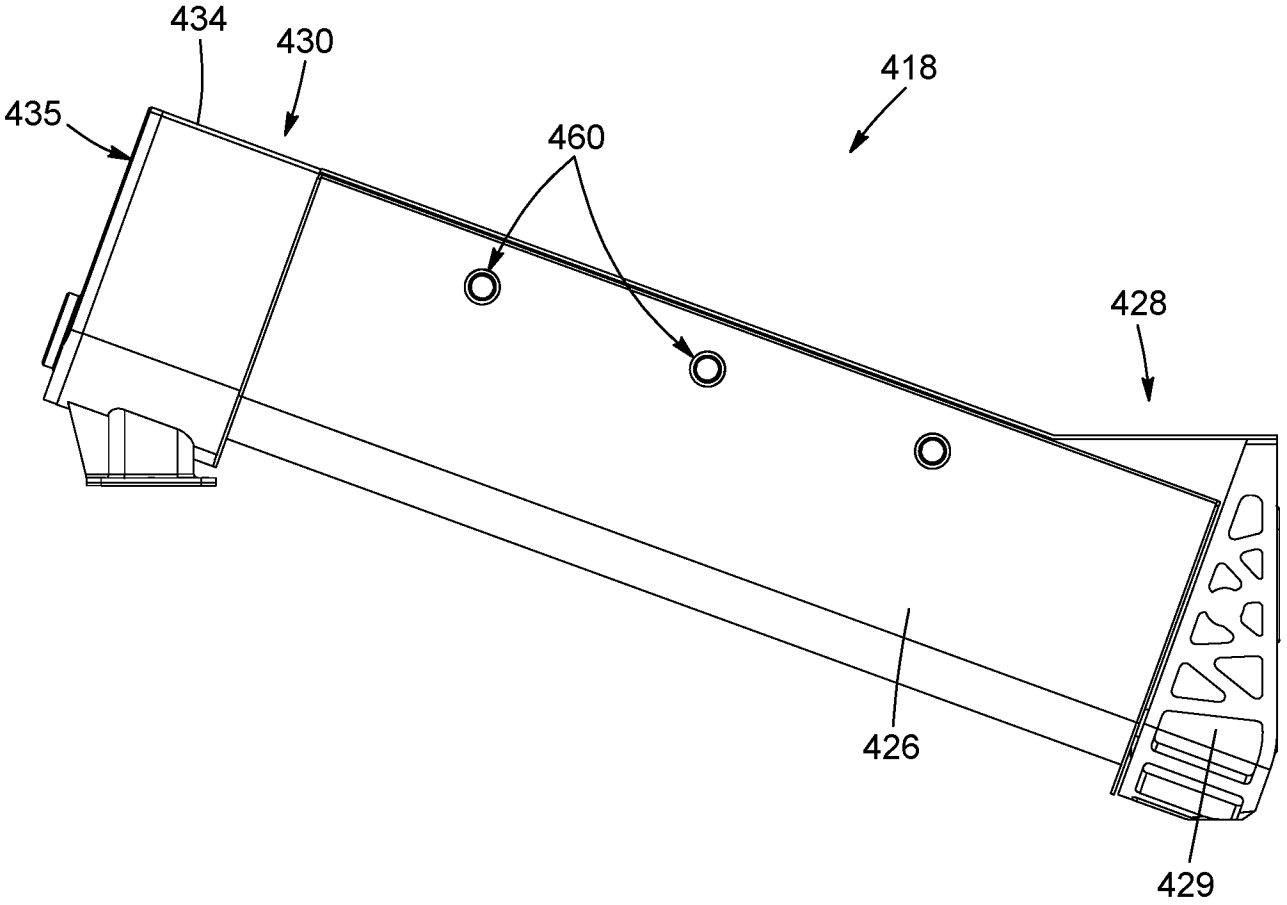
Figure 37:
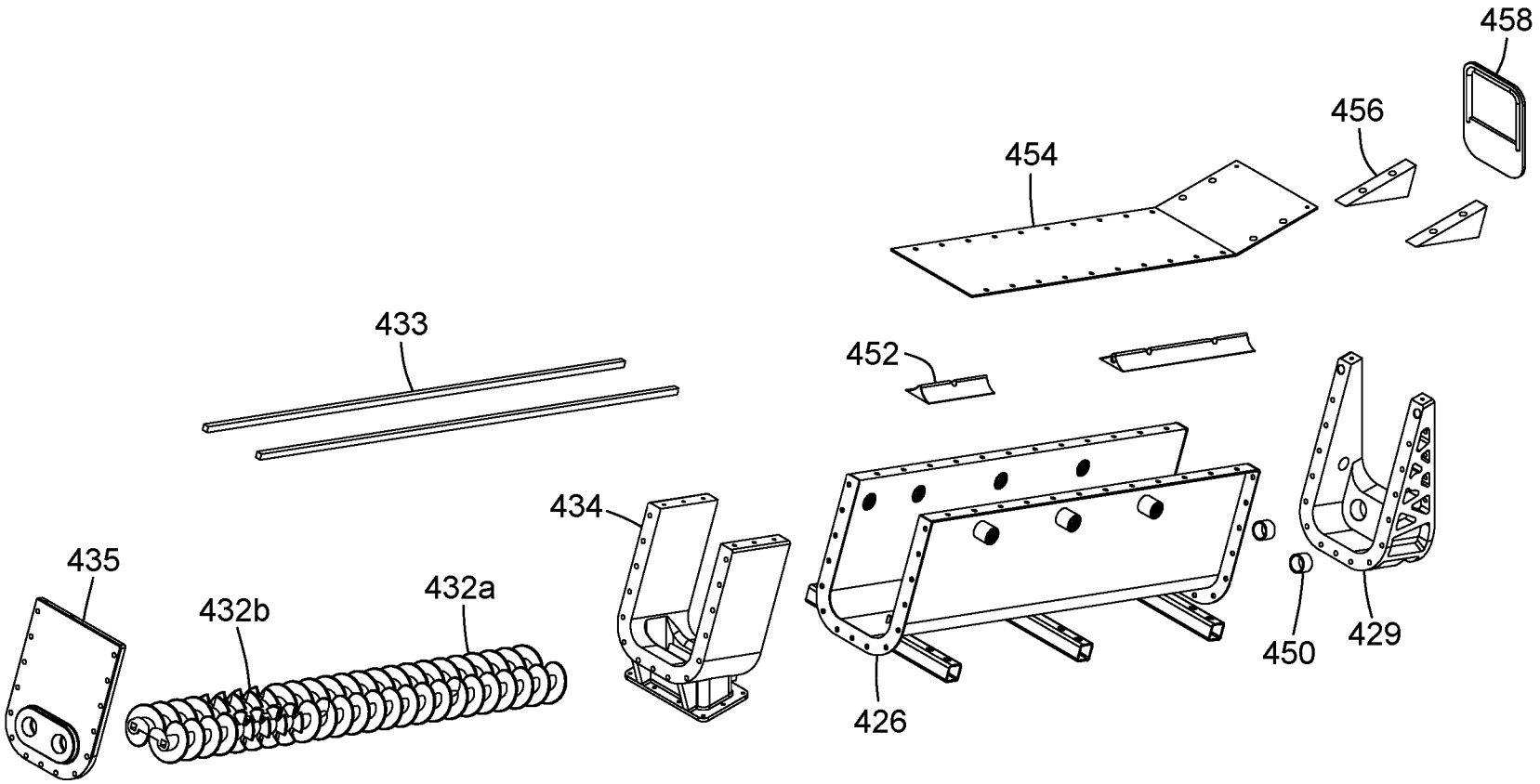

With reference to FIGS. 36 and 37, the classifier assembly 418 has a conveyance assembly for conveying material from the transition zone 429 towards the downstream end 430. The conveyance assembly may be at least one auger 432, located within and extending along a length of the classifier trough 426. In the illustrated implementation, the conveyance assembly includes a dual-auger assembly including two side-by-side augers 432 operable to mix the oil sands ore with the solvent and convey the extracted solids in the downstream direction as solvent flows in the opposite direction and collects bitumen from the solids. The lower upstream end 428 of the classifier assembly 418 engages oil sands solids discharged from the primary extraction assembly 420, and, via rotation of the augers 432, the oil sands solids is transported toward the upper downstream end 430 while separation and washing are facilitated by the displacement and mixing of the solids with the solvent within the classifier assembly 418. The countercurrent flow of the solids and extracted bitumen/solvent mixture promotes washing of the solids within the classifier assembly 418. It is noted that, in general, the extractor 142 including the primary extraction assembly and the classifier assembly can be configured and operated for countercurrent movement of the solids and liquids, such that extraction, separation and washing occurs in a single integrated vessel instead of two or more separate vessels for respective operations.

Referring back to FIGS. 34 and 35, the upstream end 428 of the classifier assembly 418 is in fluid communication with the primary extraction assembly 420, and the solids and upstream ends of the augers will also be below a liquid level in the troughs. As the solids are lifted upward and travel downstream within the classifier assembly 418, the solids will eventually rise above the liquid level of the solbit, and solvent added further downstream will drain by gravity to further wash bitumen from the solids. There is therefore a submerged section of the classifier assembly as well as a non-submerged section. The angle of the classifier section as well as its length can be provided to enable a desired length or function of this section.

Referring to FIG. 37, the classifier assembly 418 can have various possible designs. In one implementation, the classifier assembly includes at least one rotating element that rotates about a longitudinal axis of the classifier trough. For example, the rotating element can be an auger-type element. The auger 432 can include a single auger, dual augers arranged side-by-side, or other configurations of multiple augers arranged within a correspondingly constructed trough. In the illustrated implementation, the auger includes a dual-auger assembly, whereby each auger 432 has a corresponding shaft 433 as well as a blade or flightings helically mounted around the corresponding shaft. It is appreciated that, in a dual auger configuration, the auger flights can be designed to promote mineral solids displacement downstream as well as solbit drainage upstream (i.e., toward the primary extraction assembly). For example, the augers 432 can include conveying auger sections 432*a* and one or more drainage auger sections 432*b* (e.g., pug auger sections) shaped and configured to promote solbit drainage. It should nevertheless be noted that the rotating elements of the classifier assembly can have various features and constructions for conveying the solids while allowing solvent addition and drainage counter-currently with respect to the solids.

In FIG. 37, there is a main upstream section of the dual augers that has full helical flights, followed by a shorter section where the flights are cut to promote solbit drainage, followed by an end section where the flights are again configured as full helical flights. The drainage auger sections 432*b* can have flights which are shaped and sized such that conveyance is somewhat hindered in order to promote in-place mixing, along with solbit drainage. The drainage auger sections 432*b* can be located in the non-submerged section of the classifier assembly 418. It should be noted that there are various configurations of the flights, including full and cut helical sections and different sizes and arrangements, that are possible along the length of the shafts in the classifier assembly 418. In some implementations, the drainage auger sections 432*b* are positioned in the classifier assembly 418 at locations where additional solvent is introduced, although other configurations are possible. It is also possible to include discrete projections extending from the shafts of the rotating elements rather than continuous flights, and such discrete projections could have various designs to enable the desired mixing, transport and washing functions along different segments of the shaft.

Referring to FIG. 37, the classifier trough 426 has a tailings discharge main 434 (i.e., an outlet) at the downstream end 430 to allow evacuation of tailings material, and a back cap 435 connected to the discharge main 434 for closing off the trough 426 and promote evacuation of tailings material through the discharge main 434. The back cap 435 can also be adapted to act as a shaft guide, whereby the shafts 433 of the classifier assembly 418 are secured to the back cap 435, for example, via bearings (not shown). Similarly, the shafts 433 can be further connected to the transition 429 via a pair of bearings 450. The classifier assembly 418 further includes a motor system which can be mounted at the downstream end to drive rotation of the two shafts 433 of the augers within the trough 426. Of course, the motor system can be arranged in the appropriate location depending on the position and structure of the rotating elements of the classifier assembly.

As seen in FIGS. 34 and 35, the classifier assembly 418 can be oriented at an oblique angle to facilitate back drainage of the solbit. The angle can be provided along with other parameters (e.g., auger design, sizing and spacing; speed of rotation; and auger conveyor length) in order to enable desired extraction, separation or washing characteristics as well as extractor performance. In some implementations, the oblique angle can be between about 15 degrees and about 45 degrees, or about 20 degrees and about 35 degrees. The angle can be adjustable, for example by having an adjustment assembly that can raise or lower the downstream end of the classifier assembly 418. The angle adjustment can be done during operation or in between operations during downtime. Alternatively, the extractor can be built so that the angle remains fixed.

Other parameters can be adjusted and coordinated to enable desired extractor performance. For example, when oil sands ore is fed to the extractor at a rate between about 50 kg/h and about 350 kg/h, or between 100 kg/h and 250 kg/h; solvent can be fed at a rate between about 15 kg/h and about 150 kg/h or between about 30 kg/h and about 100 kg/h. Depending on the sizing and design of the extractor, increased ore feed rates can be accompanied by increased solvent feed rates to maintain the desired solvent-to-ore ratio. In addition, if such an extractor were provided with higher feed rates of solids and solvent, the extractor may benefit from increased rotational speed of the rotating elements 432 of the classifier assembly and/or of the primary extraction assembly. For such an example extractor, rotation speeds of the classifier augers 432 can vary between about 5 rpm and about 40 rpm, or between 10 rpm and 25 rpm; while the rotational speed of the log washers in the primary extraction assembly can vary between about 50 rpm and 210 rpm or about 100 rpm and 150 rpm. It is noted that the ranges of operating parameters mentioned above relate to an example pilot unit, and that modifications to the extractor size and design may result in changes to the operating parameters. For example, larger scale extractors would of course have higher input feed rates for the ore and solvent, and could also operate at lower rotational speeds for the log washers and augers or other rotating elements, depending on the size of the unit and scale-up considerations. Various other modifications can also be made to larger scale extractors.

Regarding the design of the classifier trough 426, in the illustrated implementation, the trough can include, among other components, a center ridge 452 provided along a bottom surface thereof; a top cover plate 454; transition fillers 456; and a weir 458. The center ridge 452 can be used to fill gaps along the classifier trough 426 (e.g., between the shafts 433 and augers 432) to at least partially avoid accumulation and aging of the oil sands ore. The weir 458 can be configured to increase residence time of the oil sands ore in the extractor trough by reducing the area through which the ore can travel between the extractor and classifier troughs. It is noted that such a center ridge and weir can be absent in various implementations of the unit.

It should be understood that solvent (e.g., fresh solvent or in the form of solbit) can be introduced into the classifier assembly 418 to promote extraction, separation and washing of bitumen from the solids. In some implementations, solvent-containing streams can be introduced at various solvent inlets 460 (e.g., as shown in FIG. 36) provided at various locations along the extractor 142. The extractor is operated so that the oil sands material proximate the transition 429 between the classifier assembly 418 and primary extraction assembly 420 is immersed in solbit. As the oil sands material is transported and churned by the augers 432 away from the lower upstream end 428, the mineral solids are generally forced toward the upper downstream end 430 while solbit flows counter-currently toward the lower upstream end 428 and collects bitumen from the mineral solids. Solvent introduced proximate to the upper downstream end 430 can be of higher solvent content to promote cleaning of residual bitumen in the solids fraction, while solvent introduced at other locations can be a solbit stream having higher bitumen content, for example. Solvent introduced at the various solvent inlets 460 can initiate the countercurrent wash process as solvent flows generally downwardly, while solids containing bitumen are discharged from the primary extraction assembly into the classifier assembly 418 via the transition 429. In general, when different solbit streams are fed into different sections of the extractor, the composition of the solbit feed streams should be different (e.g., lower bitumen concentration) from the composition of the solbit liquid within the extractor to enhance efficiencies. In other words, solbit compositions should be provided to promote a compositional difference that enhances mass transfer of bitumen into the sobit.

The tailings material discharged from the upper downstream end 430 is solids rich and bitumen depleted while containing some residual bitumen and solvent. This solvent containing tailings material may not be a pumpable material as it has relatively high solids content (e.g., a dense phase, a fluid-saturated solid, or a cake-like material) such that it can be subjected to dry materials handling and transport techniques. Alternatively, the tailings stream may be re-fluidized using an intermediate process fluid to facilitate hydraulic transport. In the illustrated implementation, and with specific reference to FIG. 37, the discharge main 434 can be part of a discharge assembly which allows tailings, among other components, to exit the classifier assembly 418 proximate the upper downstream end 430.

Figure 38:
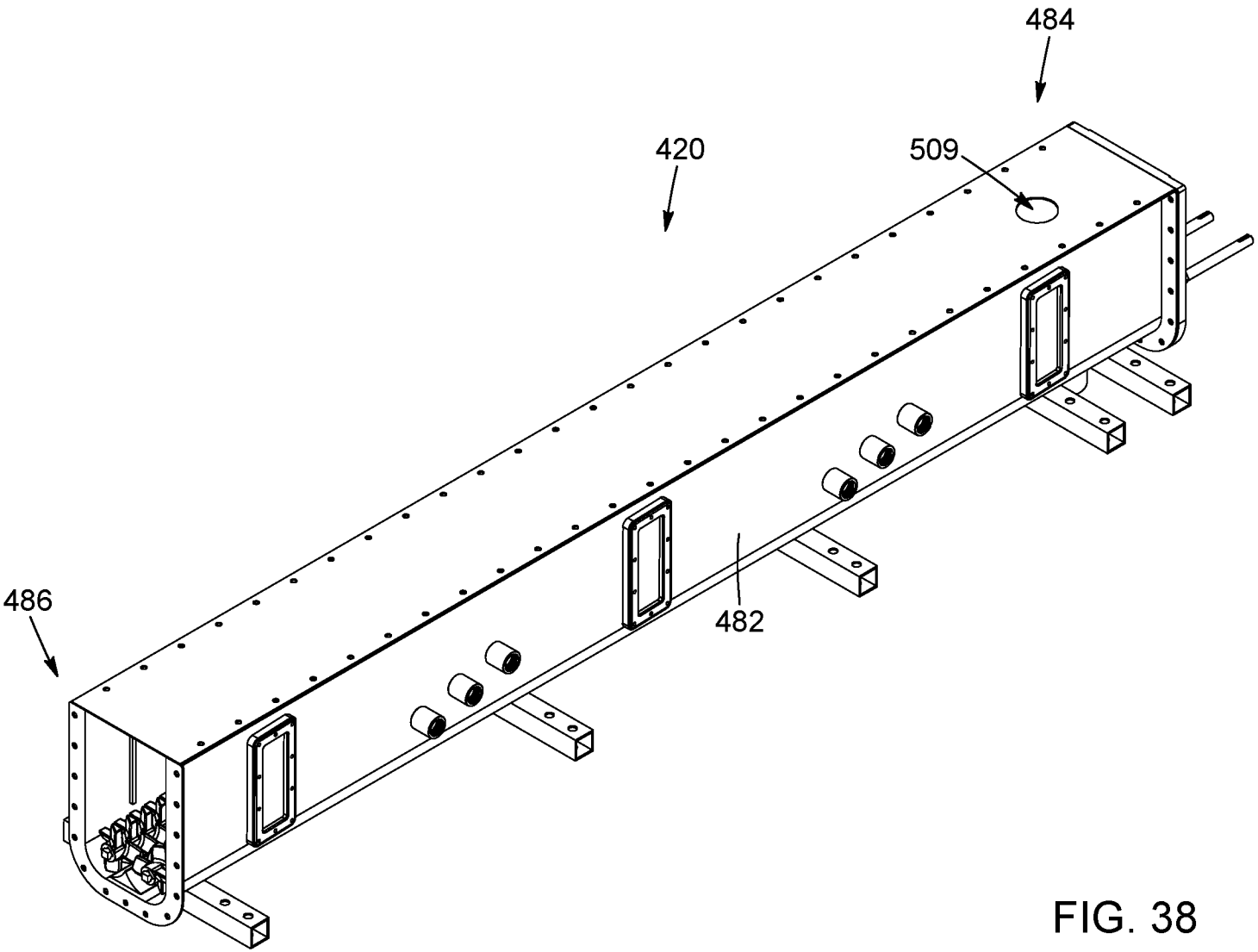
Figure 39:
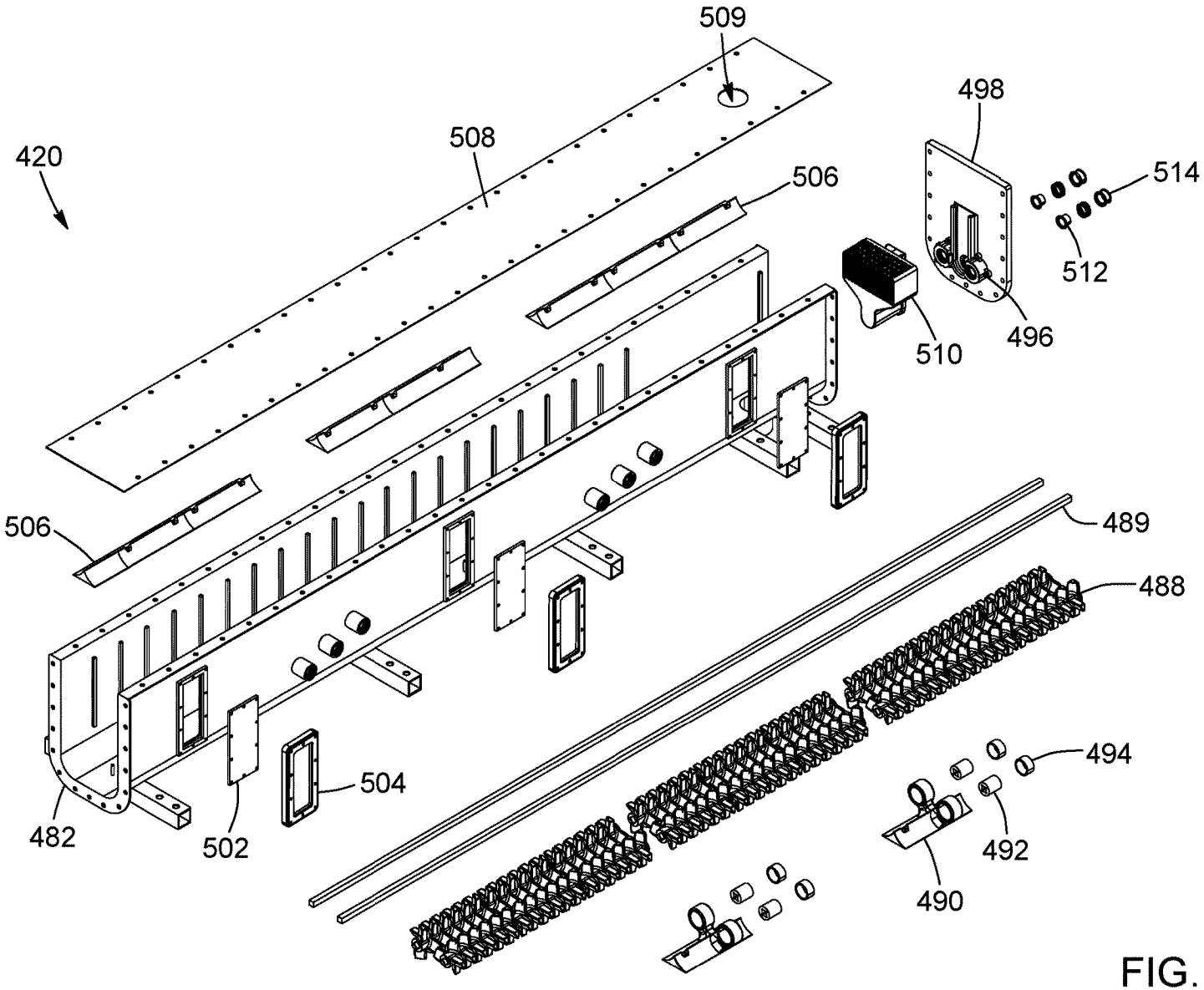
Figure 40:
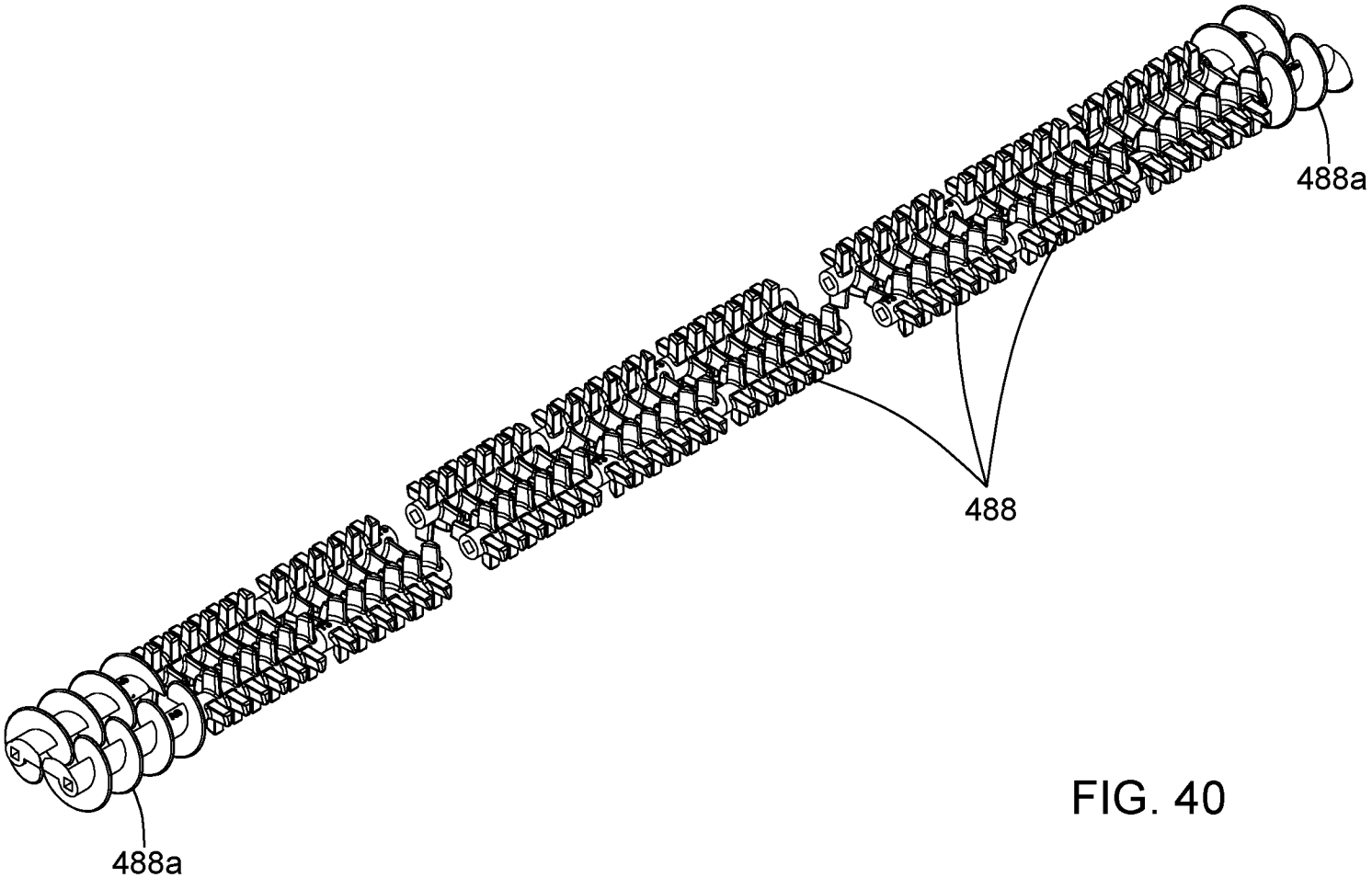

Referring to FIGS. 38 to 40, in addition to FIGS. 34 and 35, the primary extraction assembly 420 will be described in more detail. The primary extraction assembly 420 is the upstream section of the extractor and receives the sized oil sands at its upstream end. The primary extraction assembly 420 also produces the solvent diluted bitumen stream that is subjected to further processing in downstream unit operations. It is noted that the extractor would typically receive a crushed sized oil sands ore at the feed material, but it could also receive oils sands material in other forms such as a slurry that includes ore and solvent previously mixed together.

Referring to FIG. 39, the primary extraction assembly 420 includes an extractor trough 482 having an upstream end 484 and a downstream end 486 connected to the classifier assembly 418 via the transition 429. The oil sands ore material can be fed into the primary extraction assembly 420 from above and proximate the upstream end 484 via a feedwell that is fed ore from a sized ore hopper. However, it is appreciated that other locations for feeding oil sands ore into the primary extraction assembly 420 are possible. An ore inlet is therefore provided and is in fluid communication with the feedwell. The ore inlet can be provided as an opening in the top of the primary extraction assembly. The oil sands solids material is submerged in the solbit at the upstream end of the primary extraction assembly 420 and is subjected to digestion, mixing and extraction upon entering the extractor.

The oil sands are conveyed along the extractor trough 482 via action of at least one rotating element 488, which can be configured extending along the extractor trough 482. In some implementations, each rotating element 488 includes a shaft and a plurality of projections extending radially outward therefrom. The projections may be of various types, including baffles, paddles, blades, rods, flights, augers, and/or other types of projections that are discrete or continuous. In some implementations, the rotating element is configured as a log washer that includes a shaft and at least some discrete projections. The shaft of each rotating element can also have various designs, having a small or large diameter, being configured for connection of certain projections thereto, being constructed to enable mounting within the extractor trough in a certain manner and to connect with motors, and so on. During this conveyance, the rotating element 488 provides digestion of the oil sands while facilitating extraction of the bitumen which forms part of the solbit moving counter-currently and also advancing the solids downstream. The region above the rotating element 488 enables separation of the solbit from the solids, and the solbit can be withdrawn, e.g., once it overflows over the weir at the upstream end of extractor trough 482.

As seen in FIGS. 39 and 40, the primary extraction assembly 420 can have various possible design features. For example, the rotating element 488 can be a single shaft configuration, a dual shaft configuration arranged side-by-side (as illustrated), or other configurations of multiple shaft rotating elements 488 arranged within a correspondingly constructed extractor trough. In the illustrated implementation, a dual shaft primary extraction assembly 420 is provided, where each rotating element 488 has a corresponding shaft 489 as well as baffles, paddles, blades, rods, flights, augers, and/or other types of projections mounted around the corresponding shaft. In the illustrated implementation, the dual rotating elements can be referred to as a pair of log washers.

It is appreciated that, in a dual shaft configuration, the projections on the rotating element 488 are designed to impart mixing energy to the oil sands and facilitate digestion and extraction while also conveying or advancing the solids downstream along the extractor trough 482. The projections can therefore be angled or shaped to impart some force in the downstream direction. The projections can be designed and configured to provide a desired combination of mixing and advancing.

In some implementations, and as seen in FIG. 40, the rotating element 488 can include auger sections 488*a*, e.g., provided at one or both end of the shafts 489. These auger sections can be provided to prevent ore accumulation in these regions. Alternatively, the entire length of the rotating elements 488 can be equipped with a similar or an identical pattern of projections. Auger sections can be provided at one or more locations at various places along the shafts.

It is also possible to equip the rotating elements 488 with a mixed complement of different projections along the length of the shafts, to provide certain functionalities (e.g., advancing, mixing energy, etc.) at certain points along the extractor trough 482.

It should be noted that the rotating elements 488 can have various features that can be designed and implemented depending on certain functions that may be desired in different parts of the primary extraction assembly. For instance, the rotating elements 488 can have various combinations of discrete and continuous projections extending from the shafts. The rotating elements 488 can also be divided into shaft segments having different lengths and/or arrangements. Each shaft segment can have a different arrangement of projections, in terms of their type, structure, spacing, length, orientation, angle, width, distribution, and so on. There may be up to "n" segments that make up the rotating element 488. Each segment can be designed to provide or promote desired functions. For instance, a segment can be designed to promote transportation of the solids with lower mixing energy (e.g., using an auger type structure), while another segment can be designed to promote digestion and extraction (e.g., using paddles that are designed to provide high mixing energy to the solids). Each segment along the shafts of the rotating element 488 can therefore be tailored in various ways to provide desired effects. The segments can be of the same or different length. When two side-by-side rotating elements 488 are used, they can be substantially the same in terms of their segments or they can be different. Alternatively, the rotating elements 488 can also be provided so that the projections are the same along the entire length of the shaft and are provided in a single consistent arrangement.

In some implementations, the rotating elements 488 can be configured in parallel relation to each other and can be operated to rotate in opposite directions with respect to one another during regular operation such that they produce an upward movement in the center of the extractor trough 482 and thus a downward movement at the outer edges of the trough. The shafts of the rotating elements 488 can also be configured to rotate at substantially the same speed (e.g., between about 50 and 210 rpms) to promote central conveyance, although it is appreciated that other configurations and operating parameters are possible. For example, the rotating elements 488 can be made to rotate in the same direction, or in opposite directions but producing a downward movement in the center of the trough. It should also be noted that the direction of rotation of the rotating elements 488 can be reversed during operation, for example, if material, such as a rock, becomes stuck between the projections of a given rotating element 488. Moreover, the projections of the rotating element 488 can be shaped and sized so as to interlock, or overlap each other in a central region of the extractor trough. However, in a preferred implementation, the projections are spaced from each other in the central region which can promote countercurrent displacement of liquids and solids within the extractor trough.

Referring still to FIG. 39, the rotating element shafts 489 can be supported or stabilised within the extractor trough 482 via a support assembly. For example, the support assembly can include at least one support base 490 having inner and outer bearings 492,494 for operatively connecting the shafts 489 thereto. Alternatively, the shafts 489 can span the entire length of the extractor trough 482, and be simply connected at either end thereof. It should be understood that the shafts 489 are further operatively connected to motors. The motors can be adapted to rotate the shafts independently of each other in a joint or coordinated manner. The motors can be fixed together on a common frame or independently. Various motor constructions and implementations are possible. The motors can be controllable to provide variable rotation speeds and/or torques depending on certain variables of the process.

The extractor trough 482 can have a fluid outlet 496 defined in a trough end plate 489 positioned at an upstream end 484 of the primary extraction assembly 420. The assembly can further include one or more outlet tubings connected to the outlet 496 for allowing the solvent diluted bitumen stream (solbit) to exit the extractor trough 482 and prevent overflowing, for example. The outlet can be located in an end section of the trough that is upstream of a weir 510 over which the solbit flows. The weir 510 can be configured allowing the shafts to pass through its lower section. In some cases, no overflow weir may be required. Within the extractor trough 482, solvent diluted bitumen that has been extracted from the oil sands material separates upstream from the solids which are then advanced downstream. The solvent diluted bitumen forms a liquid zone above a lower solids zone, and a stream of solvent diluted bitumen can be withdrawn via the outlet 496.

In some implementations, a portion of the solvent diluted bitumen stream withdrawn from the extractor trough 482 can be recycled to a different part of the extractor 142, e.g., to the classifier assembly 418 or back to the extractor trough 482, via a recycle line. Prior to reintroducing the solvent diluted bitumen into the extractor 142, it can be mixed with another solvent stream which may be fresh solvent, solvent-rich solbit from a downstream unit, or a combination thereof. In some implementations, the recycle line can be heated in order to adjust the temperature of at least one of the troughs of the extractor, and/or can be adapted to feed solbit at a rate between about 0 (i.e., no recycling) and about 15 kg/h, or between 0 and 10% of solvent feed flow, for example. It should also be noted that a recycle line can run from a point in the classifier trough in order to reintroduce solvent (or solbit) back into the classifier trough for increasing the liquid flow within the extractor. It should be understood that the use of recycle lines can be used to control the solvent-to-bitumen ratio within the extractor, the liquid-to-solids ratio, and/or other conditions (e.g., within the classifier 418, the primary extraction assembly 420, or both).

It is also noted that there may be one or more solbit heating arrangements that include a solbit removal line that removes some solbit from the pool at any point along the primary extraction assembly 420, a heater connected to the solbit removal line to heat the solbit, and a solbit return line for returning the heated solbit back into the primary extraction assembly 420. The return line can be positioned such that its discharge is in the solids region which could provide additional mixing. The return line can also be positioned such that its discharge port can be at the same or different (upstream or downstream) horizontal position compared to the outlet port of the solbit removal line. The heater could be an indirect heat exchanger or a direct heater. The heating arrangement could be operated in cold environments (e.g., winter operation) to heat the extractor. Alternative methods to maintain the temperature of the extractor could include a steam jacket, direct heating, and/or indirect heating of the solbit.

Referring to FIG. 39, the primary extraction assembly 420 can further include the following components, among others: windows 502 and window frames 504; one or more centre ridges 506 provided along the bottom surface of the extractor trough 482; a top cover plate 508 that includes the ore inlet 509; a weir assembly 510; rotary shaft seals 512; and pump shaft seals 514. The primary extraction assembly 420 can include sample ports along its length to obtain samples of solbit in order to test the composition for process control purposes, for example. The windows 502 can be provided for visual inspection within the extractor and/or to facilitate access to certain parts of the trough. It should be noted that the particular construction of the primary extraction assembly 420 can vary and may have a number of differences compared to the example illustrated in FIG. 39.

Referring briefly to FIG. 34, the illustrated implementation of the extractor 142 has been constructed and operated as part of a pilot process. It should be noted, however, that this type of extractor 142 could be integrated within an overall process in which various other units would be present, e.g., hoppers, conveyors, separators, washing unit, dryer, etc. Furthermore, it is understood that the extractor can be coupled to a pipeline to supply the solvent diluted tailings to the next processing stage or to a pump box. More details will be provided further below with respect to potential integration of the extractor illustrated in FIGS. 34 and 35 into an overall process.

In some implementations, and referring broadly to FIGS. 34 to 40, the extractor 142 can be constructed to include a sealed envelope 544, which can include walls of the classifier assembly 418 (i.e., walls of the classifier trough 426) and walls of the primary extraction assembly 420 (i.e., walls of the extractor trough 482) with appropriate seals. The walls include the side, bottom, top and ends of the extractor. The envelope 544 ensures that solvent vapour is retained within its interior, and also enables controlling the pressure within the units of the extractor (i.e., enables control of a safe atmosphere). In this regard, providing the classifier and primary extraction assemblies with fixed stationary troughs and respective rotating elements, such as augers or log washers, enables the troughs to generally form the sealed envelope 544.

In operation, the oil sands material (e.g., sized ore) is fed to an upstream end of the extractor trough 482 via a feedwell or inlet so as to form a solid rich zone in the lower part of the extractor trough. Solvent (e.g., fresh solvent and/or a solvent rich solbit stream) is supplied to a non-submerged part (e.g., downstream end) of the classifier trough 426 and flows upstream as it dissolves bitumen and becomes progressively more enriched in bitumen as it flows upstream. The sizing of the troughs and the feed rates of the oil sands and the solvent are provided so that the solbit in the extractor trough submerges all of the solids, thereby forming a lower region that is rich in solids and an upper region that is rich in liquid. The rotating elements 488 operate within the solids rich region, with portions of the projections extending above the solids/liquid interface in order to promote mixing of the two phases together such that substantially the entire content of the extractor trough becomes a light slurry. In addition, it should be noted that the pair of rotating elements 488 can be spaced relative to each other such that the projections overlap in a central region, do not overlap and are thus spaced apart or arrive at substantially the same central location. The lower part of the classifier trough 426 and the transition 429 are also filled with enough solbit to submerge the solids, but the upper part of the classifier trough is above the liquid level to facilitate back drainage. The liquid level can be monitored within the troughs and the operating parameters can be adjusted to control a desired liquid level and/or desired features of the solids and liquid rich regions.

The extractor can be operated under various conditions. For example, the primary extraction assembly can be operated under conditions such that the solids rich zone has different slurry densities and forms a slump bed or an expanded bed. For example, in test runs, operating conditions were provided to generate a bed density of about 1.1 g/mL in the solids rich zone which resulted in expanded fluidized bed conditions. In expanded fluidized bed conditions, there existed some differences in solids content between the top and bottom layers. Operating conditions were also provided to generate a bed density of up to about 1.9 g/mL in the solids rich zone which resulted in slumped bed conditions. In slumped bed conditions, counter-current flow of the solids and solbit can be facilitated and therefore operating with bed densities and other parameters that provide slumped bed conditions can be desirable in some circumstances. Nevertheless, expanded fluidized bed conditions can facilitate fluid passing through the solids and therefore can provide enhanced performance and can be desirable.

Regarding the implementation illustrated in FIG. 34, the extractor can facilitate combining digestion, extraction, separation, as well as countercurrent washing in a single unit. Digestion, extraction and separation are promoted in the primary extraction assembly 418 and in the bottom of the classifier assembly; while some extraction, separation and countercurrent washing are promoted in the upper part of the classifier assembly and the upper, liquid portion of the primary extraction assembly 420.

Process Implementation with Counter-Current Extractor

Figure 41A:
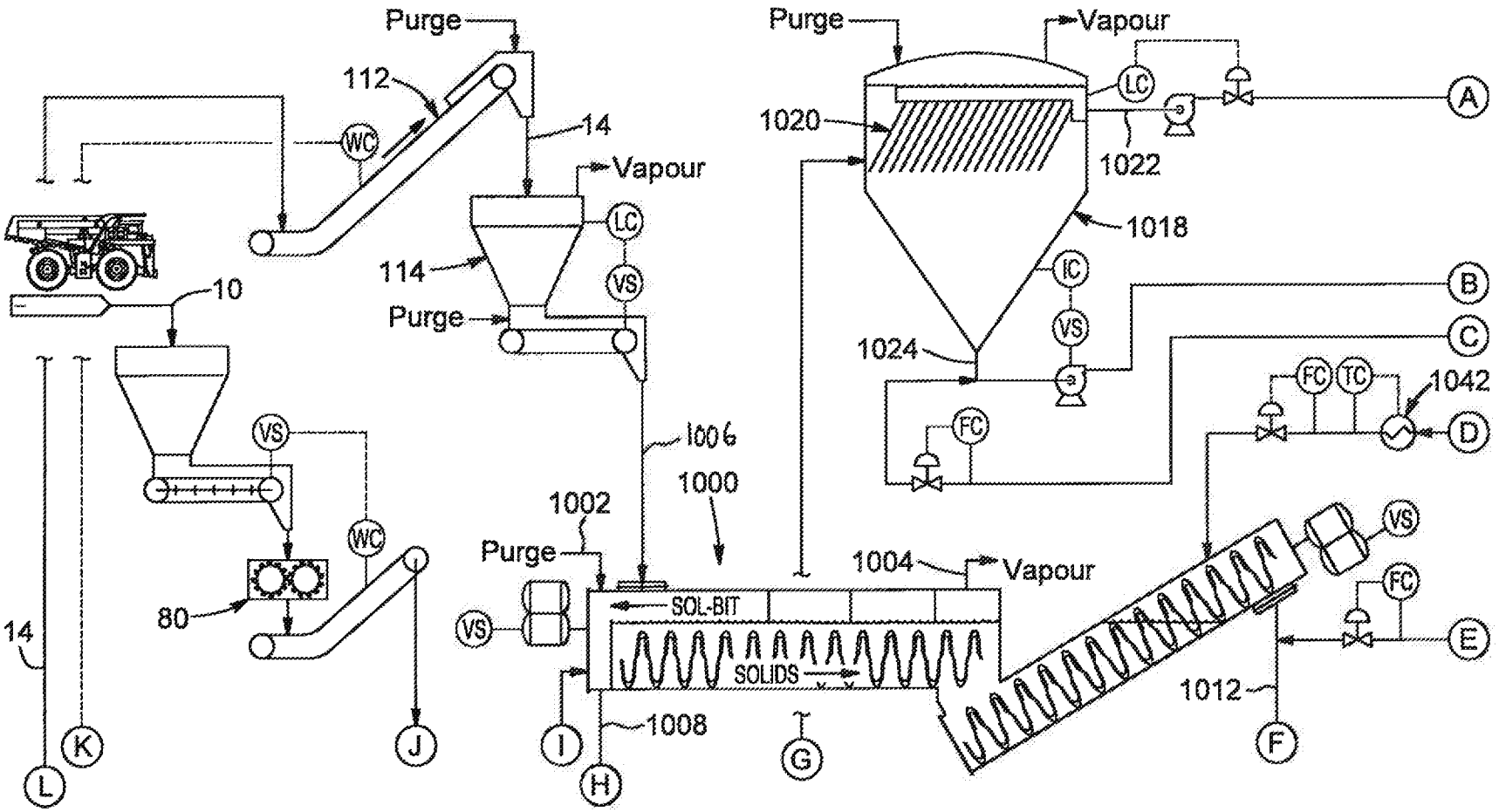
FIGS. 41*a* to 41*d* illustrate a flow diagram of another process implementation for extracting bitumen from oil sands.
Figure 41B:
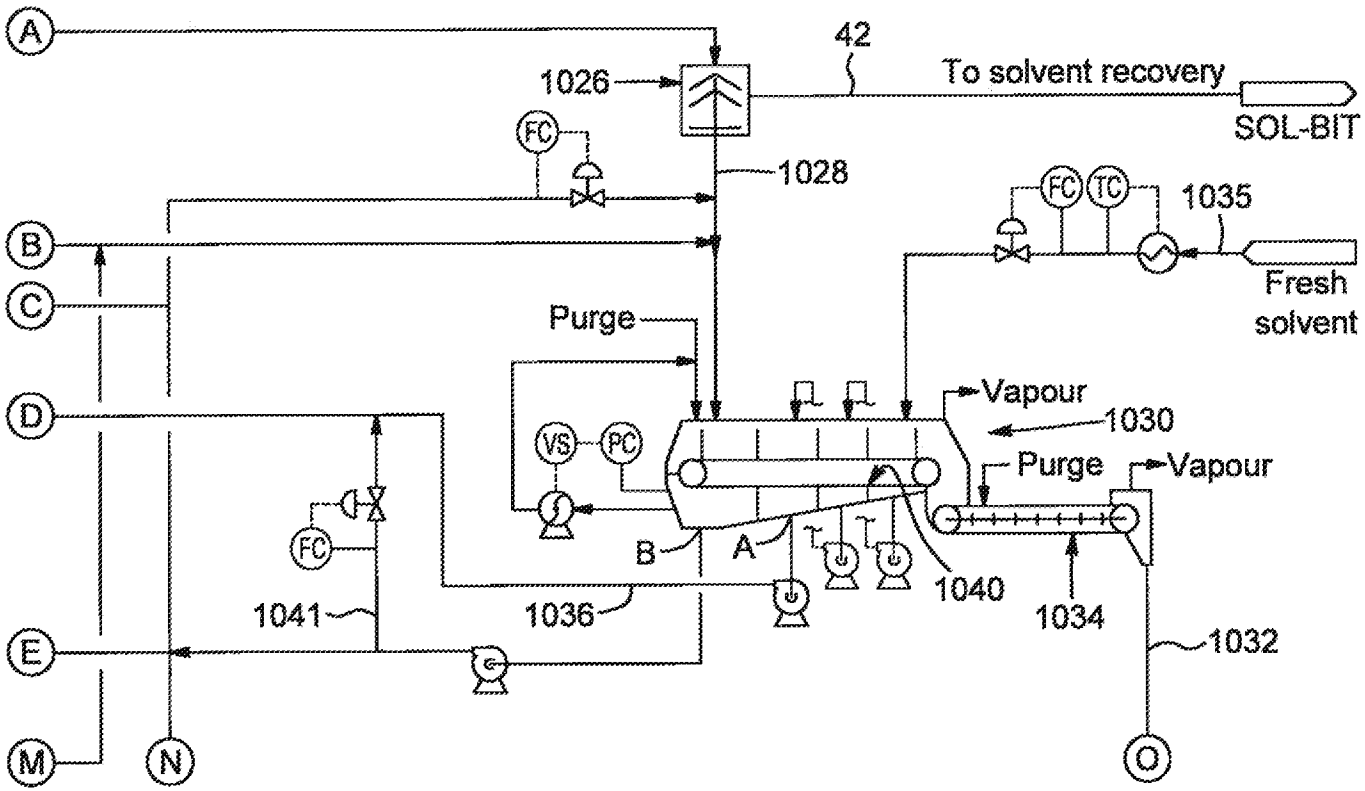
Figure 41C:
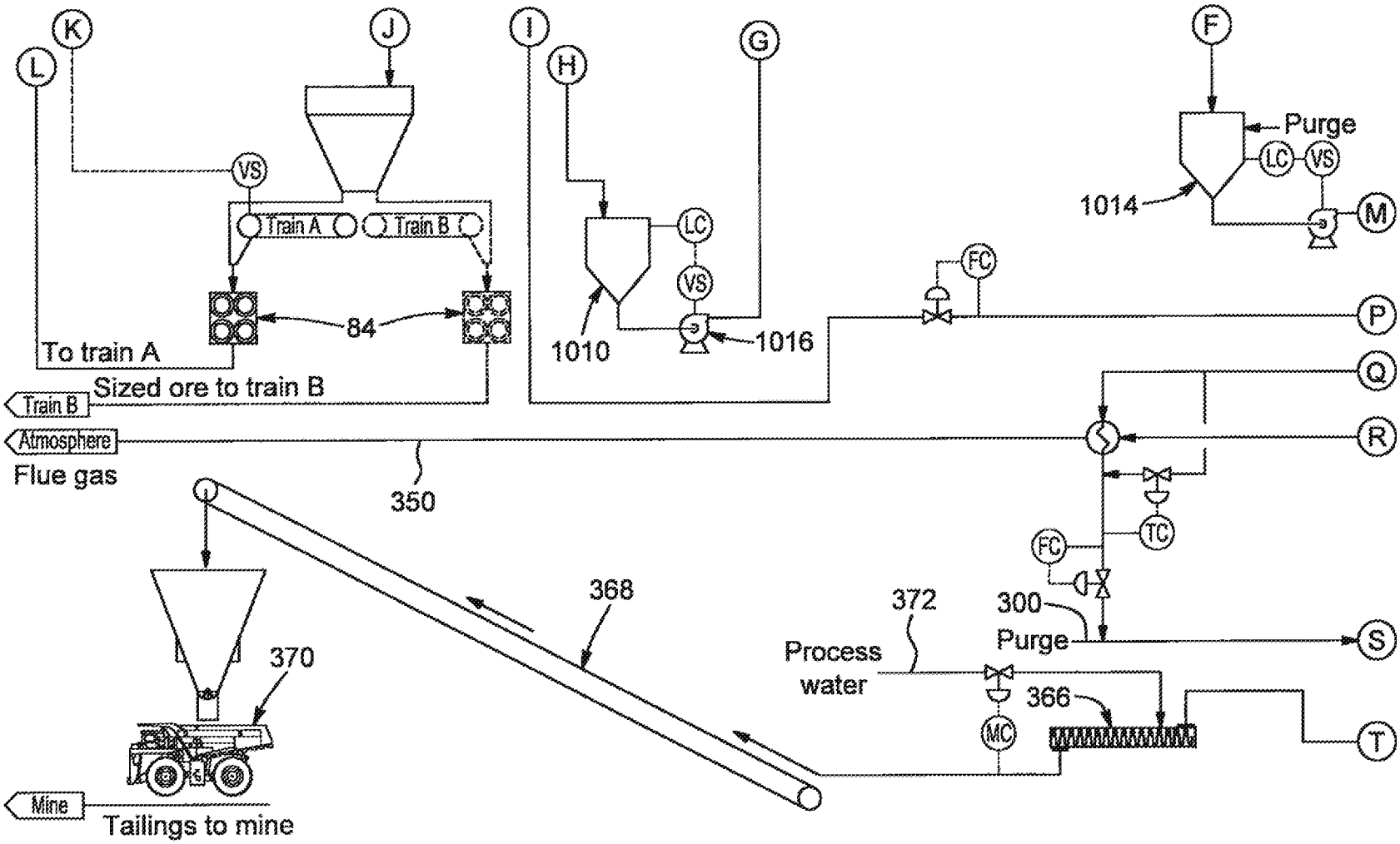
Figure 41D:
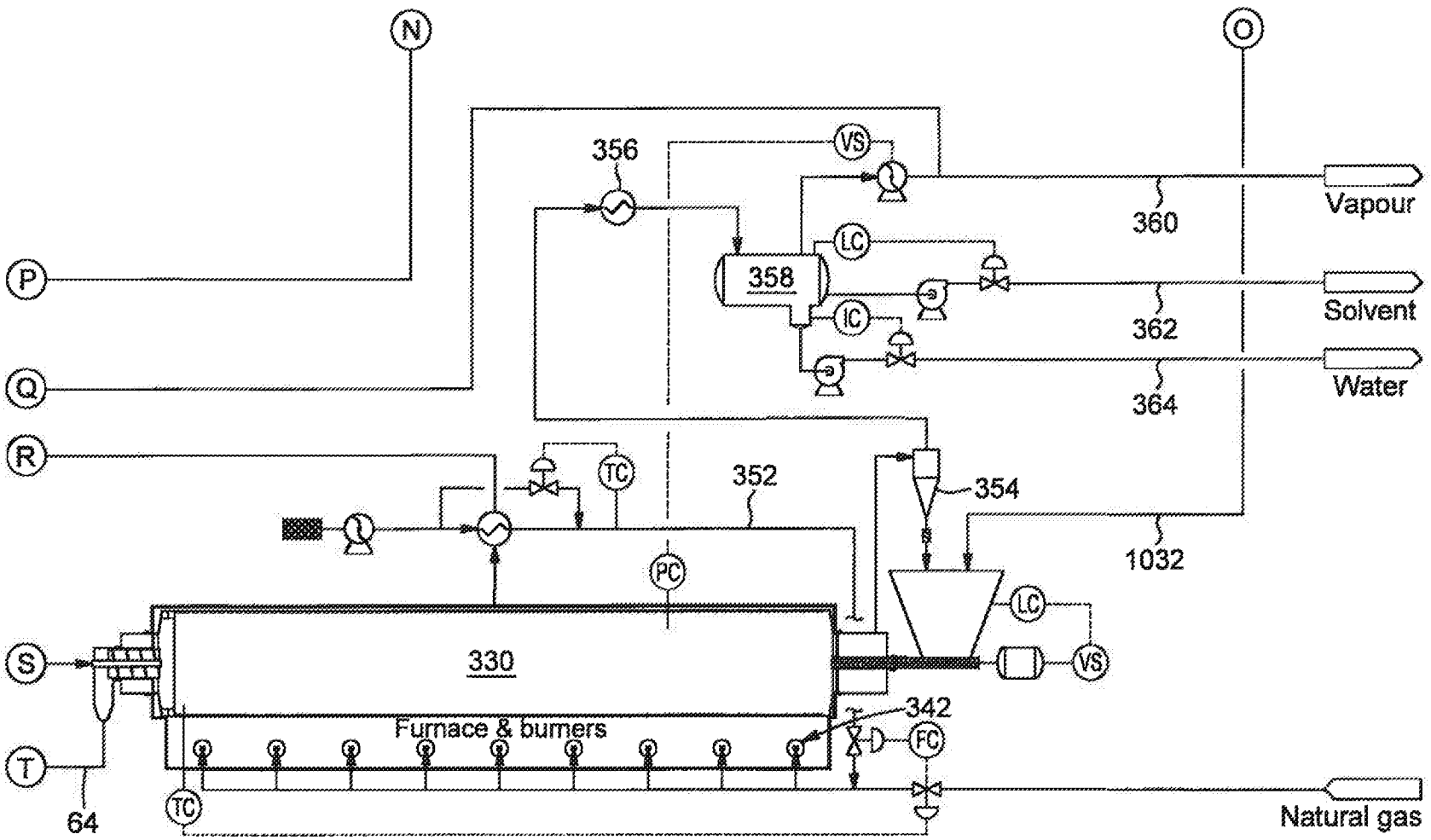

Referring to FIGS. 41*a* to 41*d*, oil sands ore 10 is subjected to crushing and sizing, and the sized oil sands ore 14 is fed into an integrated extractor 1000 with rotating elements. The extractor 1000 illustrated in these figures can be similar in design and functionality as the extractor of FIG. 34 described above. As seen in FIG. 41*a*, the extractor 1000 is provided with a purge line 1002 and a vapour exit line 1004. The sized oil sands 14 is fed via a feed line 1006 that is provided at an upstream end of the extractor 1000. As described above, the extractor 1000 is operated with counter-current displacement of the solids relative to the solbit, with the solids moving downstream and the solbit moving upstream. The extractor 1000 produces a solvent diluted bitumen stream 1008 that can be withdrawn from its upstream end and supplied into a surge tank 1010, and a solvent diluted tailings stream 1012 that can be discharged from a downstream end into a coarse solids pump box 1014. It is noted that one or more hydrocyclones could be added to separate fines from the extractor tailings 1012 and/or from the solbit and/or from other slurries in the process, so as to process fines separately from the coarse tailings.

The solvent diluted bitumen stream 1008 can be supplied by a pump 1016 to a gravity separator 1018 in order to remove fine solids. The gravity separator 1018 can be an inclined plate separator with inclined plates 1020 provided in an upper portion of the separator and a conical bottom. It is noted that various other types of separators could be implemented instead of a gravity separator at this stage of the process to remove a portion of the fines from the solvent diluted bitumen stream 1008. The gravity separator 1018 produces an overflow stream 1022 that is mainly bitumen and solvent with some residual fines, and an underflow solvent diluted fines stream 1024. This separation stage can also be referred to as a bulk fines separation stage where most of the fines in the solvent diluted bitumen stream 1008 are removed.

Referring still to FIGS. 41*a* to 41*d*, the overflow stream 1022 can then be supplied to second fines separation stage, which may be conducted in a centrifuge 1026 to remove additional fines from the solvent diluted bitumen and produce the bitumen enriched, solids depleted stream 42 which is then supplied to solvent recovery. The centrifuge 1026 also produces a bottoms stream 1028 that is mainly composed of solvent and fines. The centrifuge 1026 can be a vertical centrifuge with the goal of polishing the overflow stream 1022 when it has a relatively low solids content (e.g., below 5 wt %). However, the centrifuge 1026 could be a horizontal centrifuge if the overflow stream 1022 fed into the centrifuge has higher solids content (e.g., up to 30 wt %). It is also noted that other types of fines separators could be used in this second fines separation stage.

Thus, the solvent diluted bitumen stream 1008 produced by the extractor 1000 can be subjected to fines removal, which can be conducted in multiple stages. The first stage of fines removal can be performed by gravity, while the second stage of fines removal can be performed by accelerated techniques, such as centrifuging. The first stage can be a bulk fines removal stage that removes a bulk of the fines and produces a fines depleted stream (e.g., fines below 5 wt %), and the second stage can be a polishing stage that removes residual fines in order to obtain a final fines content of about 0.5 wt % for example. It should nevertheless be noted that various other units and configurations can be used to remove fines from the solvent diluted bitumen stream 1008.

Still referring to FIGS. 41*a* to 41*d*, the various solids rich tailings streams can be supplied to a washing unit 1030 for washing and filtration to remove residual bitumen and drain solvent from the mineral solids. The washing unit 1030 produces a washed tailings 1032 that can be supplied by conveyor 1034 to a drum dryer 330 or another type of solvent recovery unit, which can be operated in a similar manner as described above and in relation to FIG. 8. The solids streams 1028 and 1032 can be supplied to the washing unit 1030 separately or they can be combined together to be supplied as a single solids rich feed stream to the washing unit 1030.

Referring to FIGS. 41*a* to 41*d*, the washing unit 1030 also receives fresh solvent 1035 or a relatively high solvent content stream, and produces solvent wash liquors 1036. The fresh solvent 1035 can be obtained from a solvent recovery unit and may be pre-cooled in a cooler 1038 prior to being fed to the washing unit 1030. The washing unit 1030 can include a belt filter 1040 with overhead washing systems and wash liquor recycling, for example as illustrated.

In more general terms, the washing unit 1030 can have multiple stages for counter-current washing of the solids to remove residual bitumen. The final or n-th washing stage can be supplied with the purest solvent mixture (e.g., fresh solvent), which enables production of the washed tailings 1032 with relatively low bitumen content. The n-th stage also produces a corresponding solvent wash liquor, which passes through the filter and still has a relatively high solvent content. This solvent wash liquor is recycled via pump back into the upstream or (n-1)th washing stage. The washing unit can have two, three or more of such washing stages and the solvent wash liquor from each stage can be recycled into the previous stage. Finally, the solvent wash liquor collected from the first washing stage will have the highest bitumen content but will still be relatively high in solvent content and can be supplied in whole or in part to the extraction stage 1000.

The solvent wash liquor 1036 can be withdrawn from several different locations (e.g., locations A and B) of the washing unit 1030 and these streams can have different compositions in terms of solvent and bitumen content. The solvent wash liquor 1036 streams A, B can be withdrawn separately and supplied via dedicated lines to other processing units. For example, one stream A can be supplied directly and in whole to the extractor 1000, while the other stream B can be supplied in part as an optional fluidizing liquid to the solvent diluted tailings 1012 or the pump box 1014 to facilitate pumping of the tailings, if needed. Part or all of stream B can also be selectively joined back with stream A, via a branch line 1041, for example to control the flow of solvent that is supplied into the extractor 1000. It should be noted that other solvent containing streams can also be fed into the solvent wash liquor stream and/or added directly to the extractor depending on solvent demand and operating conditions.

The solvent wash liquor 1036 is a solvent rich solbit stream that can be supplied to other parts of the process. For example, the solvent wash liquor 1036 can be supplied, at least in part, to the downstream end of the extractor 1000 as the sole source of solvent or a part of that source. The solvent wash liquor 1036 can be pre-heated or cooled in a heat exchanger 1042 before entering the extractor 1000, although it is preferably heated in order to promote extraction and gravity separation of the components within the extractor 1000. Some of the solvent wash liquor 1036 can also be recycled to other units to increase fluidity of solids rich streams or for other purposes.

As can be seen in FIGS. 41*a* to 41*d*, the process can be controlled using various level control (LC), weight control (WC), temperature control (TC), interface control (IC), flow control (FC), and pressure control (PC) devices. Certain units (e.g., conveyors, pumps, motors, etc.) can be controlled with a variable speed (VS) controller. Temperature control is relevant in terms of the operational safety of the unit, solvent loss control, and evaporation. The liquid level in the extractor 1000 is another relevant variable to control as it influences the hydrodynamics of solvent-ore interaction; liquid level can be controlled by a weir or similar outlet mechanism. In addition, the process can accept a wide range of ore grades from an oil sands mine and process control schemes can be implemented in order to account for variations in ore feed composition (e.g., grade, fines content, clay content, etc.) Changes in feed ore from the mine can create disturbances in some regular control variables, particularly with respect to tailings washing and filtration steps. To mitigate such disturbances, advanced instruments may be used to monitor changes in bitumen content, compositional characteristics, filter cake interface, or other variables. Various control strategies can be implemented in response to variable ore quality, e.g., feed rates may be reduced to meet tailings quality targets.

It is also noted that the process illustrated in FIGS. 41*a* to 41*d* can represent one train of an overall process that includes multiple parallel trains for processing oil sands. For example, sized oil sands could be divided into two main streams that are fed to respective trains A and B. Train A is illustrated in these figures, while train B could be similar or different in design for processing a portion of the oil sands.

It is further noted that the process illustrated in FIGS. 41*a* to 41*d* is suitable for integration of the counter-current extractor 1000 shown in FIG. 41*a* and in FIG. 34, for example. However, it is noted that other types of extractors, such as other implementations described herein, could be integrated into this process scheme.

The main example of the counter-current extractor described herein includes a horizontal primary extraction section followed by an inclined classifier section. However, the extractor design could be modified in various ways. For example, the extractor could include one main section that is inclined and has an upstream section where the shafts of the rotating elements are below the liquid level and a downstream section where the shafts of the rotating elements extend above the liquid level to enable back drainage. Thus, the entire unit can be configured to be inclined at a single angle (which could be adjustable), or multiple sections of the unit can have different angles (e.g., horizontal followed by inclined, or various sections having different angles to provide the desired mixing and transportation functions along the length of the unit). Nevertheless, experiments have found that the example extractor design illustrated herein with a first section that is generally horizontal and the second section that is inclined gave superior performance compared to a single long unit oriented at an incline.

One factor to consider in designing the counter-current extractor is to balance the mixing and transportation functions along the length of the unit. One challenge of operating a counter-current extractor configured as a single inclined unit is that there is typically only one pair of rotating elements. In the two-section design, the primary extraction assembly can rotate at relatively high speeds to provide enough mechanical energy to the ore to mix with the solvent for good extraction while in the classifier assembly, the augers can rotate at lower speeds. When comparing equipment of the same size, augers generally run at lower speeds than rotating elements having discrete projections (e.g., log washers) to transport the same amount of ore. Having an independent pair of motors in the two-section design enables the rotating elements of the primary extraction assembly to be run at higher speeds while the classifier augers are run at lower speeds, and they can both be adjusted independently. Thus, the two-section extractor design provides certain enhancements and operational flexibility compared to the single-unit design.

Additional features may be included in some implementations of the extractor 1000. For example, the extractor trough 482 may include baffles or weirs to control the amount of mixing in the expanded fluidized bed (containing the solids) and the overlying solvent stream (containing the bitumen) that is passing in the opposite direction to the solids. One or more mechanical inserts such as horizontal baffles or weirs may be included between the solid rich zone in the lower part of the extractor trough 482 and the overlying solvent rich zone in the upper part of the extractor trough 482, parallel to the longitudinal flow of solvent, to reduce solids transfer between the expanded fluidized bed below and the liquid phase above. Alternatively, or in addition, one or more vertical baffles or weirs may extend from the upper part of the extractor trough 482 into the solvent rich zone, transverse to the flow of solvent, to control axial mixing in the solvent-rich zone.

Applications of NAE Techniques to Oil Containing Materials

As mentioned above, the NAE methods and systems can be applied for processing bitumen containing materials, such as oil sands ore, to extract bitumen. Various oil sands ores as well as other bitumen and mineral solids containing materials can be processed using NAE.

In some implementations, the oil sands material can be low grade Athabasca oil sands. The NAE process extracts high levels of bitumen regardless of ore grade (within ranges tested). The NAE process can cost effectively extract low grade oil sands. It is estimated that many millions of barrels of bitumen is contained in high fines or high clay ores that are difficult to process using aqueous extraction techniques. The NAE techniques can also receive oil sands ores that vary in grade over time without the need to significantly modify operating parameters, thus facilitating continuous processing of mined ore regardless of ore grade.

In some implementations, the oil sands material can be oil sands not processable by hot water extraction methods. This technology could be applied to other types of oil sands from other deposits around the world, beyond Canadian oil sands deposits. For example, oil sands from Utah that are not water-wet like Athabasca oil sands and not readily extracted by aqueous processes, could be processed using NAE techniques. Thus, oil-wet oil sands ore could be processed using NAE.

In some implementations, the oil sands material can be contaminated soil such that the NAE process is used for remediation. Hydrocarbon-contaminated soils from spills or leaks and industrial sites (e.g., manufacturing, service and storage) contaminated with leaked liquid hydrocarbons can also be ameliorated and cleaned up using NAE processes.

Comments on NAE Process Features and Advantages

Figure 29A:
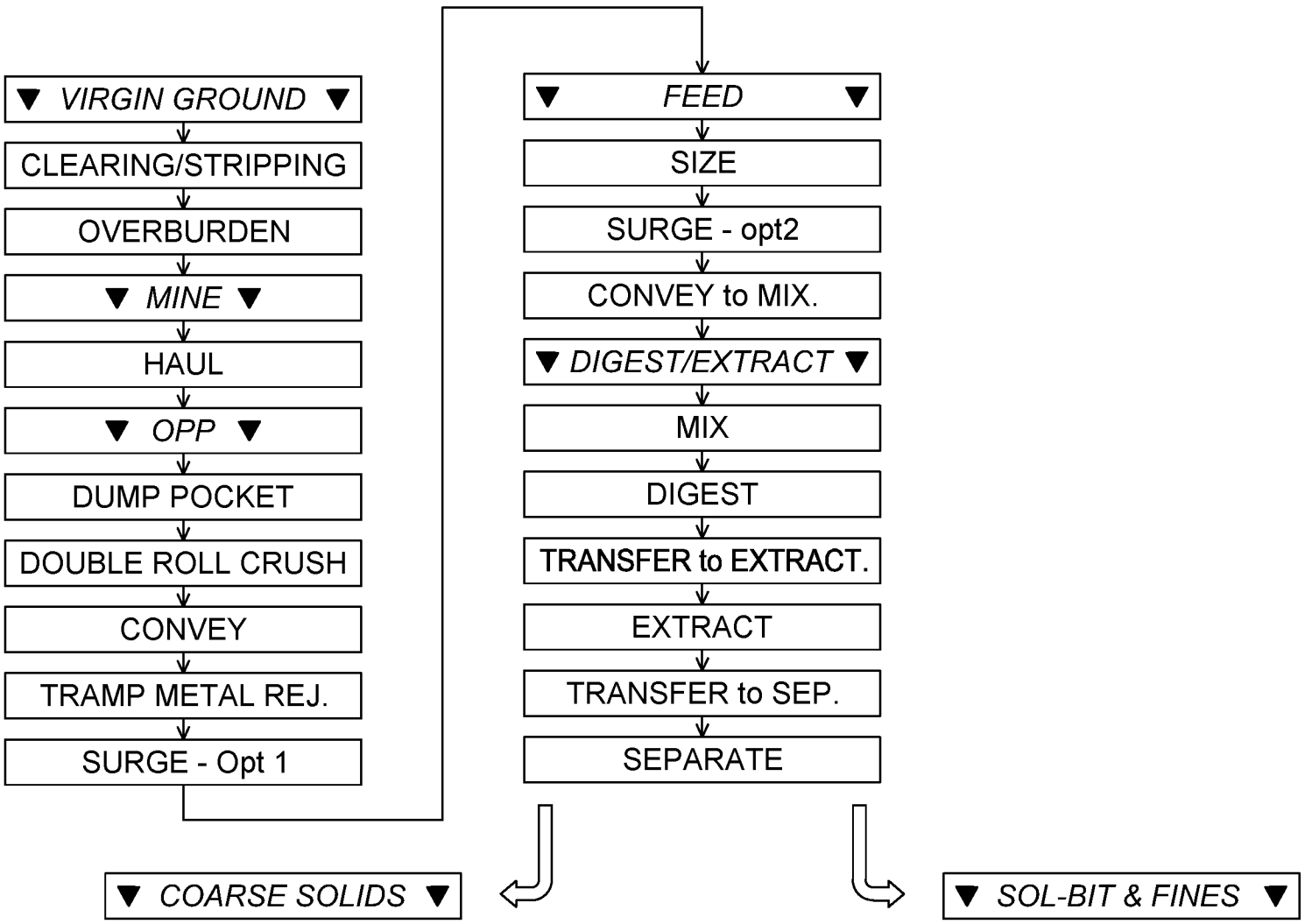
FIGS. 29*a* to 29*c* provide a high-level oil sands processing sequence including NAE.
Figure 29C:
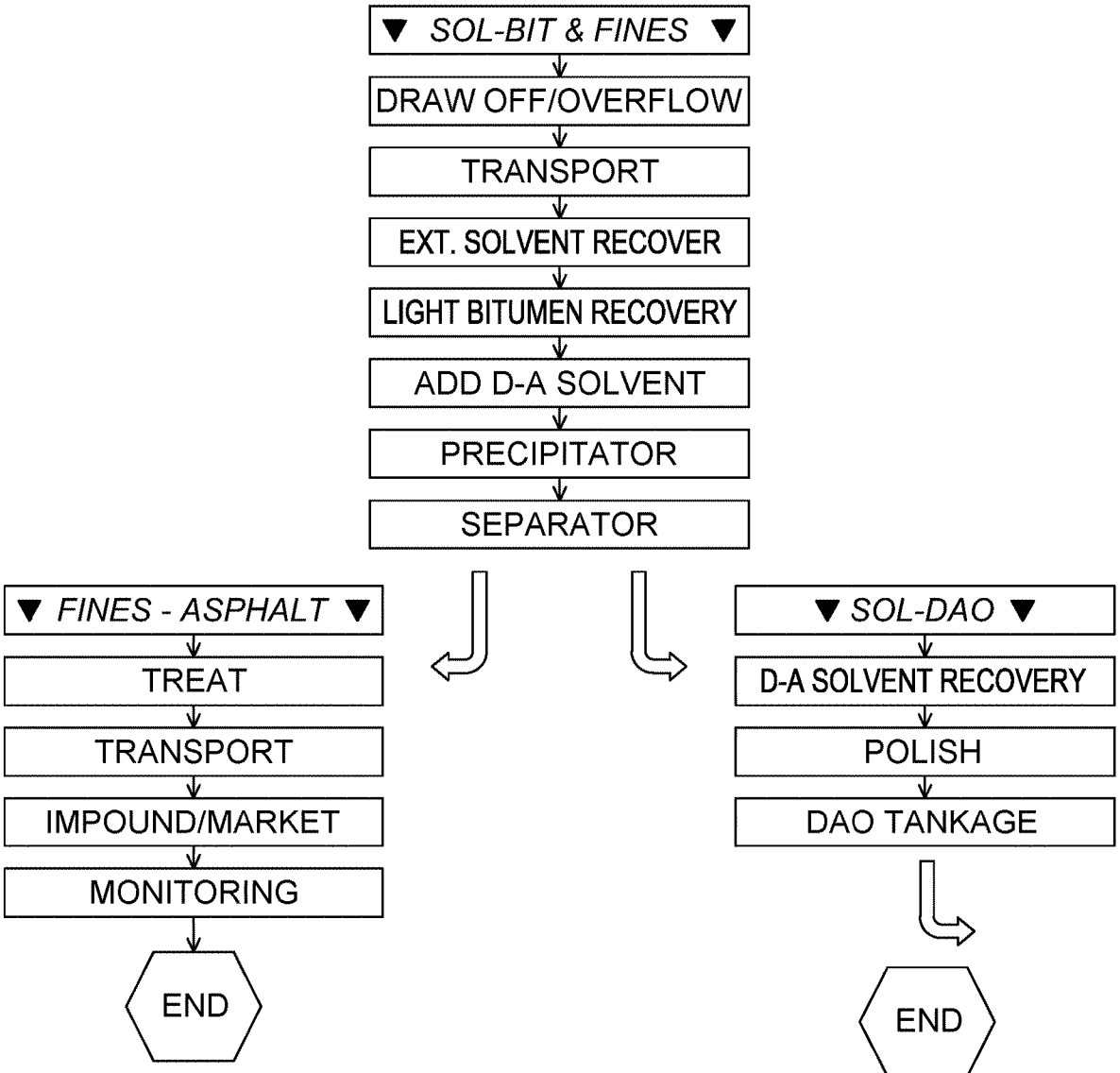
Figure 29B:
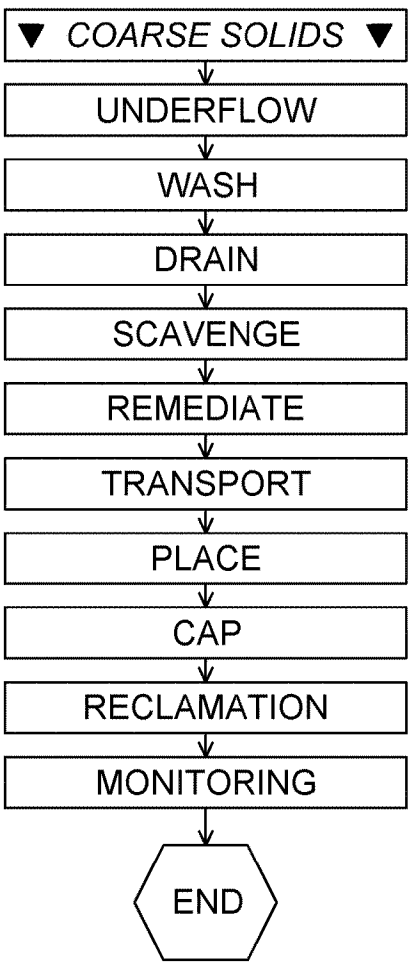
Figure 30:
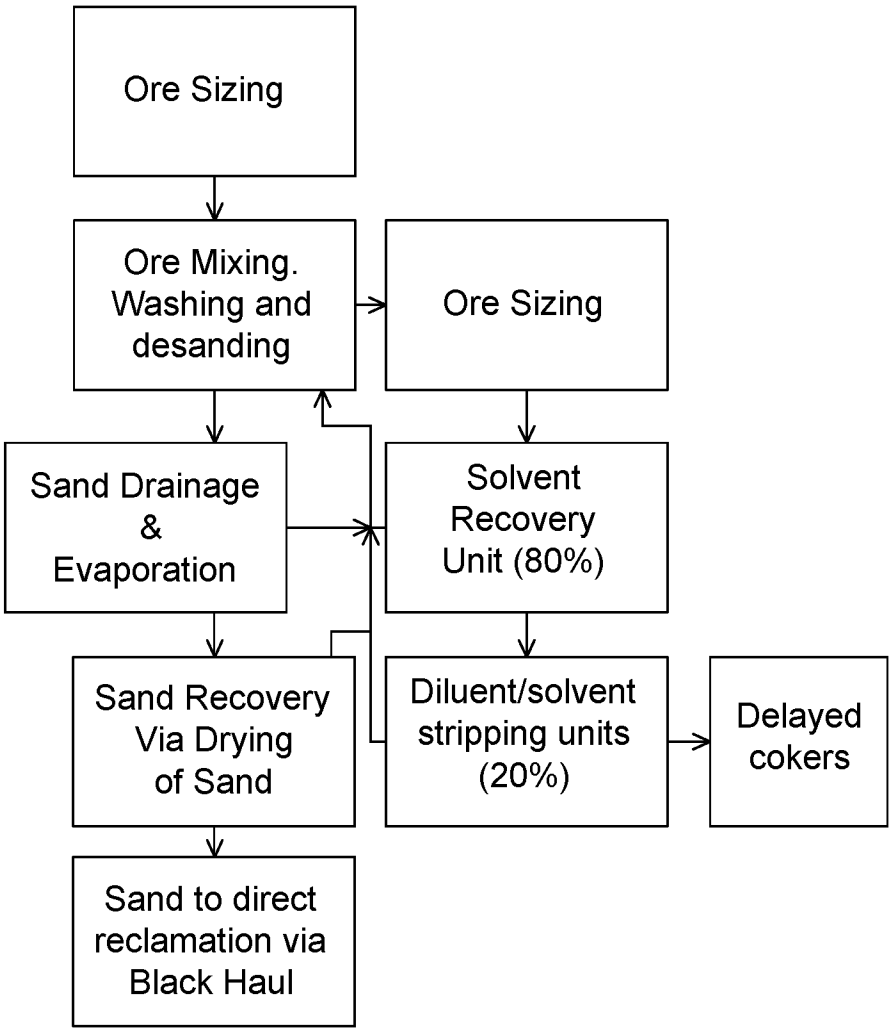
FIG. 30 is a block diagram of another example NAE process.

Referring to FIGS. 29*a* to 29*c* and 30, additional illustrations of process block diagrams are provided for NAE of bitumen from oil sands. FIGS. 29*a* to 29*c* provide a high level representation of an NAE process sequence. FIG. 30 is a block diagram showing an example of an NAE implementation.

Implementations described herein overcome challenges of NAE base methods and provide effective extraction and recovery of bitumen. For example, NAE techniques described herein facilitate digestion and bitumen extraction in low cost equipment which can be operated safely and reliably; achieve a low fines bitumen product and high solvent recovery while maintaining the minimum level of process complexity to deliver low capital and operating costs; provides comparable or lower GHG emissions compared to existing HWE processes; enables very low solvent loss, e.g., less than 4 barrels of solvent per 1,000 barrels of bitumen; facilitate production of clean dry bitumen with less than 0.5 wt % of sediment. As mentioned above, integrating multiple operations (e.g., digestion, extraction, separation) into fewer or single vessels provides advantages in terms of process simplicity and low cost of equipment. Various units and process configurations are provided to ensure solvent recovery and recycling, as well as fines removal from bitumen.

Alternative Implementations

It should also be noted that some units and processes described herein can be used in connection with other types of oil sands processing techniques that can involve the addition of water alone or in combination with solvent. Such techniques would not be considered non-aqueous bitumen extraction and can involve adapting the units and processes to water addition and associated handling of aqueous streams. For example, certain integrated extraction units described herein could be adapted for use with aqueous techniques, although equipment sizing, operating parameters including residence time, temperatures, pressures, and the like would be modified compared to non-aqueous extraction.

It is also noted that some implementations described herein can be used for the non-aqueous extraction of other valuable materials from mined ore as well as the treatment and handling of process streams such as oil containing tailings. Of course, the type of solvent as well as equipment sizing and design can be adapted for the extraction of other materials.

EXPERIMENTATION & CALCULATIONS

Various experiments and calculations have been conducted to assess NAE techniques and properties, and to compare NAE methods to aqueous extraction techniques.

Comparative Calculations and Observations

Comparisons have been made between NAE techniques and water-based techniques for extracting bitumen from oil sands. It has been determined that NAE techniques can represent advantageous of about 30% lower operating cost with the production of little to no fine tailings.

Figure 27:
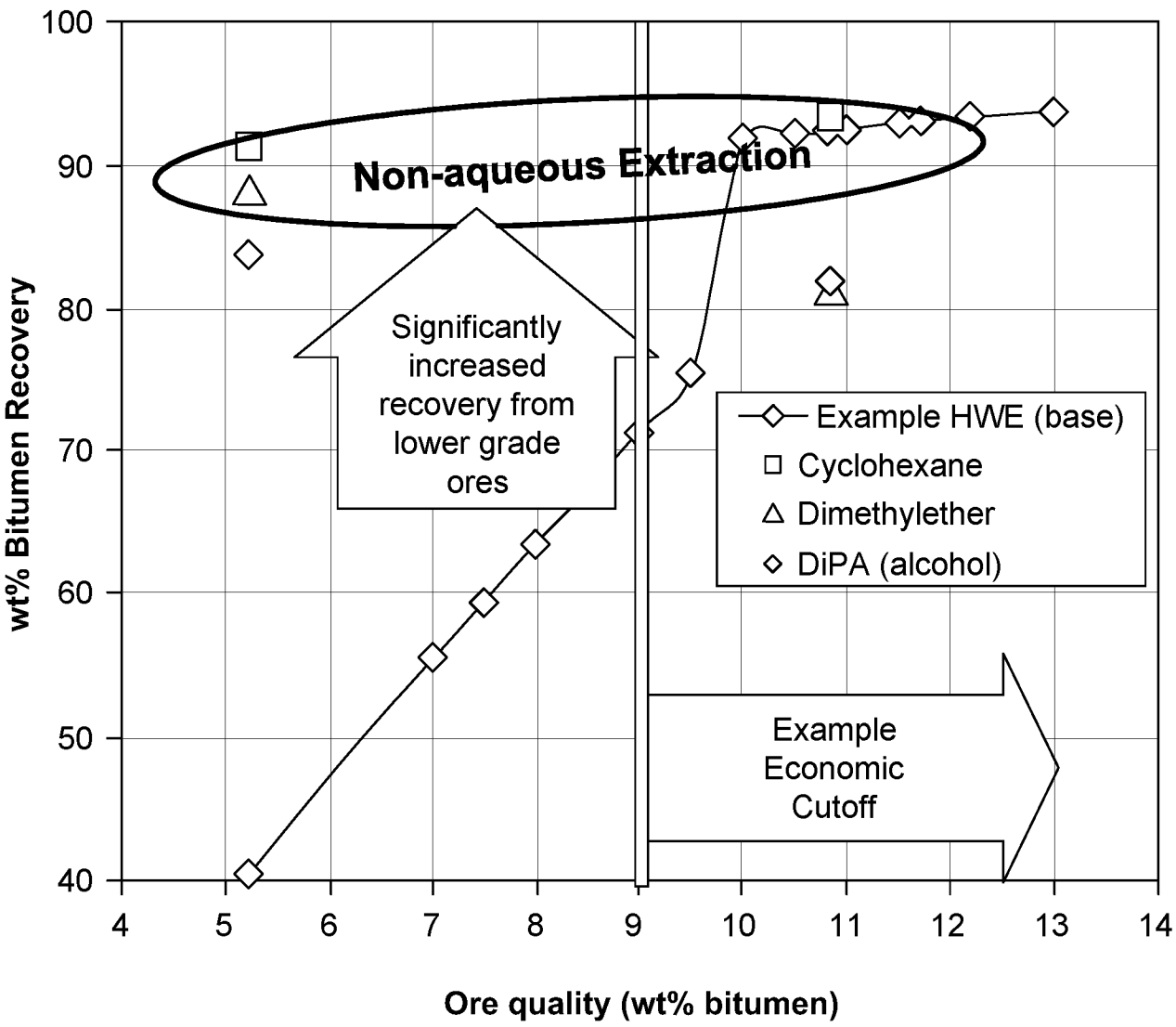
FIG. 27 is a graph of bitumen recovery versus ore quality comparing NAE and aqueous methods.

NAE methods can also be used for the extraction of bitumen from a broad range of oil sands grades, i.e., oil sands having different levels of bitumen content or other compositional features. Test work has shown that the bitumen recovery can be high (e.g., above 90%) regardless of the ore grade, as shown in FIG. 27. In contrast, the bitumen recovery from the traditional hot water extraction process drops off significantly below 9% ore grade. This feature of NAE will have a significantly beneficial impact on mined ore blending requirements.

Figure 28:
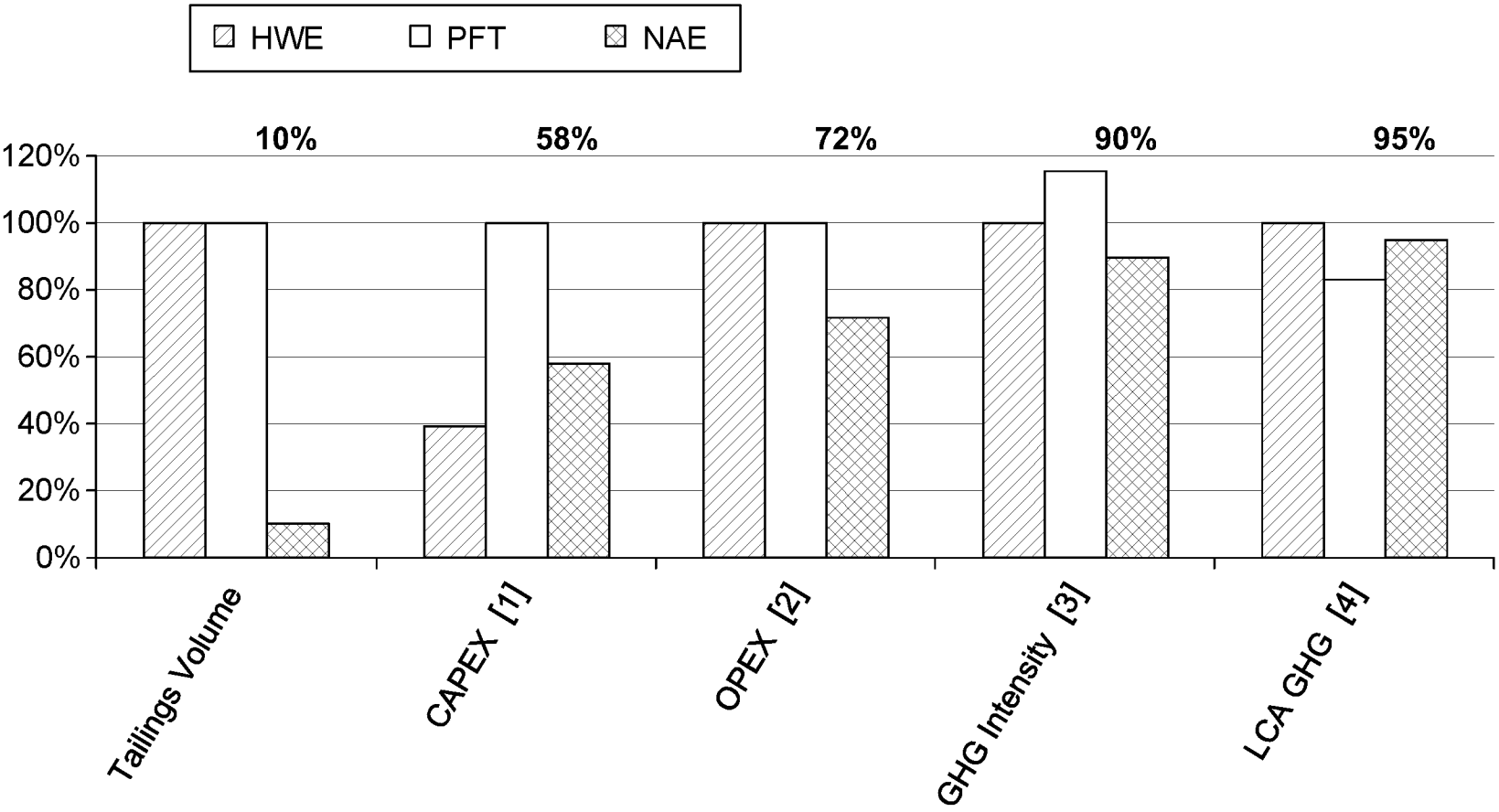
FIG. 28 is a bar chart of comparing various performance indicators of NAE, hot water extraction (HWE) and paraffinic froth treatment (PFT) methods.

A comparison of the environmental, economic and GHG performance of NAE methods compared to current base cases of Hot Water Extraction (HWE) and Paraffinic Froth Treatment (PFT) was conducted. Results are shown in FIG. 28. The comparative metrics for the NAE process compared to HWE and PFT processes were tailings volume, CAPEX, OPEX, GHG intensity, and life cycle analysis (LCA) GHG. In terms of relevant findings, it appears that there will be a significantly lower tailings footprint (90% reduction), lower CAPEX (40% lower than PFT, comparable to brown field HWE deployment, using pre-existing processing plants), and 30% lower OPEX (primarily due to a significant reduction in tailings and HWE extraction costs). The GHG emissions are about 10-20% lower than the current HWE process and about 5-10% lower on a full well-to-refinery product tank basis.

Experimentation Series for NAE Extraction and Settling

Ore grades were tested to assess the impact of ore grade on NAE processing. Lean and medium grade ores were tested, where the lean grade ores had higher fines and lower bitumen content (about 50 and 5 wt % respectively), while the medium grade ores had lower fines and higher bitumen content (about 20 and 10 wt % respectively).

Laboratory scale batch test work has been conducted to evaluate processing steps of NAE methods. Operating performance metrics (e.g., degree and rate of bitumen extraction, solvent/bitumen ratios, impact of extraction temperature, impact of ore grade, and so on) have been determined to support process evaluation. Continuous flow testing of example process arrangements has been conducted with positive results.

Batch extraction tests were conducted and aimed to determine how rapidly the bitumen could be extracted by the solvent (extraction kinetics); impact of mixing energy input (thermal and mechanical); and the quality of the recovered bitumen after extraction (solids and water content). Work was carried out using two types of batch extraction equipment and two types of semi-continuous extraction systems. Some work was done in a stirred glass batch extractor (high shear mixer-extractor unit). A rotary extractor (square or cylindrical cross-section polycarbonate bottle) processing oil sands was also employed for some comparison testing. Cyclohexane was used as the extraction solvent in the tests.

Table of some properties of cyclohexane relevant to use in extraction

| Property | Property Value |
|---|---|
| Density (g/mL @ 20° C.) | 0.779 |
| Viscosity (cP @ 20° C.) | 0.977 |
| Boiling Point (° C.) | 80.7 |
| Vapour Pressure (kPaa) | |
| 25 | 13.0 |
| 35 | 20.1 |
| 45 | 30.0 |
| Solubility in water @ 25° C. (mg/L) | 55 |

The stirred extractor vessel was equipped with baffles and impellers for maintaining suspended oil sands slurry at appropriate impeller speeds. This stirred extractor allowed extraction tests to be conducted at elevated controlled temperatures. Small samples could be withdrawn periodically to determine the concentration of bitumen extracted into the solvent and thereby monitor the extraction rate.

In typical operation of the mix-extractor, ore and solvent were equilibrated at the extraction temperature before being rapidly combined to begin the extraction process. The start of mixing is time zero. Samples are withdrawn from the extractor at pre-determined time intervals, filtered to remove suspended solids and analyzed using standard techniques to determine bitumen content in the solbit (solvent-bitumen extract). The bitumen content of the ore was determined and used with extracted bitumen content at each time interval to determine percent extraction at that time. Experimental conditions included combinations of the following factors: (a) ore grade, (b) temperature, (c) solvent to oil sands mass ratio, (d) mixer speed, (e) simple solvent additives and (e) initial concentration of bitumen in the solvent.

A rotary drum extractor was also tested. The rotary extractor was operated at room temperature. The rotary extractor vessel was used with or without internals (baffles or balls) and rotated at speeds above and below the critical rpm when solids are lifted via centrifugal force without baffles. Small samples were not withdrawn while the extractor was rotating. Typically, a data point of percent bitumen extraction at time (t) was obtained per test with this extractor. Experimental variables included: (a) ore grade, (b) solvent to bitumen ratio, (c) internal baffles, (d) rotational speed, (e) fill level and (f) solvent additives. Typically, ore was added to the rotary extractor and then cyclohexane was poured in. The rotary extractor with ore and solvent was then placed on a roller and rolled at a set speed for a predetermined time. At the end of the rotation time a sample was withdrawn from the extractor, filtered to remove suspended solids and analyzed using standard techniques to determine bitumen contents. The bitumen content of the ore used to determine extraction percent was directly measured for each test ore sample. After the rotary extraction tests, the remaining contents in the extractor was rolled to achieve complete extraction then a second sample was withdrawn for analysis to determine the bitumen content of the ore sample used and hence extraction rate and recovery percent at the first sample interval.

The oil sands ore used in this phase of work were from a base mine and included: medium grade ore and lean grade ore. Three sample packages from each ore were analyzed to determine average oil, solids and water content. The solvent used for extraction was cyclohexane. In a few cases, cyclohexane with a known initial amount of dissolved bitumen was used as the extraction solvent. The impact of water and/or methanol addition to the ore prior to extraction was evaluated in some tests.

Room temperature settling of fine solids (solids below about 44 μm) in the solbit extract was investigated by settling in graduated cylinders, in a centrifuge and with the aid of induced asphaltenes precipitation by pentane addition.

The extraction test work assessed effects on rate of extraction and recovery of bitumen on the following process parameters: temperature; mixing rate (energy); ore grade; solvent-to-ore mass ratio; and initial concentration of bitumen in the solvent. Settling of solids in the solbit (solvent-bitumen extract) was also investigated at room temperature conditions. The main focus of the settling test work was: solids content after settling under normal and enhanced gravity; impact of added water to solbit on settling; and efficacy of solids removal with partial deasphalting.

Extraction Tests

The study of NAE of bitumen from oil sands by cyclohexane showed that the rate of extraction of bitumen was dependent on temperature and mixing energy and to a lesser extent solvent-to-oil sands ratio. In the high shear mixer extractor, faster bitumen extraction rates are achieved by: increasing temperatures; increasing mixer speed; and higher solvent-to-oil sands ratios.

In one example test, 95% of the bitumen was able to be extracted in about 5 minutes with a mixer speed of 900 rpm and extraction temperature of 45° C. for the lean and medium grade ores. Other extraction tests with the lean grade ore using a solvent including about a quarter wt % bitumen in cyclohexane showed no appreciable differences in extraction rates compared to extraction using pure cyclohexane. Similar extraction rates at room temperature were achieved for lean grade and medium ores in the rotary extractors when using suitable internal baffles and rotational speeds.

It was found that water content of the oil sands ore had an impact on bitumen recovery and the fine solids content in the produced extract phase. Depending on the amount added, water addition to the oil sands ore prior to extraction can suppress bitumen extraction and solids suspension in the produced extract phase. Weathered or desiccated oil sands ore can lead to a high content of suspended solids in the extract phase. While the mechanism of the effect of water content in the oil sands ore on bitumen extraction and solids content in the produced extract phase is not certain, it may be that at low addition rates water serves to wet clay fines and hold them together preventing their dispersion. At higher addition rates, water could also coat the bitumen, prevent direct contact with the solvent and impede bitumen extraction into the solvent.

Settling Tests

The main objective of the settling processes is to reduce fines content in the fungible bitumen sales product, which can be based on refinery testing where higher levels of solids adversely impact desalter operation, for example.

With the lean grade ore, settling under normal gravity reduced solid content in the solbit to 0.88 wt. %. Some solid particles 10 microns and smaller ($d_{50}$ of 4 microns) still remain suspended after 45 minutes of settling, for example. Washing of the extract with water (similar to a desalting process) reduced the fines content in the solbit.

For lean grade ores, gravity settling tests were found to reduce fines content of the supernatant extract to about 0.88 wt %. Results for centrifugation of the initial extraction (without prior settling under normal gravity) showed further reduction in fines. Centrifugation of this extract at conditions reflective of current disk stack centrifuge operations can further reduce the fines to 0.3 wt. % (equivalent to 2.5 wt. % on a dry bitumen basis). Centrifugation of the extract for longer time periods reduced fines content to 0.011 wt. % (equivalent to 970 ppm on a dry bitumen basis).

Depending on the solvent to bitumen ratio employed, partially deasphalting with n-pentane can produce a bitumen product with down to 220 ppm solids on a dry bitumen basis. These results from deasphalting were achieved by first removing the cyclohexane solvent from the oil sands extract prior to carrying out the deasphalting. Without prior removal of cyclohexane, a higher rate of pentane addition could be used for partial deasphalting.

The primary extraction stage is the first point at which the suspension of fines can be controlled. Tests indicate that the state of the ore, primarily with respect to moisture content, can have an impact on fines suspension in the extract. Low shear mixing in a rotating drum, for example, may avoid digestion of clay lumps and reduce fines suspension. Higher slurry density during extraction can improve the settling of the polydispersed solids from the extract by enhancing the rate of fines settling. These approaches can reduce the volume of fines in the supernatant extract, and can reduce fines separation and treatment requirements in downstream units.

Reductions in fines content can be achieved by gravity settling, water washing, centrifugation (which can include longer residence times), as well as partial deasphalting and/or particular equipment or process designs to enhance solids settling rates. Various techniques and combinations of unit operations can be used to reduce fines content to desired levels.

Counter-Current Extractor Pilot and Data

A pilot counter-current extractor was tested to assess performance and operation for extracting bitumen from oil sands. The pilot apparatus was similar to the one shown in FIGS. 34 to 40. Results have shown that the counter-current extractor can efficiently extract bitumen from oil sands to produce a solvent diluted bitumen stream and a solids rich tailings stream.

The following table shows results obtained from the pilot operations using a pilot extractor as illustrated in FIGS. 34 to 39 with a primary extraction assembly with dual shafts with a combination of discrete and continuous projections, and an inclined classifier assembly with dual augers. The extractor was run counter-currently. The solvent that was used for these pilot runs was cyclohexane. Samples were taken at different points along the length of the primary extraction assembly and in the solbit and tailings products, to assess bitumen content at different locations. Note that "midpoint 1" is located at one third length of the extractor trough and "midpoint 2" at two thirds with the reference being the solbit production point.

| Ore Feed | Rotating Element in Primary Extraction | | Ore | | Wt % Bitumen in liquid/solbit | | | | | wt % | % Solids in |
|---|---|---|---|---|---|---|---|---|---|---|---|
| Rate (kg/hr) | Assembly rpm | Classifier rpm | grade (wt %) | Extraction (%) | Solbit Product | Midpoint 1* | Midpoint 2* | Transition zone | Tailings | Solbit in Tailings | Solbit Product |
| 50 | 120 | 10 | 13.3 | 96.9% | 24.0% | — | — | 0.9% | 1.0% | 28.3% | — |
| 90 | 120 | 30 | 13.3 | 97.1% | 17.4% | 17.7% | 13.8% | 4.7% | 6.4% | 24.8% | 0.4% |
| 95 | 120 | 7 | 13.3 | 97.6% | 20.6% | 20.2% | 15.2% | 6.5% | 8.3% | 26.3% | 0.3% |
| 140 | 135 | 30 | 13.3 | 96.1% | 25.1% | 24.2% | 15.5% | 7.9% | 5.5% | 37.5% | 0.4% |
| 200 | 120 | 20 | 13.3 | 96.5% | 21.7% | 24.8% | 17.8% | 15.2% | 6.8% | 30.1% | 0.3% |

The invention claimed is:

1. A non-aqueous process for producing bitumen from oil sands, comprising:

contacting oil sands and solvent in an extraction stage to produce a solvent diluted bitumen and a solvent diluted tailings comprising coarse mineral solids;

separating the solvent diluted bitumen from the solvent diluted tailings;

subjecting the solvent diluted bitumen to a fines separation stage to produce a fines enriched material that includes solvent, residual bitumen and fines and a solvent diluted bitumen stream with residual fines;

subjecting the solvent diluted bitumen stream to solvent recovery to produce recovered solvent and a bitumen product; and subjecting the fines enriched material to a washing stage to remove residual bitumen and to produce a washed tailings and a solvent wash liquor comprising solvent and bitumen;

combining the solvent diluted tailings with a fluidizing stream comprising part of the solvent wash liquor from the washing stage.

2. The non-aqueous process of claim 1, wherein the fines separation stage utilizes gravity separation.

3. The non-aqueous process of claim 1, wherein the fines separation stage further comprises subjecting the solvent diluted tailings to an additional fines separation stage to remove at least a portion of the residual fines therefrom and produce the solvent diluted bitumen stream.

4. The non-aqueous process of claim 3, wherein the additional fines separation stage utilizes enhanced solid-liquid separation.

5. The non-aqueous process of claim 3, wherein the fines separation stage utilizes an inclined plate separator and a vertical centrifuge.

6. The non-aqueous process of claim 3, wherein the fines separation stage is operated to effect bulk fines removal and the additional fines separation stage is operated to effect polishing to remove the at least a portion of the residual fines.

7. The non-aqueous process of claim 1, wherein the fines separation is operated to produce the solvent diluted bitumen stream having below 5 wt % solids content.

8. The non-aqueous process of claim 1, wherein the solvent diluted tailings and the fines enriched material are combined and supplied together to the washing stage to produce the washed tailings and the solvent wash liquor.

9. The non-aqueous process of claim 8, wherein the washing stage comprises filtration.

10. The non-aqueous process of claim 9, wherein the washing stage comprises overhead washing.

11. The non-aqueous process of claim 1, wherein at least a portion of the solvent wash liquor is supplied back into the extraction stage.

12. The non-aqueous process of claim 1, wherein the solvent diluted bitumen is pumped from the extraction stage to the fines separation stage.

13. The non-aqueous process of claim 1, wherein the extraction stage is operated so as to perform the steps of:

displacing the oil sands and a solbit liquid comprising the solvent in counter-current and generally horizontal fashion with respect to each other, thereby forming a lower sand zone in contact with an upper solbit zone, the lower sand zone being subjected to mixing to extract bitumen from the oil sands material and cause extracted bitumen to dissolve into the solbit zone, wherein:

the lower sand zone comprises:

an upstream sand region having a high bitumen content; and a downstream sand region having a lower bitumen content compared to the upstream sand region; and the upper solbit zone comprises:

an upstream solbit region above the downstream region lower sand zone and having a low bitumen content; and a downstream solbit region above the upstream region of the lower sand zone and having a high bitumen content; and producing the solvent diluted bitumen from the downstream solbit region of the upper solbit zone.

14. The non-aqueous process of claim 13, wherein the extraction stage is operated with counter-current flow of liquids and solids.

15. The non-aqueous process of claim 13, wherein the solvent is preheated prior to being fed into the extraction stage.

16. The non-aqueous process of claim 15, wherein the solvent supplied to the extraction stage is obtained in part from the solvent wash liquor.

17. A non-aqueous process for producing bitumen from oil sands, comprising:

subjecting oil sands to solvent extraction in an extraction stage to produce a solvent diluted bitumen and a solvent diluted tailings comprising coarse mineral solids, wherein the extraction stage comprises:

displacing an oil sands material and a solbit liquid in counter-current and generally horizontal fashion with respect to each other, thereby forming a lower sand zone in contact with an upper solbit zone, the lower sand zone being subjected to mixing to extract bitumen from the oil sands material and cause extracted bitumen to dissolve into the upper solbit zone, wherein:

the lower sand zone comprises:

an upstream sand region having a high bitumen content; and a downstream sand region having a lower bitumen content compared to the upstream sand region; and the upper solbit zone comprises:

an upstream solbit region above the downstream region of the lower sand zone and having a low bitumen content; and a downstream solbit region above the upstream region of the lower sand zone and having a high bitumen content; and recovering a bitumen enriched solbit stream as the solvent diluted bitumen from the downstream solbit region of the upper solbit zone;

subjecting the solvent diluted bitumen to fines separation to produce a fines enriched material that includes solvent, residual bitumen and fines and a solvent diluted bitumen stream depleted in fines;

supplying the fines enriched material to a washing stage to produce washed tailings and a solvent wash liquor;

adding a portion of the solvent wash liquor to the solvent diluted tailings to enable fluidization thereof downstream of the extraction stage; and subjecting the solvent diluted bitumen stream to solvent recovery to produce a bitumen product and recovered solvent.

18. The non-aqueous process of claim 17, wherein the extraction stage further comprises:

displacing a bitumen depleted sand from the downstream sand region of the lower sand zone vertically above the upper solbit zone to produce an elevated bitumen depleted sand; and draining solvent and bitumen from the elevated bitumen depleted sand back into the upper solbit zone to thereby form the solvent diluted tailings.

19. The non-aqueous process of claim 18, further comprising adding a solvent containing stream into the elevated bitumen depleted sand to wash bitumen therefrom.

20. The non-aqueous process of claim 18, further comprising discharging the solvent diluted tailings as a solbit drained solid rich material.

21. The non-aqueous process of claim 17, wherein the displacing and mixing is performed so that the lower sand zone is in slumped bed conditions.

22. The non-aqueous process of claim 17, wherein the displacing and mixing is performed so that the lower sand zone is in expanded fluidized bed conditions.

23. The non-aqueous process of claim 17, wherein subjecting the solvent diluted bitumen to fines separation comprises:

subjecting the solvent diluted bitumen to a first fines separation stage to produce a first bottoms stream that includes solvent, residual bitumen, the majority of fines and an overflow solvent diluted bitumen stream with residual fines; and subjecting the overflow solvent diluted bitumen stream to a second fines separation stage to remove residual fines and produce a second bottoms stream and the solvent diluted bitumen stream that is subjected to the solvent recovery.

24. The non-aqueous process of claim 23, wherein the fines separation stage utilizes gravity separation and the second fines separation stage utilizes enhanced solid-liquid separation.

25. The non-aqueous process of claim 24, wherein the fines separation stage utilizes an inclined plate separator and the second fine separation stage utilizes a vertical centrifuge.

26. The non-aqueous process of claim 24, wherein the fines separation stage is operated to effect bulk fines removal to below 5 wt % solids content, and the second fines separation stage is operated to effect polishing to remove residual fines.

27. The non-aqueous process of claim 17, wherein the solvent diluted tailings and the fines enriched material are combined and supplied together to the washing stage to produce the washed tailings and the solvent wash liquor.

28. The non-aqueous process of claim 17, wherein another portion of the solvent wash liquor is supplied back into the extraction stage.

29. The non-aqueous process of claim 28, wherein the portion of the solvent wash liquor supplied back into the extraction stage is preheated prior to being fed into the extraction stage.

30. The non-aqueous process of claim 1, wherein the washing stage comprises contacting a wash solvent with the fines enriched material counter-currently to produce the washed tailings and the solvent wash liquor.

31. The non-aqueous process of claim 1, wherein the solvent wash liquor is supplied back into the extraction stage as a sole source of the solvent.

32. A non-aqueous process for producing bitumen from oil sands, comprising:

contacting oil sands and solvent in an extraction stage to produce a solvent diluted bitumen and a solvent diluted tailings comprising coarse mineral solids;

subjecting the solvent diluted bitumen to fines separation to produce a fines stream that includes solvent, residual bitumen and fines and a solvent diluted bitumen stream;

subjecting the solvent diluted bitumen stream to solvent recovery to produce recovered solvent and a bitumen product;

subjecting the solvent diluted tailings to a washing stage to remove residual bitumen and produce washed tailings and a solvent wash liquor comprising solvent and bitumen; and adding a portion of the solvent wash liquor to the solvent diluted tailings to enable fluidization thereof prior to pumping to the washing stage.

33. A non-aqueous process for producing bitumen from oil sands, comprising:

subjecting oil sands to solvent extraction in an extraction stage to produce a solvent diluted bitumen and a solvent diluted tailings comprising coarse mineral solids, wherein the extraction stage comprises:

displacing the oil sands material and an extraction solvent in counter-current and generally horizontal fashion with respect to each other to produce the solvent diluted bitumen;

subjecting the solvent diluted bitumen to fines separation to produce a fines enriched material that includes solvent, residual bitumen and fines, and a solvent diluted bitumen stream depleted in fines;

subjecting the solvent diluted bitumen stream to solvent recovery to produce a bitumen product and recovered solvent;

subjecting the fines enriched material to a washing stage to produce washed tailings and a solvent wash liquor comprising solvent and bitumen; and fluidizing the solvent diluted tailings with a portion of the solvent wash liquor to produce a tailings mixture and pumping the tailings mixture to a downstream stage.

* * * * *